US009526973B2

(12) United States Patent
Ibach et al.

(10) Patent No.: US 9,526,973 B2
(45) Date of Patent: Dec. 27, 2016

(54) SKI BINDING AUTOMATIC FRONT UNIT

(71) Applicant: FRITSCHI AG-SWISS BINDINGS, Reichenbach im Kandertal (CH)

(72) Inventors: Stefan Ibach, Kirchdorf (CH); Andreas Fritschi, Thun (CH); Theo Eggimann, Steffisburg (CH)

(73) Assignee: FRITSCHI AG-SWISS BINDINGS, Reichenbach im Kandertal (CH)

( * ) Notice: Subject to any disclaimer, the term of this patent is extended or adjusted under 35 U.S.C. 154(b) by 288 days.

(21) Appl. No.: 13/622,861

(22) Filed: Sep. 19, 2012

(65) Prior Publication Data

US 2013/0087992 A1 Apr. 11, 2013

(30) Foreign Application Priority Data

Sep. 29, 2011 (CH) ..... 1605/11
Feb. 27, 2012 (CH) ..... 250/12

(51) Int. Cl.
*A63C 9/00* (2012.01)
*A63C 9/22* (2012.01)
(Continued)

(52) U.S. Cl.
CPC ..... *A63C 9/22* (2013.01); *A63C 9/086* (2013.01); *A63C 9/0807* (2013.01);
(Continued)

(58) Field of Classification Search
CPC ..... A63C 9/00; A63C 9/08; A63C 9/085; A63C 9/22; A63C 9/0807; A63C 9/08528; A63C 9/086; A63C 9/08571; A63C 9/08564
(Continued)

(56) References Cited

U.S. PATENT DOCUMENTS 4,134,603 A * 1/1979 Zoor ..... 280/614
4,184,696 A * 1/1980 Settembre ..... 280/615
(Continued)

FOREIGN PATENT DOCUMENTS

CH 673 402 A5 3/1990
DE 2706111 A1 8/1978
(Continued)

OTHER PUBLICATIONS

European Search Report dated Nov. 27, 2014 for corresponding Application No. EP 12 40 5102.

*Primary Examiner* — James M Dolak
(74) *Attorney, Agent, or Firm* — Birch, Stewart, Kolasch & Birch, LLP

(57) ABSTRACT

An automatic front unit for a ski binding comprises two levers which, seen in the longitudinal direction of the ski are arranged laterally opposite each other, each having means for holding the toe of a ski boot. The two levers each pivot in such a way that pivoting movement of the levers moves the holding means in a transverse direction of the ski. The front unit has a release position, in which the two holding means are at a first distance from each other and a securing position, in which the two holding means are at a smaller second distance from each other. The front unit comprises a positive control device, on which the two levers are jointly pivotable within a dynamic region in the transverse direction of the ski and the two holding means are thereby jointly moved at the second distance from each other in the transverse direction.

22 Claims, 25 Drawing Sheets

(51) Int. Cl.
*A63C 9/085* (2012.01)
*A63C 9/086* (2012.01)
*A63C 9/08* (2012.01)

(52) U.S. Cl.
CPC ..... *A63C 9/08528* (2013.01); *A63C 9/08564* (2013.01); *A63C 9/08571* (2013.01)

(58) Field of Classification Search
USPC ..... 280/601, 607, 611, 615, 616, 617, 623,280/626, 629, 630, 631, 632, 634
See application file for complete search history.

(56) References Cited

U.S. PATENT DOCUMENTS

| | | | | | |
|---|---|---|---|---|---|
| 4,348,036 | A | * | 9/1982 | Settembre | 280/615 |
| 4,632,419 | A | * | 12/1986 | Zoor | 280/614 |
| 4,913,456 | A | * | 4/1990 | Hornschemeyer et al. | 280/630 |
| 5,040,820 | A | * | 8/1991 | Rigal et al. | 280/625 |
| 5,249,820 | A | * | 10/1993 | Burger et al. | 280/614 |
| 5,364,118 | A | * | 11/1994 | Burger et al. | 280/614 |
| 5,735,541 | A | | 4/1998 | Fritschi et al. | |
| 6,105,994 | A | * | 8/2000 | Parris | A63C 9/0807 280/614 |
| 6,454,291 | B1 | * | 9/2002 | Hillairet et al. | 280/623 |
| 6,951,347 | B2 | * | 10/2005 | Buquet et al. | 280/625 |
| 8,439,389 | B2 | * | 5/2013 | Moore et al. | 280/617 |
| 8,544,869 | B2 | * | 10/2013 | Lehner | 280/611 |
| 8,894,087 | B2 | * | 11/2014 | Barthel et al. | 280/614 |
| 8,899,611 | B2 | * | 12/2014 | Alzner et al. | 280/634 |
| 9,126,095 | B2 | * | 9/2015 | Wollo et al. | |
| 9,220,969 | B2 | * | 12/2015 | Soldan | A63C 9/10 |
| 9,233,295 | B2 | * | 1/2016 | Indulti | A63C 9/0805 |
| 9,375,630 | B2 | * | 6/2016 | Pegolo | A43B 1/0054 |
| 2004/0070177 | A1 | | 4/2004 | Buquet et al. | |

FOREIGN PATENT DOCUMENTS

| | | | |
|---|---|---|---|
| DE | 19727159 | A1 | 1/1999 |
| EP | 0 199 098 | A2 | 10/1986 |
| EP | 0 754 079 | B1 | 4/1999 |
| EP | 1 393 783 | A1 | 3/2004 |
| EP | 2609972 | A1 | 7/2013 |
| EP | 2626116 | A1 | 8/2013 |
| EP | 2626117 | A1 | 8/2013 |
| WO | WO 2007/010392 | A2 | 1/2007 |
| WO | WO 2009/121187 | A1 | 10/2009 |

* cited by examiner

SKI BINDING AUTOMATIC FRONT UNIT

TECHNICAL FIELD

The invention relates to an automatic front unit for a ski binding, in particular a ski-touring binding. This automatic front unit comprises two levers, which when seen in the longitudinal direction of the ski are arranged laterally, lie opposite each other and each have a holding means for holding a ski boot in a toe region of the ski boot. The two levers are each mounted pivotably about a pivot in such a way that, when there is a pivoting movement of the levers about these pivots, the holding means are moved in a transverse direction of the ski. The automatic front unit has a release position, in which the two holding means are at a first distance from each other. Moreover, it has a securing position, in which the two holding means are at a second distance from each other, which is less than the first distance.

PRIOR ART

With regard to their function, ski bindings can be subdivided into downhill-ski bindings, which are used only for skiing downhill and skiing on ski lifts, and ski-touring bindings, which are also additionally used for walking on skis, in particular for climbing with the aid of climbing skins fastened on the skis. While the former just have to ensure reliable fixing of the ski boot on the ski in a so-called downhill position, the latter additionally have to be able for climbing purposes to be moved from the downhill position into a climbing position, in which the ski boot can be pivoted about a pivot in the transverse direction of the ski and can be lifted up from the ski in the heel region, in order to make an articulated movement between the ski boot and the ski possible for walking.

Ski-touring bindings in turn can be subdivided into two types. The one type comprises a ski-boot carrier, which can be pivoted in relation to the ski and on which the ski boot is held by binding jaws. A representative of this type of ski-touring binding is described, for example, in EP 0 754 079 B1 (Fritschi AG). The second type of ski-touring bindings does not comprise such a ski-boot carrier. In the case of this type, the ski boot is pivotably mounted in a toe region on the sole in an automatic front unit fixedly mounted on the ski. The automatic heel unit is in this case likewise fixedly attached to the ski, at a distance from the automatic front unit that is adapted to a sole length of the ski boot, and in the downhill position locks the ski boot in the heel region. In the climbing position, the heel of the boot is released from the automatic heel unit, so that the heel of the boot can be lifted up from the ski and pivoted about the mounting on the automatic front unit. Ski boots that are suitable for this type of binding typically have for this purpose two lateral recesses in the toe region for being pivotably secured in the automatic front unit. Formed on the sole of the boot in the heel region are rearwardly open recesses, in which holding means of the automatic heel unit can engage. Moreover, such ski boots have a sole that is stiff or only slightly flexible. In the latter case, the ski boots may, for example, be formed flexibly in the region of the ball of the foot.

For describing such binding systems, a (fictitious) ski is often used as a reference system, it being assumed that the binding is mounted on this ski. This custom is adopted in the present text. Thus, the expression "longitudinal direction of the ski" means along the alignment of the longitudinal axis of the ski. Similarly, "parallel to the ski" means, for an elongated object, aligned along the longitudinal axis of the ski. For a planar object, by contrast, the expression "parallel to the ski" means aligned parallel to the sliding surface of the ski. Furthermore, the expression "transverse direction of the ski" is intended to mean a direction transverse to the longitudinal direction of the ski, although it need not necessarily be oriented precisely at right angles to the longitudinal axis of the ski. Its alignment may also deviate slightly from a right angle. The expression "center of the ski" in turn means a center of the ski when seen in the transverse direction of the ski, while the expression "fixed to the ski" means non-movable in relation to the ski. Moreover, it should be noted that expressions that do not contain the word "ski" also refer to the reference system of the (fictitious) ski. Thus, the expressions "front/forward/forwardly", "rear/rearward/rearwardly", "top/above/upper/upward/upwardly", "bottom/below/lower/downward/downwardly" and "lateral/laterally" relate to "front/forward/forwardly", "rear/rearward/rearwardly", "top/above/upper/upward/upwardly", "bottom/below/lower/downward/downwardly" and "lateral/laterally" of the ski. Equally, expressions such as "horizontal/horizontally" and "vertical/vertically" also relate to the ski, "horizontal/horizontally" meaning lying in a plane parallel to the ski and "vertical/vertically" meaning aligned perpendicularly to this plane.

A ski-touring binding of the second type, introduced above, is described in EP 0 199 098 A2 (Bartel) and is sold under the name Dynafit. The binding front part of this system comprises two angled levers, which are arranged opposite each other in the transverse direction of the ski and are each mounted pivotably about a pin running in the longitudinal direction of the ski. The two angled levers each have an arm that is directed upward and an arm that is aligned sideward, which are arranged at right angles to each other. The upwardly aligned arms each comprise a frustoconical or hemispherical stud which points toward the center of the ski and can engage in depressions intended for the purpose in the toe region of a ski boot. Like the studs, the sidewardly aligned arms of the angled levers point toward the center of the ski, but are in operative connection with each other by way of a spring device. Since, by way of the sidewardly aligned arms, the two angled levers are spring-loaded with respect to each other by the spring device, they can snap into place in the downward and upward directions by overcoming a dead center position, in which the two sidewardly directed arms are aligned in linear extension in relation to each other. When the sidewardly aligned arms have snapped into place in the downward direction, the upwardly directed arms are pivoted together. By contrast, when the sidewardly aligned arms have snapped into place in the upward direction, the upwardly directed arms are pivoted apart. Correspondingly, the studs for holding a ski boot are closer together in the first case and further apart in the second case. In the first case, as a result a ski boot can be secured, or pivotably mounted, between the two angled levers by means of the studs. Therefore, this position of the binding front part is a securing position. By contrast, in the second case the holding means are sufficiently far apart for the ski boot to be released. This position of the binding front part is correspondingly a release position.

In order to bring the binding front part from the securing position into the release position and back, the binding front part described in EP 0 199 098 A2 (Bartel) comprises an opening lever, which is pivotable about a pin aligned in the transverse direction of the ski and which reaches over and under around the connection of the two laterally aligned arms of the angled levers. By actuating this opening lever, the laterally aligned arms of the angled levers can be pressed in the upward direction, where they snap into place in the release position. By reverse actuation of the opening lever, however, the laterally aligned arms of the angled levers can also be pressed in the downward direction, where they snap into place in the securing position.

In the event of a fall, the ski boot can also be released from the ski binding system without actuation of the opening lever. For this purpose, the ski boot is first released from the automatic heel unit and then from the binding front part. If a frontal fall is concerned, the ski boot is released in the upward direction by the automatic heel unit and tilted forward in the binding front part. If the forwardly or upwardly acting force on the ski boot is sufficiently great, the ski boot is also torn out of the binding front part, by the force acting on the two angled levers being overcome. If, by contrast, a lateral fall is concerned, the ski boot is released by the automatic heel unit in the lateral direction and turned about a vertical pin lying in the toe region of the ski boot. In this case the ski boot comes away from the binding front part in a rotating manner, by the force acting on the angled levers being overcome.

On account of this possibility of the binding front part coming away, there is the problem that, in the climbing position, the ski boot may unintentionally come away from the binding front part, and consequently be detached entirely from the ski, due to a lateral torque. According to EP 0 199 098 A2 (Bartel), such unintentional release can be prevented by the opening lever, and consequently the two angled levers, being blocked.

A further development of the binding front part according to EP 0 199 098 A2 (Bartel) is described in WO 2009/121187 A1 (G3 Genuine Guide Gear Inc.). Here, the sidewardly aligned arms of the angled levers do not snap into place in the release position, but are always pretensioned toward the securing position. As a result, the angled levers are not moved beyond a dead center position. Correspondingly, they must be secured in the release position by a stopper, in order that they do not snap into the securing position.

Both the binding front part according to EP 0 199 098 A2 (Bartel) and the binding front part according to WO 2009/121187 A1 (G3 Genuine Guide Gear Inc.) have the disadvantage that a release can take place in an uncontrolled manner. In the event of a release, the two angled levers are pressed apart in an undefined way by a force (or torque) acting on the ski boot, whereby the ski boot is detached from the binding front part.

A slightly different approach is adopted in the case of the automatic front unit that is described in WO 2007/010392 A2 (Ski Trab S.R.L.). This automatic front unit does likewise comprise two angled levers, which each comprise two arms arranged substantially at right angles to each other. First arms of these angled levers do likewise each comprise a frustoconical or hemispherical stud pointing toward the center of the ski for holding a ski boot. Moreover, second arms of these angled levers are likewise aligned laterally in relation to the center of the ski, pointing toward each other. As a difference from the automatic front units described above, however, the two angled levers are mounted pivotably about vertical pins, the pins being arranged in front of the toe region of the ski boot. Moreover, the second arms of the angled levers are not in direct operative connection, but each engage with their end in a lateral notch of a pivoting lever aligned in the longitudinal direction of the ski. This pivoting lever is displaceable in the longitudinal direction of the ski, the ends of the second arms of the two angled levers being carried along in the lateral notches. Correspondingly, when there is a displacement of the pivoting lever, the two angled levers are pivoted together or apart, whereby a transfer of the automatic front unit from the release position into the securing position and back is achieved.

In addition to the displaceability in the longitudinal direction of the ski, the pivoting lever is mounted on the automatic front unit pivotably about a vertical pin, although it is pressed by two springs into an alignment parallel to the ski. Therefore, with a force acting laterally on the ski boot, the outer of the two angled levers can be pressed in the outward direction, by the pivoting lever being slightly pivoted laterally against the spring force until the angled lever is released from the lateral notches in the pivoting lever. At the same time, the inner angled lever is slightly pivoted in the inward direction by the pivoting movement of the pivoting lever, following the outer angled lever. As a result, the automatic front unit according to WO 2007/010392 A2 (Ski Trab S.R.L.) makes a lateral release possible, in which the mounting of the ski boot is first loosened and is released completely as soon as the outer angled lever is released. Furthermore, the automatic front unit makes a frontal release possible, which however takes place in just as uncontrolled a manner as in the case of the binding front parts according to EP 0 199 098 A2 (Bartel) and WO 2009/121187 A1 (G3 Genuine Guide Gear Inc.).

Also in the case of the automatic front unit according to WO 2007/010392 A2 (Ski Trab S.R.L.), there is the problem that, in the climbing position, the ski boot can unintentionally come out from the automatic front unit on account of a lateral force, and thereby be detached entirely from the ski. According to WO 2007/010392 A2 (Ski Trab S.R.L.), such unintentional release can be prevented by the pivoting lever, and consequently the two angled levers, being blocked.

The disadvantage of these known binding front parts and automatic front units is that they only offer limited safety for the skier. As already mentioned, the two binding front parts according to EP 0 199 098 A2 (Bartel) and WO 2009/121187 A1 (G3 Genuine Guide Gear Inc.) do not offer a defined safety release either in the frontal direction or in the lateral direction. The automatic front unit according to WO 2007/010392 A2 (Ski Trab S.R.L.) does offer lateral safety release to a limited extent. However, on account of the interaction of the two angled levers with the pivoting lever, this involves a continuous spreading, and consequently opening, of the two angled levers before the outer angled lever is entirely released and pivoted away. In this case the ski boot is at least beginning to be become detached already during the spreading of the angled levers. Moreover, the automatic front unit according to WO 2007/010392 A2 (Ski Trab S.R.L.) also does not offer frontal release. It only allows that the ski boot can be torn out of the automatic front unit under the effect of sufficient force in the forward or upward direction. Therefore, these known automatic front units offer little safety for a skier.

SUMMARY OF THE INVENTION

The object of the invention is to provide an automatic front unit belonging to the technical field mentioned at the beginning that increases the safety for a skier.

The solution by which the object is achieved is defined by the features of claim 1. According to the invention, the automatic front unit comprises a positive control device, on which the two levers are mounted in the securing position such that the two levers are movable in a coupled state within a dynamic region in the transverse direction of the ski and the two holding means are thereby moved in a coupled state, at the second distance from each other, on a dynamic path in the transverse direction of the ski. The coupled movement of the two levers along the dynamic region may in this case be, for example, a pivoting movement of the two levers about the pivots. However, the coupled movement of the two levers along the dynamic region may also be, for example, a linear movement along a linear path that corresponds to a translational movement of the two levers in which the two levers are displaced in a coupled manner in the transverse direction of the ski. The coupled movement of the two levers along the dynamic region may, however, also be for example a linear movement along a linear path that corresponds to a combination of a translational movement and a pivoting movement of the two levers in which the two levers are displaced in a coupled manner in the transverse direction of the ski and are pivoted about the pivots.

The dynamic region may be limited on one or both sides by a stop, by which at least one of the two levers is stopped and is hindered in its further freedom of movement. However, there is also the possibility that the dynamic region is limited on one or both sides by the two levers no longer being movable in a coupled state, but in a decoupled state, as from a certain position. However, it goes without saying that there is also the possibility that the dynamic region for one of the levers is limited by a stop and for the other of the levers is limited by it being movable in a decoupled state as from a certain position. In this respect, the type of limitation for the two levers may also be dependent on the side of the dynamic region. This means that, for example, the dynamic region is limited on a first side for a first of the two levers by a stop and is limited for a second of the two levers by it being movable in a decoupled state as from a certain position. At the same time, the dynamic region on a second side may be limited for the first lever by it being movable in a decoupled state as from a certain position, while the dynamic region on the second side is limited for the second lever by a stop.

The solution has the advantage that a ski boot held in the automatic front unit can be moved together with the two holding means in the securing position on the dynamic path in the transverse direction of the ski. This movement allows energy to be absorbed by the automatic front unit without the ski boot being detached from the automatic front unit. This is advantageous when skiing, and in the possible event of a fall, since the ski or the ski boot may undergo impact under which the ski boot should not come out from the automatic front unit. In order to set an intensity of the impact that can be withstood, the energy that can be absorbed by the automatic front unit can in this case be predetermined by the length of the dynamic path and/or a force of resistance that must be applied for the movement to occur being adapted. Correspondingly, a controlled safety release that is released if the energy of an impact should happen to exceed the energy that can be absorbed may be provided.

In a first, preferred variant, in the securing position, the two levers are pivotable about the pivots in a coupled state within the dynamic region in the transverse direction of the ski. This has the advantage that the movement of the two levers is guided by the pivots.

In a second, preferred variant of this, the two levers are movable in a coupled state along a linear path within the dynamic region in the transverse direction of the ski. This may involve, for example, a translational movement of the two levers, in which the two levers are displaced in a coupled state in the transverse direction of the ski. This has the advantage that, in the securing position, a stable connection between the two levers that keeps the two holding means on the levers at the second distance from each other can be predetermined. However, the movement of the two levers along the linear path may, for example, also involve a combination of a translational movement and a pivoting movement of the two levers in which the two levers are displaced in a coupled state in the transverse direction of the ski and are pivoted about the pivots. This has the advantage that a progression of the dynamic path of the holding means can be formed in such a way that forces which act from various directions on a ski boot held in the automatic front unit can be absorbed optimally by the automatic front unit.

In a preferred embodiment, the automatic front unit for a ski binding, in particular a ski-touring binding, comprises two levers, which when seen in the longitudinal direction of the ski are arranged laterally, lie opposite each other and each have a holding means for holding a ski boot in a toe region of the ski boot. The two levers are preferably each mounted pivotably about a pivot and the holding means are moved by the levers in a transverse direction of the ski when there is a pivoting movement, the automatic front unit preferably comprising an element referred to as a positive control device and the two levers being able to be mounted on this positive control device and on another element of the automatic front unit. The automatic front unit preferably has a release position, in which the two holding means are at a first distance from each other. Furthermore, the automatic front unit preferably has a securing position, in which the two holding means are at a second distance from each other, which is less than the first distance. Advantageously, in the securing position, the two levers are in this case movably mounted on the positive control device, which is likewise movable in the securing position. In this case the two levers are preferably pivotable in a coupled state within a dynamic region in the transverse direction of the ski by the movable positive control device, the two holding means being moved in a coupled state, at the second distance from each other, on a dynamic path in the transverse direction of the ski. How the positive control device is moved in this case is not predetermined. It may, for example, involve a linear movement or a pivoting or rotating movement.

In a further, preferred embodiment, the automatic front unit for a ski binding, in particular a ski-touring binding, comprises two levers, which when seen in the longitudinal direction of the ski are arranged laterally, lie opposite each other and each have a holding means for holding a ski boot in a toe region of the ski boot. The two levers are preferably each mounted pivotably about a pivot and, when there is a pivoting movement, the holding means are moved by the levers in a transverse direction of the ski, the automatic front unit preferably comprising an element referred to as a positive control device and the pivots being mounted on this positive control device. The automatic front unit preferably has a release position, in which the two holding means are at a first distance from each other. Furthermore, the automatic front unit preferably has a securing position, in which the two holding means are at a second distance from each other, which is less than the first distance. Advantageously, the two levers are in this case mounted on the positive control device, which is movable in the securing position. In this case the two levers are preferably movable in a coupled state within a dynamic region in the transverse direction of the ski by the movable positive control device, the two holding means being moved in a coupled state, at the second distance from each other, on a dynamic path in the transverse direction of the ski. How the positive control device is moved in this case is not predetermined. It may, for example, involve a linear movement or a pivoting or rotating movement.

However, preferred embodiments of the automatic front unit may also be differently formed. It is shown hereafter on the basis of advantageous features how such other preferred embodiments may be formed. However, it goes without saying that the two aforementioned, preferred embodiments may also comprise one or more of these advantageous features.

Advantageously, the pivots of the levers are arranged in a plane parallel to the ski. This has the advantage that the pivots can be arranged underneath the holding means, whereby a compact type of construction of the automatic front unit is achieved. Moreover, the pivots are preferably aligned substantially parallel to the ski, while it is possible for deviations of an alignment parallel to the ski of 10 degrees or of 20 degrees to be provided. However, the lateral deviation of the pivots from an alignment parallel to the ski is preferably less than 10 degrees. If the levers are pivotable within the dynamic region and the dynamic path of the holding means correspondingly lies in a plane perpendicular to the pivot of the respective lever, a plane of the dynamic paths of the holding means is thereby aligned substantially in the transverse direction of the ski. If, by contrast, the two levers are movable in a coupled state within the dynamic region in the transverse direction of the ski along a linear path, a continuation of the movement of the holding means in the transverse direction of the ski may be achieved by the alignment of the pivots when there is a pivoting movement of the levers about the pivots. In both cases, this arrangement of the pivots is advantageous for the case where the automatic front unit provides a lateral safety release. In the case of such a lateral safety release, a movement of the ski boot runs substantially in a plane parallel to the ski.

In this case the movement of the ski boot may comprise both a linear movement and a rotation about a vertical axis of the ski boot. Since the plane of the dynamic path is consequently aligned substantially at right angles to the plane of movement of the ski boot, the dynamic path of the holding means is best able to absorb movements of the ski boot that are caused by variously aligned force effects running in the transverse direction of the ski. Correspondingly, the energy that can be absorbed by the automatic front unit can be predetermined as best as possible for various force effects. Predetermining the energy that can be absorbed in turn makes possible a controlled, lateral safety release, which comes into effect when the energy that can be absorbed is exceeded.

As an alternative to this, however, there is also the possibility that the pivots are differently aligned. For example, they may also be aligned vertically or at any desired angle to the longitudinal direction of the ski.

Advantageously, both levers each comprise on a side facing the center of the ski a control jaw for interaction with a ski boot. These control jaws may each be, for example, an element attached to the corresponding lever and protruding toward the center of the ski. The control jaws have the advantage that, when there is a pivoting movement of the two levers, as from a certain pivoting angle the control jaw of the lever lying in the direction of movement can interact with the ski boot and, as a result, the holding means of this lever can be detached from the ski boot. This correspondingly has the advantage that the operation of a lateral safety release from the automatic front unit can be simplified. This means that, if the automatic front unit provides a lateral safety release, the sequence of movements of the ski boot in the case of a lateral safety release becomes more continuous, and consequently the safety for the skier is increased. If the levers are pivotable about the pivots within the dynamic region, when there is a pivoting movement of the levers the control jaws may in this case already interact with the ski boot within the dynamic region. If, by contrast, the two levers are movable along a linear path within the dynamic region, and for example at least one of the two levers is pivotable about the corresponding pivot when there is a lateral safety release, the corresponding control jaw may interact with the ski boot when there is a safety release, whereby the ski boot can be detached more easily from the automatic front unit.

As a variant of this, there is also the possibility that the control jaws are not formed as a separate element. They may, for example, each be produced in one piece together with the corresponding lever, or else the levers may also be formed in such a way that, for example, a bow in the lever undertakes the function of a control jaw. In this last variant, the levers comprise a control-jaw-like bow, which should likewise be understood as included by the expression control jaw.

As an alternative to this, however, the two levers may also not comprise a control jaw arranged on the side of the levers that is directed toward the center of the ski. If, for example, the holding means are formed in such a way that they easily come away from the ski boot when the levers are pivoted beyond a certain angle, this alternative may be advantageous, since as a result the construction of the automatic front unit is simplified and the production thereof becomes less costly.

In the securing position, the positive control device is preferably movable along a positive control path, whereby the two levers are movable in a coupled state within the dynamic region. If the two levers are movable within the dynamic region along a linear path, in the securing position the two levers are preferably fixedly mounted on the positive control device, whereby the two levers are movable in a coupled state within the dynamic region. If, by contrast, the two levers are pivotable about the pivots within the dynamic region, in the securing position the positive control device is preferably movable along a positive control path when there is a coupled pivoting movement of the two levers within the dynamic region of the two levers. How precisely the positive control device is moved in these two cases is not predetermined. Their movement may, for example, be a movement in a linear direction, a pivoting or rotating movement, or a combination thereof. If the movement of the positive control device is a rotating or pivoting movement, the positive control path may consequently be an angle of rotation. If, by contrast, the movement is a combination of a linear direction and a pivoting or rotating movement, the positive control path may be a combination of an angle of rotation and a linear path. In the case of such a combination, there is moreover the possibility, for example, that the positive control device as a whole is moved in a combined movement. However, there is also the possibility, for example, that one or more elements of the positive control device are moved in a linear direction, while one or more further elements of the positive control device are turned or pivoted. All such movements of the positive control device along the positive control path have the advantage that, in the securing position, a coupled pivoting movement of the two levers along the dynamic region can be achieved in a simple way.

If the movement of the positive control device is a movement in a linear direction, a pivoting movement or a combination thereof, the movement, and consequently also the positive control path, are preferably aligned in the transverse direction of the ski. This has the advantage that the positive control device can join in the coupled pivoting movement of the two levers, whereby the construction of the automatic front unit is simplified.

As an alternative to this, however, there is also the possibility that the positive control device is not movable in the securing position, but is arranged fixed on the ski.

If the positive control device is movable in the securing position, when there is a deviation from a center of the positive control path it can be pressed with a force toward the center of the positive control path, preferably by a pretensioned, elastic element. In this respect there is also the possibility that there is more than one pretensioned, elastic element. Irrespective of the number of elastic elements, this has the advantage that the positive control device is moved by the elastic element or elements into the center of the positive control path if no other force is acting on the positive control device. In this case the two levers may also be moved with the positive control device into a center of the dynamic region. Correspondingly, the two levers can be moved both in a first direction and in a second direction along the dynamic region under the effect of a lateral force starting to occur from this center of the dynamic region, it being moved back toward the center of the dynamic region when the lateral force no longer occurs. Consequently, if when skiing there is a laterally directed impact or a laterally directed force on the ski boot or the ski, the corresponding energy can be absorbed by the automatic front unit without the ski boot coming away, no matter from which side the impact or the force comes.

The mentioned center of the positive control path and the mentioned center of the dynamic region may be the geometrical center of the positive control path or of the dynamic region. However, it may also be a location in the positive control path or dynamic region that does not lie at the geometrical center. There is the possibility that these centers lie in a continuous region of the positive control path or of the dynamic region. In this case the centers are determined by the positive control device or the levers being pressed by the elastic element or elements against this location in the positive control path or in the dynamic region. However, there is also the possibility that the centers lie in a kink in the positive control path or dynamic region. For example, the positive control path may be v-shaped and the center of the positive control path may lie at the tip of the "v". In this case, starting from the center of the positive control path, the positive control device can be moved along one or the other arm of the "v", depending on the direction of the lateral force or the lateral impact. However, the center of the positive control path may, for example, also be at one end of the positive control path. This may be the case in particular whenever the positive control path runs along the longitudinal direction of the ski. Then, the positive control device may be movable in the longitudinal direction of the ski starting from this end of the positive control path, though in this example in the securing position the two levers are mounted on the positive control device in such a way that they are pivotable in the direction of effect of the lateral force or the lateral impact, while the positive control device is moved in the longitudinal direction of the ski independently of the direction of effect of the lateral force.

As a variant of this, there is also the possibility that not the positive control device but one or both levers can be pressed into the center of the dynamic region by one or more pretensioned, elastic elements. However, it is also equally possible that both levers can each be separately pressed into the center of the dynamic region by one or more pretensioned, elastic elements. In both cases, a corresponding embodiment may be advantageous particularly whenever the positive control device itself is arranged fixed on the ski.

In all of these variants with the pretensioned, elastic element or elements, the pretensioned, elastic element is preferably aligned in the longitudinal direction of the ski in the center of the ski. In a first preferred variant of this, the pretensioned, elastic element presses on the positive control device in the longitudinal direction of the ski, by it pressing a laterally guided, and thereby laterally non-displaceable, ram into a horizontally arranged, substantially v-shaped indentation in the positive control device. In this case the positive control device that is movable in the transverse direction of the ski can be held in the center of the positive control path, by the ram being pressed into a tip of the v-shaped indentation. Correspondingly, starting from the center of the positive control path, the positive control device can be moved along the positive control path, the ram being pressed by the corresponding flank of the substantially v-shaped indentation in the longitudinal direction of the ski counter to the pretensioned force of the elastic element. In this case the force of the elastic element, acting by way of the ram onto the flanks of the substantially v-shaped indentations and directed in the longitudinal direction of the ski, brings about a driving-back force, which respectively drives the positive control device back into the center of the positive control path. In order to minimize the frictional resistance between the positive control device and the ram, the ram may, for example, have at its tip a roller bearing which can roll on the flanks of the substantially v-shaped indentation in the positive control device. However, there is also the possibility that the ram does not have a roller bearing, but that the ram and/or the substantially v-shaped indentation in the positive control device have a special coating that reduces the frictional resistance. Furthermore, there is the possibility that the ram has at its tip a roller bearing which can roll on a special coating of the substantially v-shaped indentation in the positive control device. However, there is also the possibility that the ram does not comprise such a roller bearing and that neither the ram nor the substantially v-shaped indentation in the positive control device has a special coating.

If a pretensioned, elastic element is present and it is aligned in the longitudinal direction of the ski in the center of the ski, in a second preferred variant the pretensioned, elastic element presses on the positive control device in the longitudinal direction of the ski, by it pressing a laterally guided, and thereby laterally non-displaceable, ram against a laterally guided, and thereby laterally non-displaceable, pivoting element, so that a first foot of the pivoting element is pressed into a substantially v-shaped indentation in the positive control device. In this case the pivoting element may, for example, comprise a second foot and a third foot, which are arranged on the pivoting element, each on one side of the center of the ski, and are aligned toward the ram. Thus, the positive control device that is movable in the transverse direction of the ski can be held in the center of the positive control path, by the second and third feet of the pivoting element being supported on a front side of the ram and by the first foot of the pivoting element being pressed into a tip of the substantially v-shaped indentation. Correspondingly, starting from the center of the positive control path, the positive control device can be moved along the positive control path.

The first foot of the pivoting element, which is pressed into the substantially v-shaped indentation, is thereby moved along with it. If the pivoting element is mounted pivotably about a pivot between its three feet, as a result the pivoting element is pivoted such that, depending on the pivoting direction, only the second or the third foot of the pivoting element is supported on the ram. Since the corresponding foot is thereby moved toward the center of the ski, the ram is moved against the pretensioning of the pretensioned, elastic element. At the same time, the force with which the ram is pressed against the pivoting element presses the pivoting element back into its central alignment, in which the second and third feet of the pivoting element are supported on the front side of the ram. Correspondingly, as a result the positive control device is driven back into the center of the positive control path. In such a variant there is additionally the possibility that the pivoting element or the pivot of the pivoting element is mounted slightly displaceably in the longitudinal direction of the ski.

If a pretensioned, elastic element is present and it is aligned in the longitudinal direction of the ski in the center of the ski, in a third preferred variant the pretensioned, elastic element presses on the positive control device in the longitudinal direction of the ski, by it pressing a laterally guided, and thereby laterally non-displaceable, ram against a pivotable element of the positive control device. The ram may, for example, thereby be pressed into a tip of a horizontally arranged, substantially v-shaped indentation in the pivoting element, whereby the pivotable element is aligned substantially in the longitudinal direction of the ski and the positive control device that is movable in the transverse direction of the ski is held in the center of the positive control path. In this case, starting from the center of the positive control path, the positive control device can be moved along the positive control path, by the pivotable element being pivoted in the corresponding direction. Together with the pivotable element, the v-shaped indentation is thereby also pivoted, whereby one of the two flanks of the v-shaped indentation is pressed against the ram, which as a result is moved counter to the force of the elastic element directed in the longitudinal direction of the ski. In this case the force of the elastic element, acting by way of the ram onto the flanks of the substantially v-shaped indentation and directed in the longitudinal direction of the ski, brings about a driving-back force, which respectively drives the positive control device back into the center of the positive control path.

However, in the case of a pivotable element of the positive control device there is also the possibility that the ram has, for example, at its front end a separate pivotable element, which is pressed against the pivotable element of the positive control device. With a suitable arrangement of the pivots of the two pivoting elements, the pivotable element of the positive control device can thereby likewise be aligned substantially in the longitudinal direction of the ski and the positive control device that is movable in the transverse direction of the ski can be held in the center of the positive control path. In this case, starting from the center of the positive control path, the positive control device can likewise be moved along the positive control path, by the pivotable element being pivoted in the corresponding direction. The separate pivotable element at the front end of the ram is thereby pivoted with it and the ram is moved counter to the force of the elastic element. This brings about a driving-back force, which respectively drives the positive control device back into the center of the positive control path.

If a pretensioned, elastic element is present and it is aligned in the longitudinal direction of the ski in the center of the ski, in a fourth preferred variant the pretensioned, elastic element presses on the positive control device in the longitudinal direction of the ski, by it pressing a laterally guided, and thereby laterally non-displaceable, ram against at least one pivotably mounted lever, which as a result is for its part pressed against a pivotable element of the positive control device. In this case there is the possibility that there are, for example, two pivotably mounted levers, which are arranged next to each other, when seen in the transverse direction of the ski, in such a way that the pivotable element is aligned substantially in the longitudinal direction of the ski and the positive control device that is movable in the transverse direction of the ski is held in the center of the positive control path. In order to achieve this, the two pivotably mounted levers may, for example, be arranged with their pivots in such a way that a force of the ram is transferred in a stepped-up form to the pivotable element of the positive control device. However, there is also the possibility that the two pivotably mounted levers are arranged with their pivots in such a way that a force of the ram is transferred in a stepped-down form to the pivotable element of the positive control device. Independently of these possibilities, in the fourth preferred variant, starting from the center of the positive control path, the positive control device can be moved along the positive control path, by the pivotable element being pivoted in the corresponding direction. If only one pivotably mounted lever is present, as a result this lever can be pivoted and the ram pressed by the lever counter to the driving-back force. If, by contrast, there are for example two pivotably mounted levers, the one or the other pivotable lever may be pivoted for example by the pivoting movement of the pivotable element of the positive control device, depending on the pivoting direction of the pivotable element, by the pivotable element pressing against this lever on account of its pivoting movement. This allows the corresponding pivotable lever to be pressed against the ram, whereby the latter is in turn moved counter to the driving-back force.

If the pretensioned, elastic element is aligned in the longitudinal direction of the ski in the center of the ski, there is, however, along with these four preferred variants, also the possibility that the pretensioned, elastic element interacts in some other way with the positive control device.

Moreover, there is the possibility that the pretensioned, elastic element is not aligned in the longitudinal direction of the ski in the center of the ski. For example, it may be aligned along the positive control path or along the dynamic region. However, there is also the possibility that it is differently aligned and, by its pretensioning, exerts a force on a deflecting mechanism which deflects the action of the force into a direction along the positive control path or along the dynamic region.

The automatic front unit preferably has a safety release position. Moreover, in the securing position, the two levers can advantageously be moved up to one end of the dynamic region, where the one of the two levers that comprises the holding means that has been moved away from the center of the ski on the dynamic path can be released by the positive control device and can be pivoted away by the other of the two levers, whereby the automatic front unit can be brought from the securing position into the safety release position. This has the advantage that a lateral safety release is made possible. Since the one of the two levers that lies in the direction of movement can be pivoted away, the corresponding holding means is also pivoted away, whereby a ski boot secured in the securing position is released in its direction of movement as soon as the two levers in the securing position are moved up to the corresponding end of the dynamic region. This has the advantage that, when there is a safety release, a continuous movement of the ski boot from a position secured in the securing position to a release in the safety release position is ensured. Since, as already described above, during this operation a predeterminable energy can be absorbed by the automatic front unit in the securing position, by the two levers being moved up to one end of the dynamic region, this is a controllable, lateral safety release.

In the securing position, the two levers are preferably each mounted on the positive control device by a first slotted link and a first slider mounted therein. Furthermore, in the safety release position, preferably at least one of the two levers is released, by the corresponding first slider having come out from the corresponding first slotted link. In this case there is the possibility that, at least in the securing position, the first slotted links enclose and guide the respective first slider on both sides. However, there is also the possibility that the first slotted links do not enclose and guide the respective first slider on both sides but only guide it on one side or only guide it on both sides over one region and otherwise guide it on one side. Guide it on one side means here that, for example, the respective first slider is only in contact with the corresponding first slotted link on one side. In this case the first slotted links may be, for example, a surface on which the respective first slider is supported and along which the respective first slider is movable. In this case the first sliders may, for example, be pressed against the respective first slotted link by means of an elastic element. Correspondingly, irrespective of whether the first slotted links enclose the first sliders on both sides or only on one side, the phrasing that a first slider is guided in the corresponding first slotted link is used here. Irrespective of the actual shape and form of the first slotted links, the first sliders may be formed in a wide variety of ways. For example, they may be formed cylindrically. However, they may, for example, also be formed cylindrically and each have a roller enclosing them, by which their mounting in the corresponding first slotted link is improved. Furthermore, however, there is also the possibility that the two first sliders are formed for example as blocks. Moreover, there is the possibility that the two first sliders comprise differently shaped regions. For example, they may each have a cylindrical region and each have one or more further regions. It is possible in this case, for example, that, depending on the region of the first slotted link, the cylindrical region or a different region of the respective first slider interacts with the first slotted link. All of these types of first slotted links with first sliders mounted therein have the advantage that, in the securing position, the two levers are mounted on the positive control device and, in the safety release position, at least one of the two levers is released and, as a result, has the best possible freedom of movement.

As a preferred variant of this, however, there is also the possibility that, for example, in the securing position and in the safety release position, one or both levers are each mounted on the positive control device by a first slotted link and a first slider mounted therein. This has the advantage that, both in the securing position and in the safety release position, the two levers are mounted on the positive control device. As a result, a return of the automatic front unit from the safety release position into the securing position is made easier in particular. In order to achieve this, as already described, both the first slotted links and the first sliders are formed in a wide variety of ways.

Instead of these variants, the two levers may, however, also not be mounted on the positive control device by a first slotted link and a first slider mounted therein. For example, the pivots of the levers may be mounted on the positive control device, while the levers are mounted on a further element of the automatic front unit by a first slotted link and a first slider mounted therein. In this case the levers may be mounted on the further element both in the securing position and in the safety release position or else only in the securing position.

As an alternative to these variants, however, the levers may also be mounted on the positive control device or on the further element differently than by first slotted links and first sliders. Such a mounting may, for example, be formed by a movable lever connection or ram connection.

If first slotted links and first sliders are present and if the first sliders are mounted in the corresponding first slotted link in the securing position, the first slotted links preferably have a geometry such that, in the safety release position, the one of the two levers that comprises a holding means that is moved away from the center of the ski on the dynamic path is pivotable. In this case, in the safety release position, the corresponding lever can be pivoted by movement of the corresponding first slider in the corresponding first slotted link or be released from the corresponding first slotted link. If, in the safety release position, the corresponding first slider can be pivoted in the corresponding first slotted link, this has the advantage that the two levers are mounted on the positive control device or on the further element of the positive control device both in the securing position and in the safety release position, and that consequently a return of the automatic front unit from the safety release position into the securing position is made easier. If, by contrast, in the safety release position the corresponding first slider is released by the corresponding first slotted link, this has the advantage that the two levers are mounted on the positive control device or on the further element of the positive control device in the securing position and that the one of the two levers that comprises the holding means that is moved away from the center of the ski on the dynamic path is pivotable unhindered in the safety release position.

If first slotted links are present and they have such a geometry that the first sliders are mounted in the corresponding first slotted link in the securing position and in the safety release position, the first slotted links are preferably widened in a region in which the corresponding first slider is movable in the corresponding first slotted link in the safety release position when the corresponding lever is pivoted. This has the advantage that the one of the two levers that is pivotable in the safety release position can be moved more easily, since the corresponding first slider is loosely guided in this region of the corresponding first slotted link, and therefore no frictional resistance, or only very little, occurs between the corresponding first slider and the corresponding first slotted link.

Irrespective of whether the first sliders are mounted in the corresponding first slotted link only in the securing position or both in the securing position and in the safety release position, the first slotted links also preferably have a corner in their shape about which the corresponding first slider is moved when the corresponding lever is released during a transition from the securing position to the safety release position. This has the advantage that the lever is released immediately when there is a safety release, and consequently the transition from the securing position into the safety release position takes place quickly.

Advantageously, the first slotted links have a geometry such that, in the safety release position, the one of the two levers that comprises the holding means that is moved toward the center of the ski on the dynamic path is fixed. This can be achieved, for example, by the corresponding first slider butting against one end of the corresponding first slotted link. However, this may also be achieved by the corresponding lever being guided by the first slotted link in such a way that it butts against another stop and, as a result, is hindered in its further movement. If the positive control device is movable along a positive control path in the securing position, this can however also be achieved, for example, by a further movement of the positive control device being blocked in the safety release position, whereby a further movement of the corresponding lever is also prevented. For this purpose, the further movement of the positive control device may take place for example by a stop. These three variants have the advantage that, in the safety release position, a free movement of the one of the two levers that comprises the holding means that is moved toward the center of the ski on the dynamic path is prevented. This allows a controlled release of the ski boot to be achieved when there is a lateral safety release.

As a variant of this, however, there is also the possibility that the first slotted links have a geometry such that, in the safety release position, the one of the two levers that comprises the holding means that is moved toward the center of the ski on the dynamic path is pivotable within a limited region, while the other lever is freely pivotable. Also in this way, a controlled release of the ski boot can be achieved when there is a lateral safety release.

As an alternative to this, in the safety release position, the two levers may however also be pivotable in a coupled state as a result of the geometry of the first slotted links, although the one of the two levers that comprises the holding means that is moved away from the center of the ski on the dynamic path is more pivotable proportionately than the other lever.

The positive control device is preferably arranged fixed on the ski in the safety release position. If, in the securing position, the positive control device is movable along the positive control path, for this purpose the positive control device may, for example, be hindered from further movement beyond the end of the positive control path by a stop. However, there is also the possibility that, in the safety release position, one of the two levers is hindered from further movement by a stop and, by its mounting on the positive control device, hinders the positive control device from further movement. If the two levers are mounted on the positive control device or on the further element of the automatic front unit by a first slotted link and a first slider, it can however also be achieved by a geometry of the first slotted link that the positive control device is arranged fixed on the ski in the safety release position.

As an alternative to this, the positive control device may, however, also be movable in the safety release position.

If the positive control device is movable in the securing position and the automatic front unit comprises a pretensioned, elastic element aligned in the longitudinal direction of the ski in the center of the ski and if the positive control device has a substantially v-shaped indentation, hollows are advantageously arranged in outer regions of the two flanks of the v-shaped indentation. This has the advantage that, depending on the embodiment, for example a roller bearing arranged at the tip of a ram that is subjected to a force by the pretensioned, elastic element can interact with one of these hollows when the positive control device is in the safety release position. In another embodiment, this allows for example a first foot of a pivoting element to interact with one of these hollows when the positive control device is in the safety release position. In both cases, the hollows have the advantage here that the driving-back force that acts on the positive control device as a result of the ram or as a result of the pivoting element and drives it toward a center of the positive control path is minimized or made to cease completely in the safety release position. In this case it is of no matter whether the positive control device is arranged fixed on the ski or else movably in the safety release position. However, by minimizing the driving-back force or making it cease, the hollows can support a fixed-on-the-ski arrangement of the positive control device in the safety release position.

As a variant of this, there is also the possibility that two hollows are arranged on a front side of the ram. This is advantageous particularly whenever the driving-back force that drives the positive control device toward a center of the positive control path is transferred by a pivoting element. In this case the second or third foot of the pivoting element may interact with one of these hollows when the positive control device is in the safety release position. This variant likewise has the advantage that the driving-back force that drives the positive control device toward a center of the positive control path is minimized or made to cease completely in the safety release position.

As an alternative to this, however, there is also the possibility that two hollows are not arranged in the outer regions of the two flanks of the substantially v-shaped indentation in the positive control device or on the front side of the ram. Such an alternative embodiment may be advantageous, for example, if the driving-back force that drives the positive control device toward a center of the positive control path is minimized or made to cease completely in the safety release position in some other way. If the positive control device comprises a pivotable element in which the substantially v-shaped indentation is arranged, this can be achieved for example by a corresponding interaction of the pivotable element with the rest of the positive control device.

The two levers are preferably mounted on the positive control device in the release position such that the holding means of the two levers are at the first distance from each other. This has the advantage that the two levers, and consequently the distance between the two holding means, in the release position can be controlled by the positive control device.

As an alternative to this, in the release position the two levers may also have come away from the positive control device. In this case, however, both levers may be respectively mounted on the positive control device when the automatic front unit is transferred from the release position into the securing position, it also being intended for the distance between the two holding means to be reduced from the first distance to the second distance during this transfer. This may be implemented, for example, by the two levers being mounted on a variable spacer in the release position. During the transfer from the release position into the securing position, the distance between the two holding means can be reduced to the second distance by this variable spacer, and the two levers can be mounted on the positive control device. In this case the levers may be released from the variable spacer or else remain mounted on the variable spacer. When the automatic front unit is brought back from the securing position into the release position, the two levers should conversely be able to be released by the positive control device and it should be possible for the distance between the two holding means to be widened to the first distance by the variable spacer. If the two levers are not mounted on the variable spacer in the securing position, for this they should first be able to be mounted on the variable spacer. This alternative has the advantage that the distance between the two holding means is not changed by the positive control device, as a result of which the positive control device can be constructed more stably and can correspondingly withstand greater forces.

Advantageously, the positive control device comprises a control element on which the two levers are mounted, the control element being movable in such a way that, in the release position, the two levers have been moved apart and the holding means are at the first distance from each other and that, in the securing position, the two levers have been moved together and the holding means are at the second distance from each other. Irrespective of whether the two levers are in this case mounted directly on the control element or mounted indirectly on the control element by way of one, two or more than two further elements, this has the advantage that the holding means can be brought to the first distance from each other in the release position and to the second distance from each other in the securing position by a movement of the control element.

In a preferred variant of this, by contrast, the positive control device comprises a control element where, when there is a transfer into the securing position, the two levers are moved together by the control element and the holding means are at the second distance from each other. In this case there is the possibility that, when there is a transfer into the release position, the two levers can be moved in relation to each other by a further element of the front system in such a way that the two levers are moved apart and the holding means are at the first distance from each other. Irrespective of whether the two levers are in this case mounted directly on the control element or mounted indirectly on the control element by way of one, two or more than two further elements, this has the advantage that the transfer of the automatic front unit from the release position to the securing position can be achieved by the positive control device, while the transfer of the automatic front unit from the securing position into the release position takes place by an element that is independent of the positive control device.

If the positive control device comprises a control element and if the two levers are each mounted on the positive control device by a first slotted link and a first slider mounted therein, the two levers are advantageously each mounted on the control element by the first slotted link and the first slider mounted therein. This has the advantage that the positive control device can be constructed in a simple and correspondingly compact manner. As a variant of this, however, there are also preferred possibilities in which the two levers are not each mounted on the control element by the first slotted link and the first slider mounted therein.

In a preferred variant of this, instead of the control element, the positive control device comprises two elements, one of the two levers being mounted on a first element and the other of the two levers being mounted on a second element, and the first and second elements being movable in relation to each other in such a way that, in the release position, the two levers have been moved apart and the holding means are at the first distance from each other and that, in the securing position, the two levers have been moved together and the holding means are at the second distance from each other. This may be implemented, for example, by the two elements of the positive control device being connected to each other by a ram connection or by a screw connection. However, the two elements may, for example, also be connected to each other by a pivoting connection, the holding means being moved apart or moved together by a pivoting movement of the two elements.

In a preferred variant of this, however, there is also the possibility that, instead of the two elements, the positive control device comprises the aforementioned control element.

In a further preferred variant, in addition to the two elements, the positive control device comprises the control element as a third element, the first and second elements being able to be moved in relation to each other by the third element in such a way that, in the release position, the two levers have been moved apart and the holding means are at the first distance from each other and that, in the securing position, the two levers have been moved together and the holding means are at the second distance from each other. This has the advantage that the transfer of the automatic front unit from the release position to the securing position and back can be achieved by the positive control device.

In a further preferred variant, in addition to the two elements, the positive control device comprises the control element as a third element, the first and second elements being able to be moved in relation to each other by the third element in such a way that, when there is a transfer into the securing position, the two levers are moved together and the holding means are at the second distance from each other. In this case there is the possibility that, when there is a transfer into the release position, the first and second elements can be moved in relation to each other by a further element of the front system in such a way that the two levers are moved apart and the holding means are at the first distance from each other. This has the advantage that the transfer of the automatic front unit from the release position to the securing position can be achieved by the positive control device, while the transfer of the automatic front unit from the securing position into the release position takes place by an element that is independent of the positive control device.

As an alternative to this, however, there is also the possibility that the positive control device comprises a third element, which performs a different function than the control element, or that the positive control device does not comprise a third element.

If the positive control device comprises a control element without the two above-mentioned elements or else comprises a control element as a third element in addition to the two above-mentioned elements, and, when there is a deviation from a center of the positive control path, the positive control device can be pressed with a force toward the center of the positive control path by a pretensioned elastic element, the control element is preferably formed irrespective of the aforementioned, preferred variants in such a way that the driving-back force that drives the positive control device into the center of the positive control path can be transferred to the positive control device by way of this control element. This has the advantage that the control element performs a number of functions, and consequently the automatic front unit can be constructed from fewer elements, which makes a lighter type of construction possible.

As an alternative to this, however, there is also the possibility that if, when there is a deviation from a center of the positive control path, the positive control device can be pressed with a force toward the center of the positive control path by a pretensioned elastic element, the driving-back force that drives the positive control device into the center of the positive control path can be transferred to the positive control device in some other way.

If the positive control device comprises a control element without the two above-mentioned elements or else comprises a control element as a third element in addition to the two above-mentioned elements, in a preferred variant this control element is pivotably formed. This has the advantage that, when there is a movement of the positive control device away from the center of the positive control path, a pivoting movement of the control element can be caused, whereby a lateral safety release can be triggered by the control element when there is a certain pivoting angle of the control element. In order to make this possible, the control element of the positive control device may, for example, be mounted both pivotably on another element of the positive control device and pivotably on the rest of the automatic front unit. For this purpose, the two mountings may, for example, allow both a pivoting movement and a translational movement of the control element with respect to the other element of the positive control device or the rest of the automatic front unit. In order to make a lateral safety release possible, the control element may, moreover, be formed for example in such a way that, as from a certain angle in its pivoting movement, it moves or releases the first, the second or both the first and the second element in such a way that one or both levers is/are released, and consequently can be pivoted apart. If, by contrast, the positive control device only comprises the control element, but not the two above-mentioned elements, the control element may however also be formed in such a way that, as from a certain angle in its pivoting movement, it releases one or both levers, whereby the two levers can be moved apart when there is a lateral safety release.

As a preferred variant of this, however, there is also the possibility that the control element is not pivotably formed. In this case the control element may, for example, be rotatably formed or formed such that it can be moved along a linear path. In the latter case, this linear path may be formed in the longitudinal direction of the ski, in the transverse direction of the ski, at an angle to these two directions, or else in a curved manner.

However, as an alternative to these variants in which the positive control device comprises two or more elements, there is also the possibility that the positive control device only comprises the control element or else only comprises a differently formed element.

If the positive control device comprises at least three elements, i.e. a control element as a third element in addition to the two above-mentioned elements, the first element and the second element of the positive control device are preferably each mounted on the third element of the positive control device by a second slotted link and a second slider. Correspondingly, the first and second elements can be moved in relation to each other, by the third element being moved in relation to the first or second element. This has the advantage that an actuation of the positive control device is made possible in a simple and low-cost way. In this case there is the possibility that the second slotted links enclose and guide the respective second slider on both sides. However, there is also the possibility that the second slotted links do not enclose and guide the respective second slider on both sides but only guide it on one side or only guide it on both sides over one region and otherwise guide it on one side. Guide it on one side means here that, for example, the respective second slider is only in contact with the corresponding second slotted link on one side. In this case the second slotted links may be, for example, a surface on which the respective second slider is supported and along which the respective second slider is movable. In this case the second sliders may, for example, be pressed against the respective second slotted link by means of an elastic element. Correspondingly, irrespective of whether the second slotted links enclose the second sliders on both sides or only on one side, the phrasing that a second slider is guided in the corresponding second slotted link is used here. Irrespective of the actual shape and form of the second slotted links, the second sliders may be formed in a wide variety of ways. For example, they may be formed cylindrically. However, they may, for example, also be formed cylindrically and each have a roller enclosing them, by which their mounting in the corresponding second slotted link is improved. Furthermore, however, there is also the possibility that the two second sliders are formed for example as blocks. Moreover, there is the possibility that the two second sliders comprise differently shaped regions. For example, they may each have a cylindrical region and each have one or more further regions. It is possible in this case, for example, that, depending on the region of the second slotted link, the cylindrical region or a different region of the respective second slider interacts with the second slotted link.

As a variant of this, however, there is also the possibility that the first element of the positive control device comprises for example a toothed rack, which is guided in the second element, and that the third element of the positive control device is a pinion, by means of which the first and second elements of the positive control device are movable in relation to each other. However, it goes without saying that other variants, in which the positive control device comprises at least three elements, are also possible.

In the presence of the second slotted link, the control element or third element of the positive control device is preferably movable along the longitudinal axis of the ski, the first and second elements of the positive control device being moved together by the second slotted links when there is a movement of the third element of the positive control device in a first direction, and the first and second elements of the positive control device being moved apart by the second slotted links when there is a movement of the third element of the positive control device in a second direction. In this case the first and second directions may be the forward and rearward directions, when seen in the longitudinal direction of the ski, or vice versa. Both have the advantage that, for the transfer of the automatic front unit from the release position into the securing position and back, the third element of the positive control device is moved in a direction which is independent of the pivoting movement of the two levers oriented in the transverse direction of the ski or of the possible movement, if any, of the positive control device in the transverse direction of the ski. Correspondingly, it can be prevented by the second slotted links that a force acting on one lever or both levers in the transverse direction of the ski can bring about a change in the relative positions of the first and second elements of the positive control device. As a result, a simple and dependable control of the distance between the two holding elements is made possible in the release position and in the securing position.

As a variant of this, the control element or third element of the positive control device may also be formed such that it is not movable along the longitudinal axis of the ski but rotatable about an axis of rotation. In the presence of the second slotted link, for this purpose the first and second elements of the positive control device may, for example, be moved together by the second slotted links when there is a rotation of the third element of the positive control device in a first direction, and the first and second elements of the positive control device may be moved apart by the second slotted links when there is a rotation of the third element of the positive control device in a second direction. For this purpose, the second slotted links may be arranged spirally around the axis of rotation in the third element of the positive control device or else in the first or second element of the positive control device.

If the third element of the positive control device is formed such that it is rotatable about the axis of rotation, a mounting of the first and second elements on the third element may also not be formed by way of the second slotted links. For example, the first element and the second element of the positive control device may also each be mounted on the third element of the positive control device by a revolute joint, the first and second elements of the positive control device being moved together when there is a rotation of the third element of the positive control device in a first direction of rotation and the first and second elements of the positive control device being moved apart when there is a movement of the third element of the positive control device in a second direction of rotation.

If, in the securing position, the positive control device is movable along the positive control path, it thus preferably comprises a carriage, which is formed such that it is movable along the positive control path. In this case there is the possibility that the positive control device comprises such a carriage in addition to the already mentioned control element or the already mentioned two elements. However, there is also the possibility that the positive control device comprises such a carriage which at the same time performs the function of the already mentioned first, second or third element or control element, and consequently at the same time corresponds to the correspondingly first, second or third element or control element. In this case there is also the possibility that more than one of the first, second and third elements or the control element is formed as a carriage. Furthermore, however, there is also the possibility that the positive control device comprises such a carriage and none of the above-mentioned elements. In this case there is in turn the possibility that the positive control device consists only of such a carriage or else also comprises still further elements.

If the positive control device comprises such a carriage, the further elements of the positive control device, if they are present in the first place, are preferably mounted on the carriage. In this case the further elements may, for example, be movable together with the carriage in the transverse direction of the ski. However, there is also the possibility that one or more of the further elements is mounted both on the carriage and on the rest of the automatic front unit. If, for example, the positive control device comprises a pivotable element, this pivotable element may be mounted both on the carriage and on the rest of the automatic front unit and be pivotable when there is a movement of the carriage in the transverse direction of the ski. In this sense, as already mentioned, the control element may, for example, be formed as a pivotable element and correspondingly be mounted both on the carriage and on the rest of the automatic front unit and be pivotable when there is a movement of the carriage in the transverse direction of the ski.

As an alternative to this, there is also the possibility that the positive control device does not comprise such a carriage.

If the positive control device comprises such a carriage, the two pivots are advantageously mounted on the carriage. In this case the levers may be additionally mounted on a further element of the positive control device. However, there is also the possibility that the two levers are additionally mounted not on a further element of the positive control device but otherwise on the automatic front unit. Both have the advantage that the two levers can be moved together with the carriage in the securing position.

As an alternative to this, however, there is also the possibility that the pivots are not mounted on the carriage but on another element of the positive control device or of the automatic front unit.

Advantageously, the automatic front unit has a blocking position, in which the two holding means are at a third distance from each other, which is equal to or less than the second distance and in which the two levers have been blocked in their movement. This has the advantage that the automatic front unit can be blocked when a ski boot is secured in the automatic front unit, whereby it can be prevented that the ski boot can be freed unintentionally from the automatic front unit. If a ski-touring binding system is in a state in which the automatic front unit is in the climbing position, unintentional loss of the ski can consequently be prevented by the blocking position. This could otherwise occur, for example on account of a lateral impact on the ski when setting down the ski in the course of carrying out a kick turn on a steep slope.

As a preferred variant of this, however, there is also the possibility that the automatic front unit has instead of a blocking position a damping position, in which the two holding means are at a third distance from each other, which is equal to or less than the second distance and in which the two levers can be moved within the dynamic region with a greater resistance than in the securing position. This has the advantage that, although the automatic front unit can make a lateral safety release possible when a ski boot is secured in the automatic front unit, at the same time the movement of the holding means together with the ski boot held in the automatic front unit along the dynamic path can be damped and correspondingly reduced. If, therefore, a ski-touring binding system is in a state in which the automatic front unit is in the climbing position, a movement of a ski boot held in the automatic front unit in the transverse direction of the ski in relation to the ski can be damped and correspondingly reduced by the damping position. This has the advantage that the surefootedness is increased for a skier when climbing, while at the same time the safety is retained for the skier, by the possibility of a lateral safety release being ensured.

As an alternative to this, however, there is also the possibility of dispensing with both the blocking position and the damping position. This may be advantageous if, for example, the automatic front unit is being used by an experienced skier who wishes and/or requires a lateral safety release only in the event of great lateral force effects. In this case, the ski boot can also be sufficiently secured by the automatic front unit in the securing position, whereby no blocking or damping position is required. Correspondingly, by dispensing with the blocking position and the damping position, in this case the automatic front unit can be structurally formed in a simpler and correspondingly lighter manner.

If the automatic front unit has a blocking position, the positive control device is preferably blockable in the blocking position. This means that the positive control device can be blocked in its movement if it is movable in the securing position. If, by contrast, the positive control device is arranged fixed on the ski in the securing position, this means that the mountings of the two levers on the positive control device can be blocked in the blocking position. Correspondingly, the blocking of the positive control device has the advantage that a movement of the two levers can be prevented by the blocking of a single element. Correspondingly, the automatic front unit can be of a simpler construction and be produced at lower cost.

For the blocking of the positive control device there is, for example, the possibility that the positive control device can be blocked by a blocking element. Thus, for example, one or more blocking elements may be mounted on the positive control device and be able to be pushed or pivoted into corresponding openings in the automatic front unit for the blocking. However, there is also the possibility that one or more blocking elements are mounted on the automatic front unit and can be pushed or pivoted into corresponding openings in the positive control device for the blocking of the positive control device.

As a variant of this, however, there is also the possibility that one or both levers are blockable in the blocking position. In this case, the positive control device may also at the same time be blockable.

Advantageously, the automatic front unit comprises a control lever, which can be brought into a release position and into a securing position, the automatic front unit being able to be brought into the release position by positioning the control lever in the release position and able to be brought into the securing position by positioning the control lever in the securing position. In this case the control lever may be both a pivotable lever and a displaceable lever. Both have the advantage that the automatic front unit can be brought from the release position into the securing position and back in a controlled manner in a simple way.

As a variant of this, however, there is also the possibility that the automatic front unit comprises two control levers, the automatic front unit being able to be brought from the release position into the securing position by a first of these two control levers and able to be brought from the securing position into the release position by a second of these two control levers.

As a further variant, there is the possibility that the automatic front unit comprises a control lever, by which it can only be brought from the securing position into the release position. In this case, the automatic front unit may, for example, comprise a tread spur, by which it can be brought from the release position into the securing position, it being possible for this tread spur to be actuated by a ski boot when the ski boot is correctly positioned in relation to the holding means for stepping into the automatic front unit. This has the advantage that it is made easier for the skier to step into the automatic front unit. In order to have this advantage also in the case of both of the two above-mentioned variants, this tread spur may also be provided in addition to the one control lever or both control levers that make it possible for the automatic front unit to be transferred from the securing position into the release position and back.

If the automatic front unit comprises at least one control lever and has a blocking position, the control lever can preferably be brought into a blocking position, it being possible for the automatic front unit to be brought into the blocking position by positioning the control lever in the blocking position. If, by contrast, the automatic front unit comprises at least one control lever and has a damping position, the control lever can preferably be brought into a damping position, it being possible for the automatic front unit to be brought into the damping position by positioning the control lever in the damping position. Both have the advantage that it is easy to operate the automatic front unit.

As a variant of this, however, there is also the possibility that the automatic front unit comprises for example a separate control lever, by which the automatic front unit can be brought into the blocking position or damping position, or else that the automatic front unit does not comprise a control lever by which the automatic front unit can be brought into the blocking position or damping position.

If the automatic front unit comprises at least one control lever and has a blocking position, the control lever preferably comprises at least one blocking element by which the positive control device can be blocked in the blocking position, by the control lever being positioned in the blocking position. If the positive control device is movable in the securing position, this may take place, for example, by the blocking element or blocking elements each engaging in a recess in the positive control device when the control lever has been brought into the blocking position. However, there is also the possibility that the control lever has two or more blocking elements, which reach laterally around a region of the positive control device or the entire positive control device and thereby hinder the positive control device in its movement. If, however, the positive control device is not movable in the securing position, the control lever may, for example, comprise two or more blocking elements which, when the control lever is in the blocking position, engage in the mountings of the two levers on the positive control device and thereby block the positive control device and the movement of the levers.

If, by contrast, the automatic front unit comprises at least one control lever and has a damping position, the control lever preferably comprises at least one damping element by which a movement resistance can be imparted to a movement of the two levers in the damping position, by the control lever being positioned in the damping position. If the positive control device is movable in the securing position, this may take place, for example, by the damping element or elements interacting with the positive control device and thereby increasing the resistance to a movement of the positive control device. In a variant of this, or if the positive control device is not movable in the securing position, the control lever may, for example, also comprise one or more damping elements, which interact with the levers or the pivots and thus increase the movement resistance of the two levers.

If the positive control device is movable along the positive control path and comprises a carriage which is movable along the positive control path, and the automatic front unit comprises at least one control lever with at least one damping element and has a damping position, in a preferred variant the imparting of a movement resistance to a movement of the two levers takes place by the damping element interacting with the carriage. If, however, the positive control device comprises a control element, as a preferred variant a movement resistance may also be imparted to a movement of the two levers by the damping element interacting with the control element. As an alternative to these two variants, however, the increasing of the resistance to a movement of the two levers may also take place in some other way.

If, by contrast, the positive control device is movable along the positive control path and comprises a carriage which is movable along the positive control path, and the automatic front unit comprises at least one control lever with at least one blocking element and has a blocking position, in a preferred variant the blocking of the positive control device takes place by the blocking element engaging in a recess in the carriage. As an alternative to this, however, the blocking of the positive control device may also take place in some other way.

As a variant of the blocking by means of at least one blocking element of the control lever, the positive control device may, for example, also be blockable not only by at least one blocking element of the control lever but also additionally in some other way, or else be blockable in some other way instead of by at least one blocking element of the control lever. If the positive control device comprises a control element, it may, for example, be blockable by blocking the control element. For this purpose, the control element of the positive control device may, for example, be movable in the longitudinal direction of the ski into a lateral guide, although it is also possible for the control element to be formed in such a way that it cannot be moved entirely into the lateral guide, in order sufficiently to hinder and correspondingly block a movement in a direction other than along the longitudinal direction of the ski. In order to overcome the blocking, the control element of the positive control device may be formed such that it can be moved in the longitudinal direction of the ski out of the lateral guide, whereby it can be released for a movement in a direction other than along the longitudinal direction of the ski. The lateral guide that is used in this example for the blocking does not have to be a guide that reaches laterally around the control element entirely. It may also be a rail-like guide, onto which the control element can be pushed. The movement of the control element that is blocked by the lateral guide should be the movement that can be carried out by the positive control device in the securing position. It may consequently be both a linear movement in the transverse direction of the ski and a rotating or pivoting movement.

If the automatic front unit comprises a control lever, in this variant the control element may, for example, be able to be moved in the longitudinal direction of the ski by the control lever for the actuation of the blocking of the control element. This can be achieved, for example, by the automatic front unit comprising a guiding element in which the control element of the positive control device is mounted. In this case, the control element together with the guiding element may be pressed against the control lever by a ram that is pretensioned by an elastic element, and thereby be displaceable in the longitudinal direction of the ski in a way corresponding to the positioning of the control lever. This has the advantage that, for example, the positive control device may at the same time also be formed such that, when there is a deviation from a center of the positive control path, it can be pressed by the elastic element toward the center of the positive control path. Furthermore, this has the advantage that, although the guiding element is pressed against the control lever, it does not necessarily have to follow the control lever. This has the advantage over a direct mounting of the guiding element on the control lever that, for example, the control lever can be brought from the blocking position into the securing position, whereby the guiding element is moved against the pretensioned ram. If, however, the control lever is brought from the securing position into the blocking position, the control lever can also be brought into the blocking position without movement of the guiding element. If, for example, the guiding element is hindered from being displaced by the pretensioned ram by an obstacle, the guiding element can also only be moved by the pretensioned ram when the obstacle has been removed. There is thus the possibility that the control element of the positive control device is only pushed into the lateral guide for the blocking when the positive control device is positioned correctly in relation to the lateral guide. In a variant of this example, it may also be possible, however, for the control lever to be brought from the securing position into the blocking position, whereby the guiding element is moved against the pretensioned ram. If, however, in this variant the control lever is brought from the blocking position into the securing position, the control lever can also be brought into the securing position without movement of the guiding element. Depending on the type of construction of the automatic front unit, this may be advantageous. As a further variant, the control lever may also be mounted directly on the guiding element, or else the automatic front unit may not comprise a guiding element at all. In this latter case, the positive control device may, for example, be pressed against the control lever by the pretensioned ram and/or the positive control device may also be mounted directly on the control lever.

Apart from these variants, there is also the possibility that not only the control element of the positive control device but another element of the positive control device or the entire positive control device can be moved in the longitudinal direction of the ski into and out of the lateral guide in the way described for the control element. It goes without saying that this is a variant that is also possible when the positive control device comprises more or less than three elements.

The holding means are preferably spikes, which are arranged on the respective lever in such a way that, starting from the respective lever, they point with their free end toward the center of the ski. This has the advantage that the ski boot that can be held in the automatic front unit in the toe region can be mounted pivotably in the automatic front unit in a simple way, pivotably about an axis aligned horizontally in the transverse direction of the ski, if the ski boot has two lateral recesses in its toe region.

In a first preferred variant of this, the spikes have pointed free ends. This has the advantage that the ski boot that should be held in the automatic front unit can be pivotably mounted in the automatic front unit precisely about the axis aligned horizontally in the transverse direction of the ski.

In a second preferred variant of this, the spikes have rounded free ends. This has the advantage that the ski boot can easily come out from the automatic front unit when there is a lateral safety release.

In a third preferred variant, toward their free ends the spikes have pointed regions, the free ends of the spikes being rounded. This has the advantage that, by suitably choosing the size of the pointed regions and the size of the rounded ends of the spikes, an optimization can be achieved between precisely pivotable mounting of the ski boot about the axis aligned horizontally in the transverse direction of the ski and good releasability of the ski boot from the automatic front unit when there is a lateral safety release.

As an alternative to this, however, there is also the possibility that the holding means are differently formed.

Advantageously, the automatic front unit comprises a housing that can be fastened to a ski and a holding-down element that can be fastened to the ski. In this case the housing can preferably be fastened on a ski in its front region, while in its rear region it is mounted movably in the longitudinal direction of the ski by the holding-down element, it being possible for the housing to be held on the ski in its rear region by the holding-down element that is fastened to the ski. In a preferred variant of this, the housing can be fastened on a ski in its rear region, while in its front region it is mounted movably in the longitudinal direction of the ski by the holding-down element, it being possible for the housing to be held on the ski in its front region by the holding-down element that is fastened to the ski. Both have the effect that, in the mounted state, when the automatic front unit is fastened on a ski, the housing is fastened to the ski in its front or rear region, while the rear or front region of the housing is held in the longitudinal guide of the holding-down element that is fastened to the ski and can move in relation to the holding-down element in the longitudinal direction of the ski. This makes it possible that the ski can flex during skiing, the automatic front unit adapting itself to the flexing of the ski, by the housing being moved with respect to the holding-down element in the longitudinal direction of the ski. This has the advantage that the automatic front unit does not lead to any stiffening of the ski, whereby the skier's skiing comfort is optimized. It should be noted in this respect that this advantage can also be achieved in the case of any other desired automatic front unit or any desired automatic heel unit of a ski-touring binding of the second type mentioned at the beginning if the supporting structure, such as here the housing, is fastened at one end to the ski, while the other end of the supporting structure is held in the longitudinal guide of the holding-down element that is fastened to the ski and can move in relation to the holding-down element in the longitudinal direction of the ski.

In a further preferred variant of this, however, the automatic front unit may also be able to be fastened to a ski in some other way. For example, the automatic front unit may comprise a housing which can be fixedly fastened to the ski, the automatic front unit comprising a separate holding-down element. This has the advantage, for example, that the automatic front unit can be produced in a simple and therefore low-cost manner.

Further advantageous embodiments and combinations of features of the invention emerge from the following detailed description and the patent claims in their entirety.

BRIEF DESCRIPTION OF THE DRAWINGS

In the drawings that are used to explain the exemplary embodiment.

In principle, the same parts are provided with the same designations in the figures.

WAYS OF IMPLEMENTING THE INVENTION

Figure 1A:
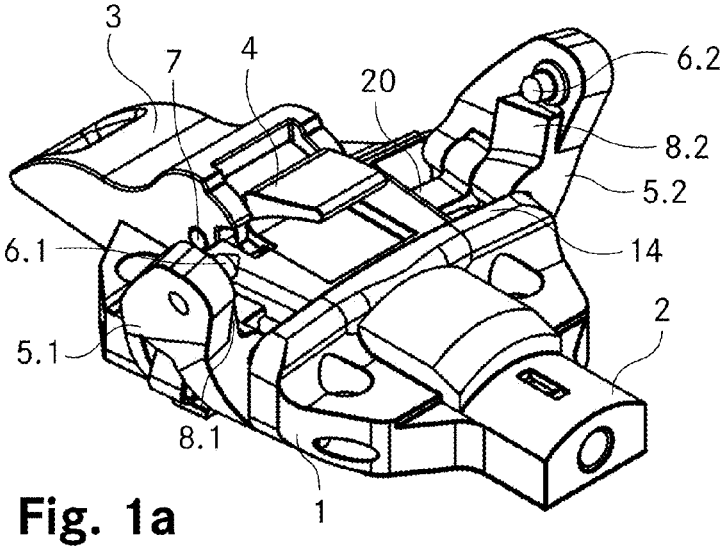
FIGS. 1*a, b, c* show an oblique view of an automatic front unit according to the invention in the release position, in the securing position and in the blocking position.
Figure 1B:
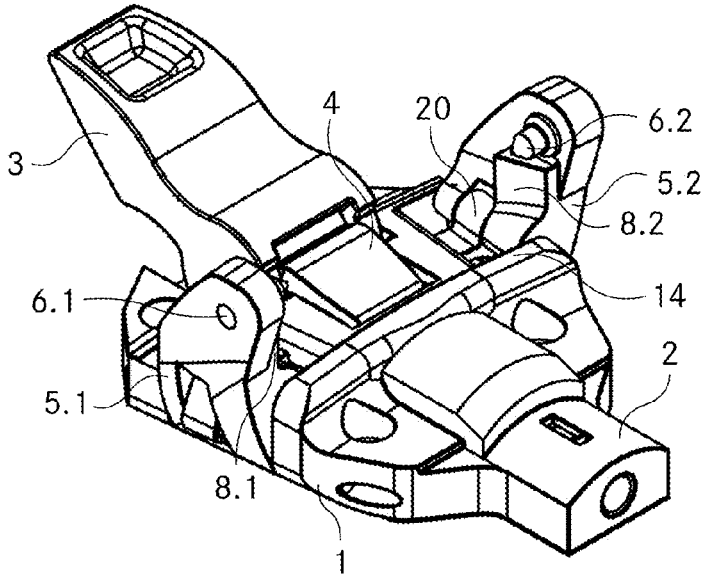
Figure 1C:
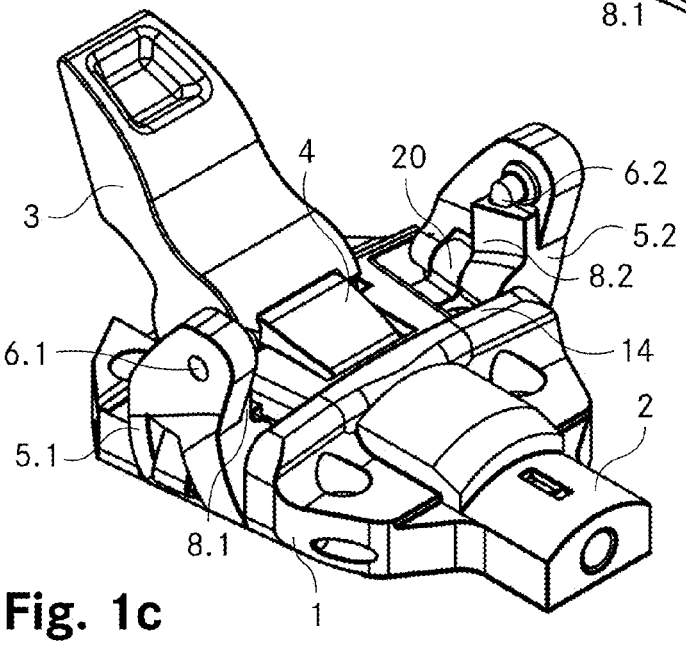

FIGS. 1*a*, 1*b* and 1*c* each show an oblique view of an automatic front unit 1 according to the invention. In FIG. 1*a*, the automatic front unit 1 is represented in a release position, in FIG. 1*b* it is represented in a securing position and in FIG. 1*c* it is represented in a blocking position. In all three FIGS. 1*a*, 1*b* and 1*c*, the automatic front unit 1 is aligned from obliquely bottom right to obliquely top left. When the automatic front unit 1 is mounted on a ski (not shown), in these figures bottom right thus corresponds to the rear of the ski, while top left corresponds to the front of the ski. Therefore, in these figures the longitudinal direction of the ski runs along an axis from bottom right to top left. Furthermore, in FIGS. 1*a*, 1*b* and 1*c*, top and bottom also correspond to top and bottom of the automatic front unit 1.

The automatic front unit 1 comprises a housing 2, a control lever 3 and a tread spur 4 of plastic. Furthermore, the automatic front unit 1 comprises two pivoting levers 5.1, 5.2 of aluminum each with a holding spur 6.1, 6.2 of steel. The two pivoting levers 5.1, 5.2 are arranged laterally, lying opposite each other in the transverse direction of the ski. They are each mounted pivotably about a pivot 9.1, 9.2 (see FIG. 3). These two pivots 9.1, 9.2 are each arranged in a lower region of the automatic front unit 1 and, lying in a plane parallel to the ski, are aligned such that they converge rearwardly at an angle of 6 degrees to the longitudinal direction of the ski (see FIG. 10). Consequently, the two pivoting levers 5.1, 5.2 are substantially pivotable in the transverse direction of the ski. In a region above the pivots, the two pivoting levers 5.1, 5.2 are mounted on a positive control device 20. Furthermore, the two pivoting levers 5.1, 5.2 each have above this mounting a control jaw 8.1, 8.2, on a side facing the center of the ski. Arranged above the control jaws 8.1, 8.2, in an upper region of upwardly pointing free ends of the pivoting levers 5.1, 5.2, are the two holding spurs 6.1, 6.2, facing the center of the ski. This allows a ski boot to be held between the two pivoting levers 5.1, 5.2 by the holding spurs 6.1, 6.2. For this purpose, the ski boot to be mounted should have in a toe region laterally attached bearing bushes, in which the holding spurs 6.1, 6.2 can engage (see FIG. 2).

In front of the two pivoting levers 5.1, 5.2, in a center of the ski, the tread spur 4 is mounted pivotably about a transverse axle 7 aligned horizontally in the transverse direction of the ski. A free end of the tread spur 4 reaches above the positive control device 20 rearwardly between the two pivoting levers 5.1, 5.2. In the release position (FIG. 1*a*), the tread spur 4 has been pivoted up slightly such that its free end is arranged above the housing 2. By contrast, in the securing position (FIG. 1*b*) and in the blocking position (1*c*), its free end has been swung down and lies on the housing 2.

Alongside the tread spur 4, the control lever 3 is also mounted pivotably about the transverse axle 7. A free end of the control lever 3, which serves for the actuation thereof, points forward. In the release position (FIG. 1*a*), it points substantially horizontally forward. The control lever 3 is in a release position. By contrast, in the securing position (FIG. 1*b*), the free end of the control lever 3 points obliquely upward in the forward direction, which corresponds to a securing position of the control lever 3. In the blocking position (FIG. 1*c*), the free end of the control lever 3 points steeply upward in the forward direction. The control lever 3 is in a blocking position. Consequently, the automatic front unit 1 can be brought from the release position into the securing position by the control lever 3 being pulled up from the release position into the securing position. Starting from the securing position, the automatic front unit 1 can also be transferred into the blocking position, by the control lever 3 being pulled up further from the securing position into the blocking position. In order to bring the automatic front unit 1 back into the securing position or the release position, the control lever 3 can accordingly be pressed in the downward direction.

In the release position, the two pivoting levers 5.1, 5.2 have been pivoted slightly apart and the two holding spurs 6.1, 6.2 are at a first distance from each other (FIG. 1*a*). This first distance is sufficiently great for a toe region of an upright ski boot to be moved through between the two holding spurs 6.1, 6.2. By contrast, in the securing position, the two pivoting levers 5.1, 5.2 have been pivoted slightly apart (FIG. 1*b*). Correspondingly, here the holding spurs 6.1, 6.2 are at a second distance from each other, which is less than the first distance. The second distance is dimensioned in such a way that the two holding spurs 6.1, 6.2 can engage at the same time from opposite sides in laterally attached bearing bushes in the toe region of a ski boot and thereby mount the ski boot. In the blocking position (FIG. 1*c*), the two pivoting levers 5.1, 5.2 have likewise been pivoted slightly together. Here, the two holding spurs 6.1, 6.2 are at a third distance from each other, which is equal to or less than the second distance. Correspondingly, in the blocking position too, a ski boot can be mounted by lateral engagement of the two holding spurs 6.1, 6.2.

In order to achieve a transfer of the automatic front unit 1 from the release position into the securing position, in which a ski boot is mounted in the automatic front unit 1, the ski boot can be positioned in upright alignment, parallel to the ski, with its toe region between the two pivoting levers 5.1, 5.2 and moved gently downward. The tread spur 4 is thereby pressed in the downward direction by a sole of the ski boot, whereby the automatic front unit 1 is transferred into the securing position. If the ski boot is positioned correctly, the two holding spurs 6.1, 6.2 thereby engage in lateral bearing bushes of the ski boot, by the two pivoting levers 5.1, 5.2 being moved together. At the same time, the pressing down of the tread spur 4 also causes the control lever 3 to be pivoted up into the securing position. During this transfer of the automatic front unit 1 from the release position into the securing position, the control lever 3 may also at the same time be lifted up manually from the release position into the securing position.

Behind the two pivoting levers 5.1, 5.2, the housing 2 has a guiding bar 14, which runs in the transverse direction of the ski from a first side to a second side of the housing 2. This guiding bar 14 is slightly elevated with respect to the rest of the housing 2 and serves the purpose of hindering a ski boot from being set down entirely on the housing 2. In the case of a lateral safety release, it also serves for assisting a movement of the ski boot in the lateral direction and preventing the possibility of a sole of the ski boot getting caught on the rest of the housing 2. In order to optimize this function, the guiding bar 14 may have in its upper region a sliding element, on which the sole of the ski boot can slide. Such a sliding element may, for example, be produced from Teflon.

Figure 2:
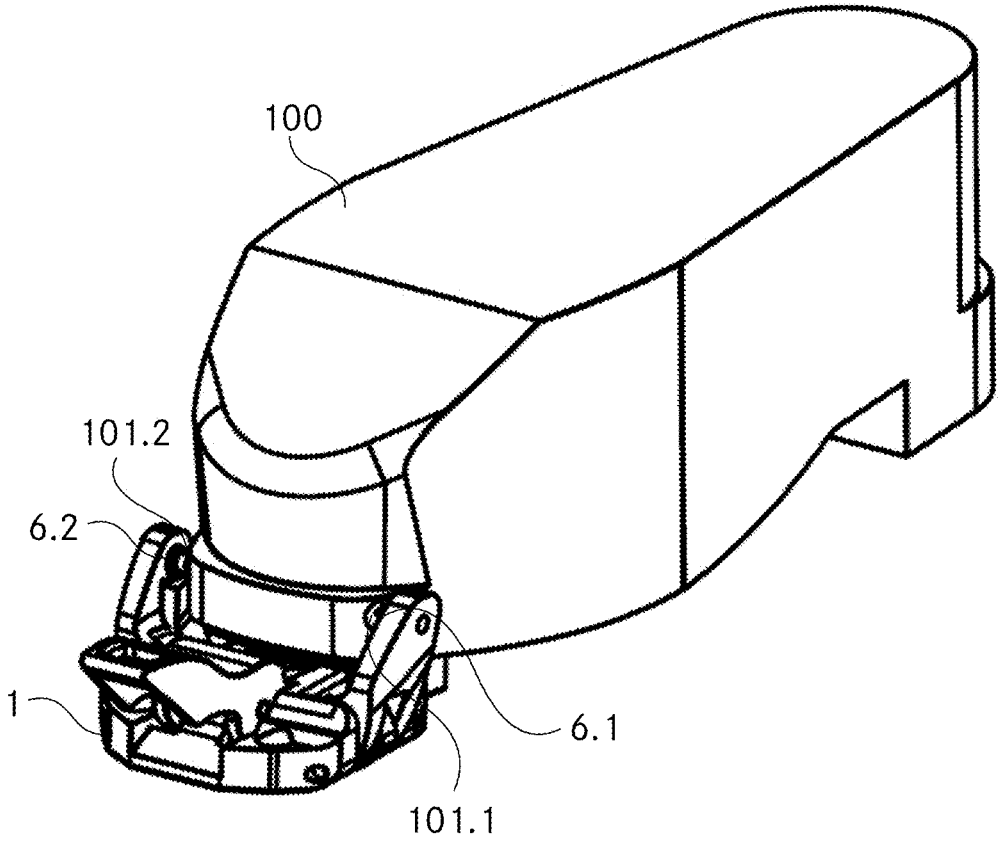
FIG. 2 shows a schematic oblique view of the automatic front unit in the securing position, with a ski boot mounted in the automatic front unit.

FIG. 2 shows a schematic oblique view of the automatic front unit 1 in the securing position, with a ski boot 100 mounted in the automatic front unit 1. The ski boot 100 has in its toe region two bearing bushes 101.1, 101.2, in which the two holding spurs 6.1, 6.2 engage. As a result, the ski boot 100 is mounted on the automatic front unit 1 pivotably about a horizontal axis aligned in the transverse direction of the ski.

Figure 3:
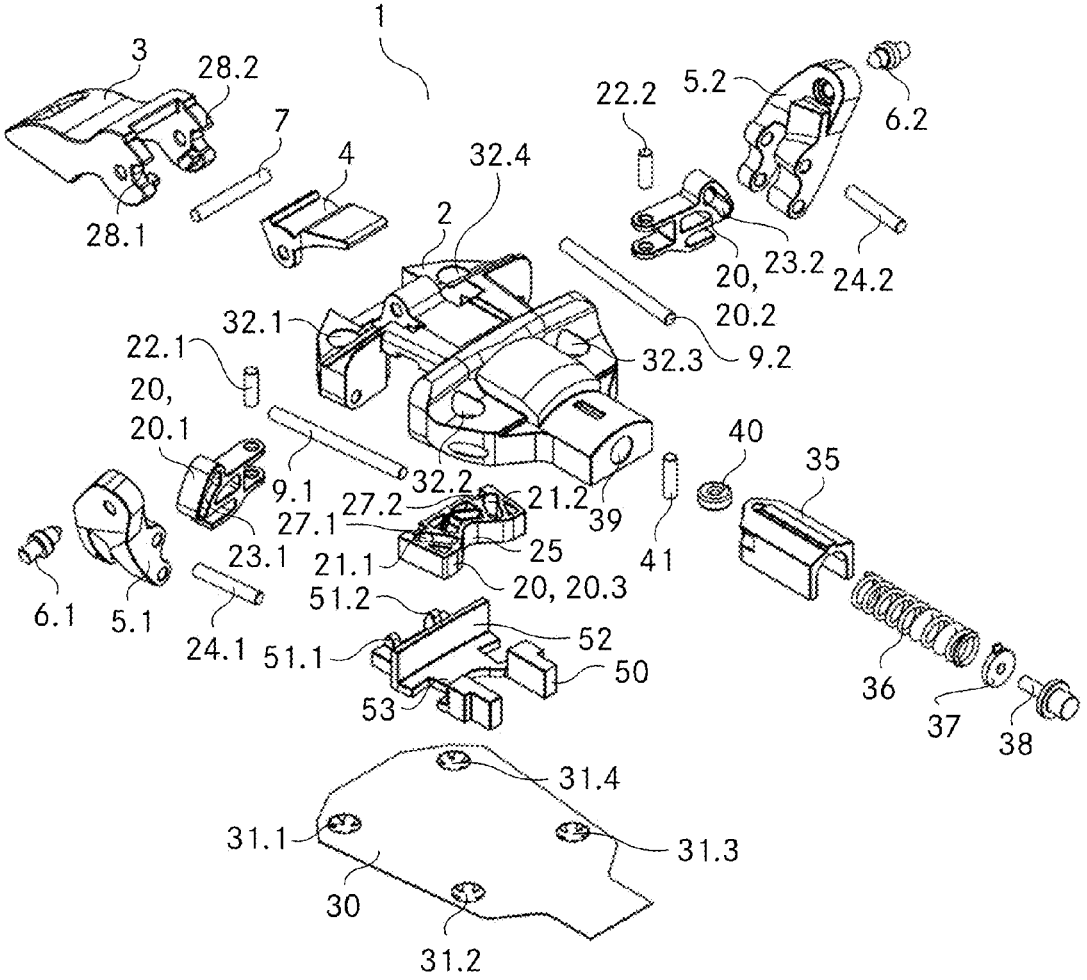
FIG. 3 shows an exploded drawing of the automatic front unit, FIGS. 4*a, b, c* show three different views of the automatic front unit in the release position, FIGS. 5*a, b, c* show three different views of the automatic front unit in the securing position, FIGS. 6*a, b, c, d* show three different views of the automatic front unit in the blocking position, FIGS. 7*a, b, c* show cross sections through the automatic front unit, extending through a positive control device, in each case together with a schematically represented section through a lower region of a ski boot to illustrate a lateral safety release of the automatic front unit, FIGS. 8*a, b, c* show views of the automatic front unit from below to illustrate a lateral safety release of the automatic front unit, while a baseplate and a guiding element have in each case been left out.

FIG. 3 shows an exploded drawing of the automatic front unit 1. The perspective of the representation is the same as in FIGS. 1*a*, 1*b* and 1*c*. However, further components of the automatic front unit 1, which in FIGS. 1*a*, 1*b* and 1*c* as well as FIG. 2 are concealed by the housing 2, can be seen in the exploded drawing. Thus, in FIG. 3 it can be seen that the automatic front unit 1 has a flat baseplate 30, produced from metal, which closes off in the downward direction the housing 2 that is otherwise open in the downward direction. The baseplate 30 has in a substantially square arrangement four vertically aligned openings 31.1, 31.2, 31.3, 31.4. When the automatic front unit 1 has been assembled, these openings 31.1, 31.2, 31.3, 31.4 coincide with four vertically aligned openings 32.1, 32.2, 32.3, 32.4 in the housing 2. In the housing 2, one of these openings 32.1, 32.2, 32.3, 32.4 is respectively arranged in front of and behind the pivoting levers 5.1, 5.2. They serve the purpose of fastening the automatic front unit 1 on a ski by means of screws.

A number of elements are arranged in an interior space of the automatic front unit 1 that is enclosed by the housing 2 and the baseplate 30. Thus, a ram 35 produced from plastic is arranged in a rear region of the housing 2, in the center of the ski. This ram 35 is aligned in the longitudinal direction of the ski. In an upper region, it has a guide, which is aligned in its longitudinal direction and can engage in a corresponding counterpart in the housing 2. As a result, the ram 35 is guided in the longitudinal direction of the ski. In its rear region, the ram 35 has an opening, in which a spiral spring 36 aligned in the longitudinal direction of the ski is inserted. This spiral spring 36 butts with its rear end against a locking nut 37, which is screwed with a thread onto an adjusting screw 38 aligned in the longitudinal direction of the ski. In the mounted state of the automatic front unit 1, a head of the adjusting screw 38 is mounted in an opening 39 in a rearwardly aligned side wall of the housing 2. In this case, the adjusting screw 38 can be turned from the outside through the opening 39.

In front of the ram 35, a guiding element 50 produced from plastic is mounted in the housing 2. This guiding element 50 has in a rear region, on each of both sides, a rearwardly pointing arm. In the mounted state of the automatic front unit 1, the ram 35 is reached around from the front on both sides by these arms. Furthermore, in a front region, the guiding element 50 has on each of both sides a forwardly pointing, short arm. In a front region, these two arms each comprise an upwardly pointing nub 51.1, 51.2. In the rearward direction, these two arms are delimited from a central region 53 of the guiding element 50 by a plate that is aligned vertically and in the transverse direction of the ski and forms a front stop 52. This central region 53 is in the form of a plate and is aligned horizontally. In the rearward direction, it is delimited by the two rearwardly pointing arms, which reach upward to above a plane of the central region 53 and thereby form a rear stop. On the central region 53, the positive control device 20 is mounted movably in the transverse direction of the ski. In this case, it is guided between the front stop 52 and the rear stop, and is correspondingly hindered from a movement in relation to the guiding element 50 in the longitudinal direction of the ski.

As can be seen here in the exploded drawing, the positive control device 20 comprises two side levers 20.1, 20.2 and a control plate 20.3. As described above, the latter is mounted movably in the transverse direction of the ski in the guiding element 50. On both sides of the control plate 20.3, one of the two side levers 20.1, 20.2 is respectively arranged such that it is aligned in the transverse direction of the ski. The mounting of the two side levers 20.1, 20.2 on the control plate 20.3 in each case consists of a second slotted link 21.1, 21.2 in the control plate 20.3, with a second slider 22.1, 22.2 mounted therein, which is attached to the corresponding side levers 20.1, 20.2. In this case, the second slotted links 21.1, 21.2 are aligned in such a way that they allow a relative movement of the control plate 20.3 in relation to the side levers 20.1, 20.2 in the longitudinal direction of the ski, whereby the two side levers 20.1, 20.2 are drawn together or pushed apart. The two pivoting levers 5.1, 5.2 are mounted on outer ends of the side levers 20.1, 20.2. For this purpose, the side levers 20.1, 20.2 each comprise a first slotted link 23.1, 23.2, in each of which there is mounted a first slider 24.1, 24.2, which is arranged on the corresponding pivoting lever 5.1, 5.2. In this case, the first sliders 24.1, 24.2 are arranged on the respective pivoting lever 5.1, 5.2 above the pivots 9.1, 9.2, about which the pivoting levers 5.1, 5.2 are pivotably mounted on the housing 2. Alongside the second slotted links 21.1, 21.2, the control plate 20.3 has two notches 27.1, 27.2, which are arranged next to each other on a forwardly aligned side of the control plate 20.3. Two catches 28.1, 28.2 that are attached to the control lever 3 can engage in these two notches 27.1, 27.2. This allows the control plate 20.3 to be hindered from a movement in the transverse direction of the ski in the blocking position.

Figure 11A:
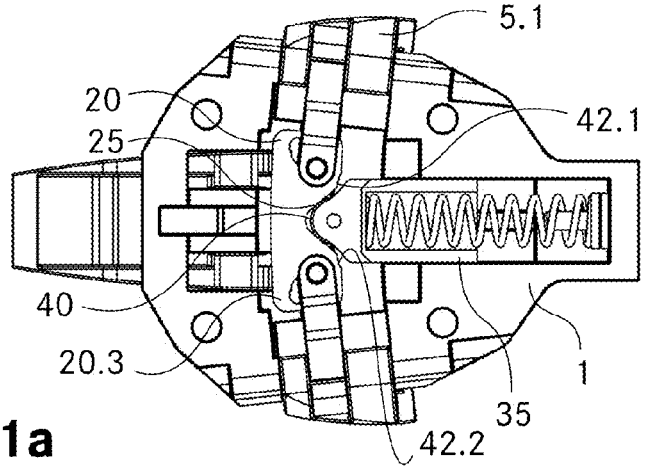
Figure 11B:
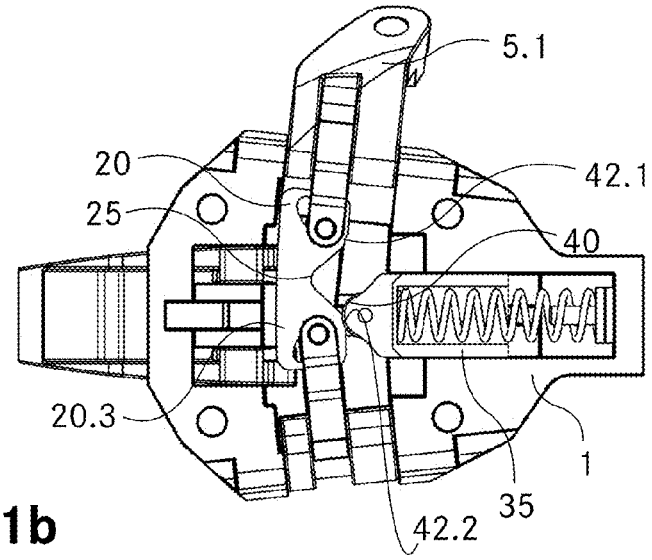

In the mounted state of the automatic front unit 1, the spiral spring 36 is pretensioned between the ram 35 and the locking nut 37. In the rearward direction, it is supported on an inner side of the housing 2 by way of the locking nut 37 and the adjusting screw 38. By turning the adjusting screw 38, whereby the locking nut 37 is moved in the forward or rearward direction, the pretensioning of the spiral spring 36 can thereby be set. The spiral spring 36 correspondingly exerts a force that can be set to press the ram 35 in the forward direction, where the ram 35 is supported against the control plate 20.3. For this purpose, the ram 35 has a laterally rounded, front end with a horizontal slit. In this slit, a round steel disk 40 is horizontally aligned and mounted rotatably about a vertical pin 41. With this steel disk 40, the ram 35 butts in a laterally flattened indentation 25 in the control plate 20.3. If the control plate 20.3 is moved laterally in the guiding element 50, the steel disk 40 rolls along the corresponding flank of the laterally flattened indentation 25 in the control plate 20.3 out of the indentation 25 (see FIGS. 8*a*, 8*b* and 8*c*). The ram 35 is thereby pressed in the rearward direction against the pretensioning of the spiral spring 36. On account of the flank of the indentation 25 that is aligned obliquely in relation to the spring force, a driving-back force is thereby exerted on the control plate 20.3, driving the control plate 20.3 back into a central position in the guiding element 50, in which the steel disk 40 is at a lowest point in the indentation 25 of the control plate 20.3. Therefore, by setting the pretensioning of the spiral spring 36, the strength of the driving-back force can be set. As also shown in FIGS. 11*a* and 11*b*, there is the possibility that the laterally flattened indentation 25 has to each side a hollow 42.1, 42.2, in which the steel disk 40 of the ram 35 can engage when the automatic front unit 1 is in the safety release position. This allows the driving back force that acts on the control plate 20.3 to be minimized or made to cease completely in the safety release position.

Figure 4A:
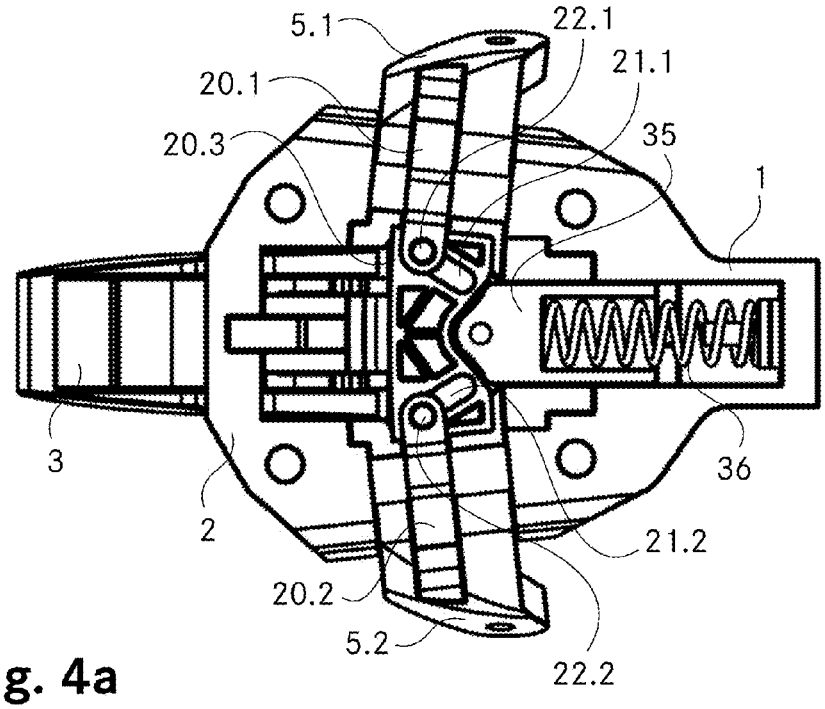
Figure 4B:
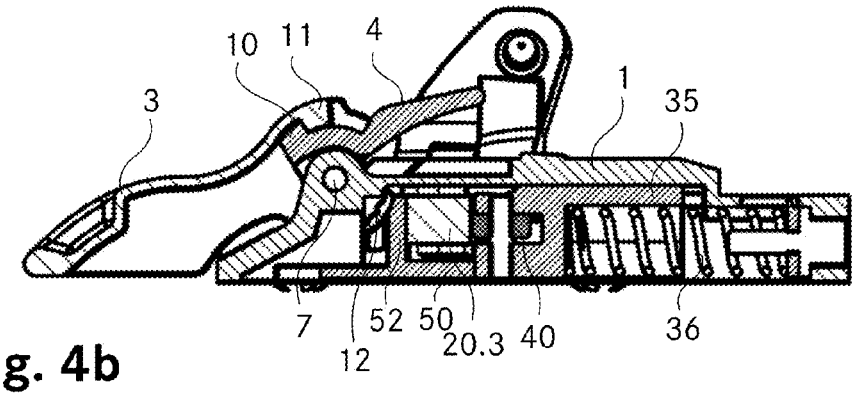
Figure 4C:
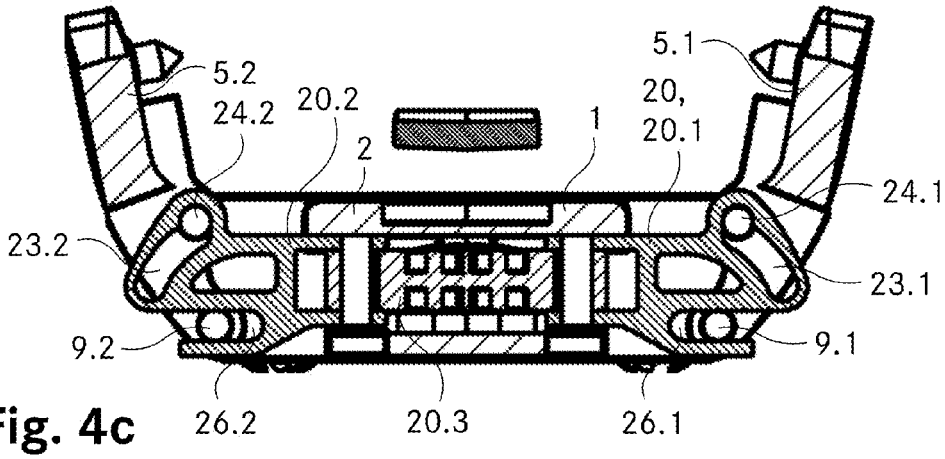

FIGS. 4*a*, 4*b* and 4*c* shows three different views of the automatic front unit 1 in the release position. In FIG. 4*a*, the automatic front unit 1 is represented from below, the baseplate 30 and the guiding element 50 (see FIG. 3) having been left out. FIG. 4*b* shows a vertical longitudinal section through the automatic front unit 1, extending along the center of the ski, and FIG. 4*c* shows a vertical cross section through the positive control device 20, when seen from the front.

As can be seen in FIG. 4*a*, the control plate 20.3 has been displaced in the rearward direction with respect to the two side levers 20.1, 20.2, whereby the two sliders 22.1, 22.2 are at a front end of the second slotted links 21.1, 21.2. Since the second slotted links 21.1, 21.2 in the control plate 20.3 diverge from the rear to the front, the two side levers 20.1, 20.2 are thereby moved apart. Correspondingly, the two pivoting levers 5.1, 5.2 are also pivoted apart. Since the two side levers 20.1, 20.2 are not mounted displaceably in the longitudinal direction of the ski, but only in the transverse direction of the ski, in the housing 2, the control plate 20.3 is displaced in the rearward direction in the housing 2, into a rear position. Correspondingly, the ram 35 is pressed in the rearward direction against the spiral spring 36.

FIG. 4*b* shows that the control lever 3 is in the release position and that the tread spur 4 has been pivoted in the upward direction. Moreover, it can be seen that, in its front region, the tread spur 4 runs in the control lever 3 and has an upwardly facing shoulder 10, which bears with its rear edge against a downwardly facing counterpart 11 of the control lever 3. Therefore, the control lever 3 is pivoted up when the tread spur 4 is pressed in the downward direction or the tread spur 4 is pivoted up when the control lever 3 is pivoted in the downward direction, into the release position.

Furthermore, it can be seen in FIG. 4*b* that the control plate 20.3 is guided in the guiding element 50 and that the ram 35 presses with the steel disk 40 from the rear in the forward direction against the control plate 20.3. The control plate 20.3 is thereby held in its rear position, by the guiding element 50 butting with the front stop 52 in the forward direction against the latching device 12 arranged on the control lever 3 (see also FIG. 6*d*).

In the cross section that is represented in FIG. 4*c*, the mounting of the two pivoting levers 5.1, 5.2 on the side levers 20.1, 20.2 can be seen. It can be seen here that the first sliders 24.1, 24.2 are at an upper end of the first slotted links 23.1, 23.2. In a region of these upper ends, the first slotted links 23.1, 23.2 run a little way downward in the vertical direction. After that, they make a sharp turn outward from the center of the ski and run arcuately outward and increasingly downward. It can also be seen in FIG. 4*c* that the two side levers 20.1, 20.2 have in a lower region notches 26.1, 26.2 that run in the horizontal direction from the outside to the center of the ski. The pivots 9.1, 9.2, about which the two pivoting levers 5.1, 5.2 are pivotably mounted on the housing 2, run in these notches 26.1, 26.2. If the positive control device 20, consisting of the two side levers 20.1, 20.2 and the control plate 20.3, is moved in the transverse direction of the ski, the notches 26.1, 26.2 are moved by way of the pivots 9.1, 9.2 arranged fixed to the ski on the housing 2.

Figure 5A:
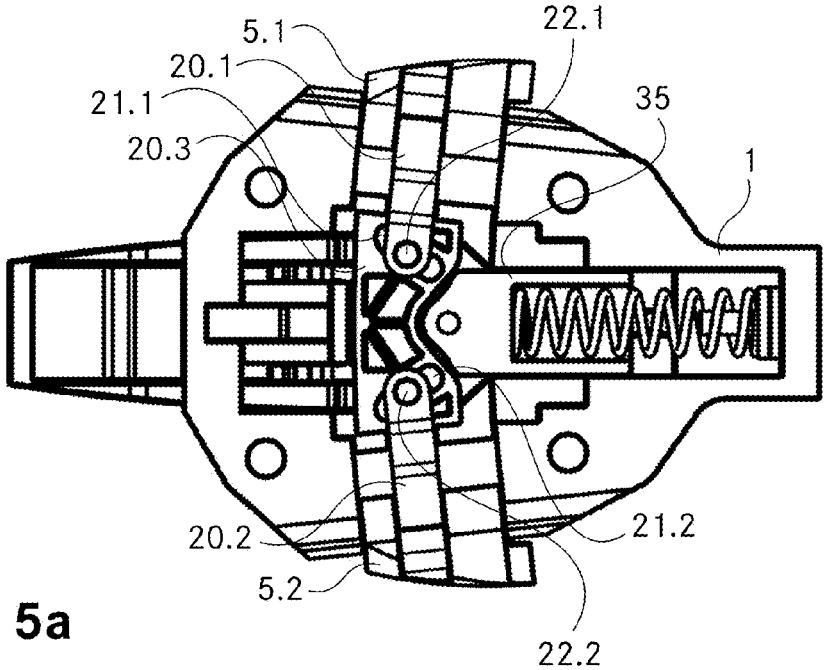
Figure 5B:
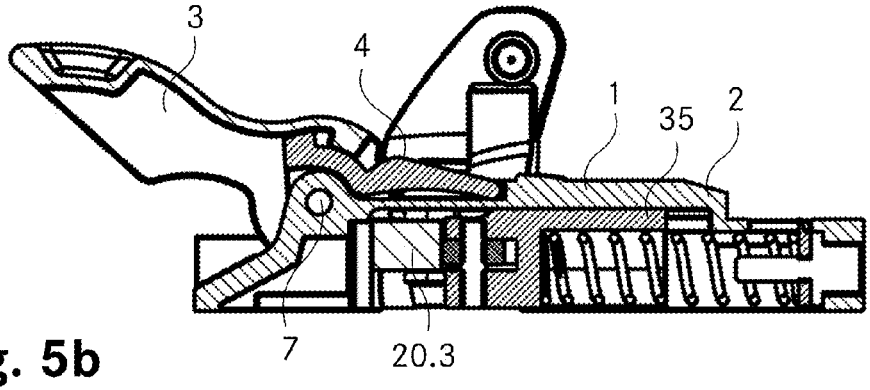
Figure 5C:
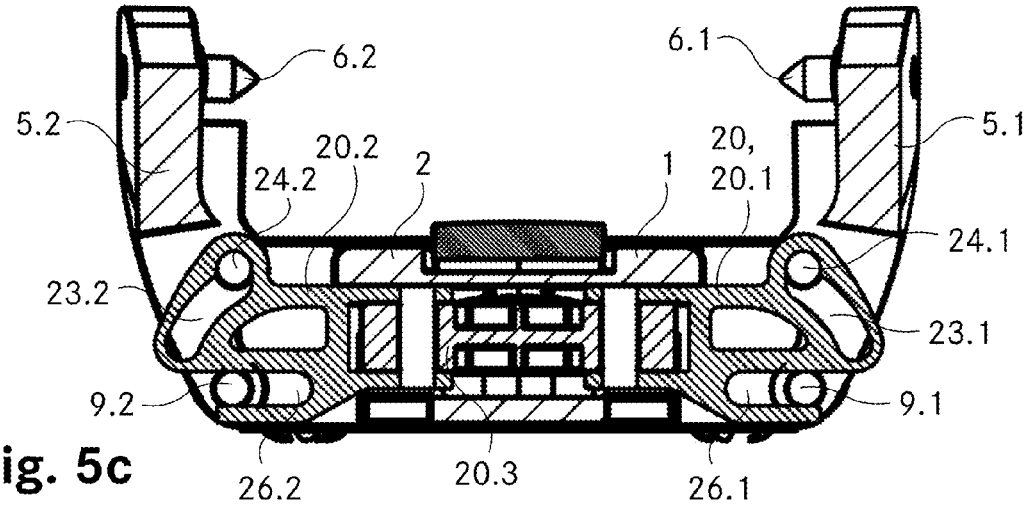

FIGS. 5*a*, 5*b* and 5*c* show the same views of the automatic front unit 1 as FIGS. 4*a*, 4*b* and 4*c*. As a difference from FIGS. 4*a*, 4*b* and 4*c*, however, in FIGS. 5*a*, 5*b* and 5*c* the automatic front unit 1 is in the securing position.

In FIG. 5*a* it can be seen that the control plate 20.3 and the ram 35 are slightly further forward in the securing position than in the release position (see FIG. 4*a*). Correspondingly, the second sliders 22.1, 22.2 are in a central region of the second slotted links 21.1, 21.2. Since the second slotted links 21.1, 21.2 diverge from the rear to the front, as a result the two side levers 20.1, 20.2 have been drawn together slightly in comparison with the release position. Therefore, the two pivoting levers 5.1, 5.2 have also been pivoted together.

FIG. 5*b* shows that the tread spur 4 has been pivoted in the downward direction about the transverse axle 7 and is resting on the housing 2. It can also be seen that the control lever 3 has been pivoted up slightly and is in the securing position. In comparison with the release position (see FIG. 4*b*), the ram 35 and the control plate 20.3 have been displaced slightly in the forward direction. By contrast with FIG. 4*b*, here in FIG. 5*b* the guiding element 50 has been left out.

In the cross section (FIG. 5*c*) it can be seen how the two pivoting levers 5.1, 5.2 have been pivoted together, whereby the two holding spurs 6.1, 6.2 are at the second distance from each other. As in the release position (see FIG. 4*c*), the first sliders 24.1, 24.2 are at the upper ends of the first slotted links 23.1, 23.2. By contrast with the release position, however, as already mentioned, the two side levers 20.1, 20.2 have been drawn together. Correspondingly, the pivots 9.1, 9.2, about which the two pivoting levers 5.1, 5.2 are pivotably mounted on the housing 2, are slightly further outward in the notches 26.1, 26.2 of the two side levers 20.1, 20.2.

Figure 6A:
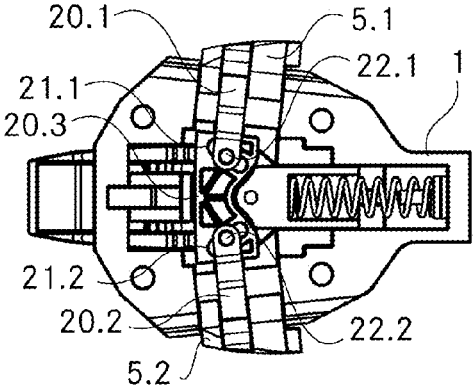
Figure 6B:
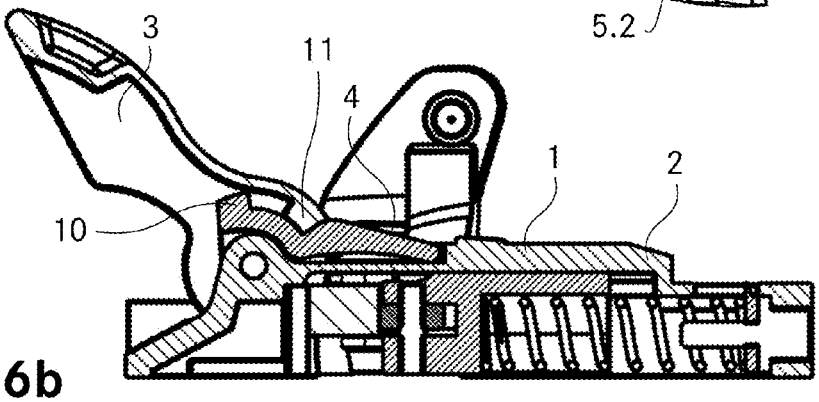
Figure 6C:
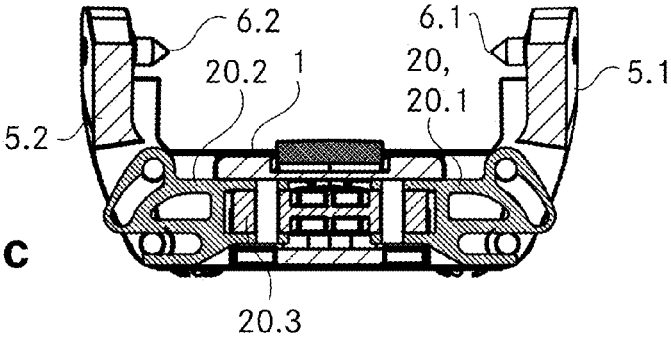

FIGS. 6*a*, 6*b* and 6*c* show the same views of the automatic front unit 1 as FIGS. 4*a*, 4*b* and 4*c* as well as 5*a*, 5*b* and 5*c*. In FIGS. 6*a*, 6*b* and 6*c*, however, the automatic front unit 1 is in the blocking position.

In FIGS. 6*a* and 6*c*, it can be seen that the two side levers 20.1, 20.2 and the control plate 20.3 are substantially at a position that is the same as in the securing position (see FIGS. 5*a* and 5*c*). It can also be seen in FIG. 6*b* that, in the blocking position, the control lever 3 has been pivoted further in the upward direction. It is in the blocking position. As already in the securing position, the tread spur 4 has been pivoted in a downward direction and is resting on the housing 2. As a result, the shoulder 10 of the tread spur 4 is further forward under the control lever 3 and is not in contact with the counterpart 11 of the control lever 3.

Figure 6D:
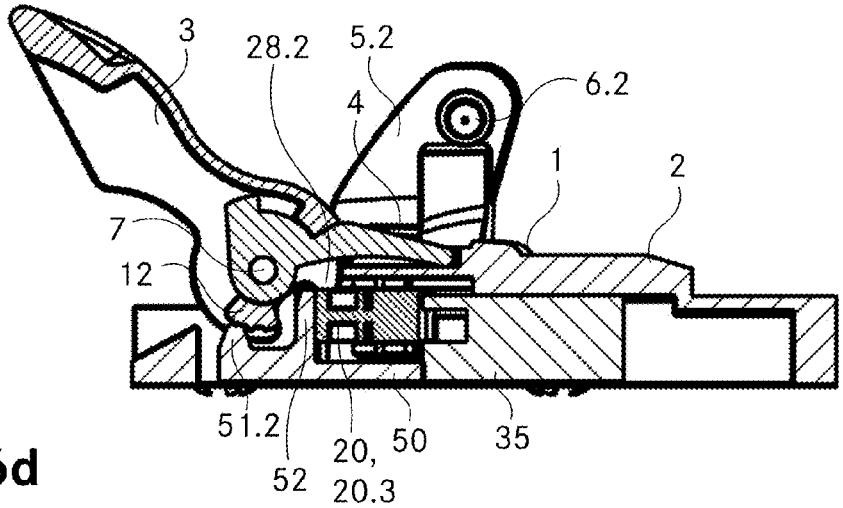

FIG. 6*d* shows in a way similar to FIG. 6*b* a vertical longitudinal section through the automatic front unit 1, in the blocking position. However, the vertical longitudinal section does not extend along the center of the ski, but is offset slightly from the center of the ski to the side. It extends through one of the two forwardly running arms of the guiding element 50 and through the nub 51.2 arranged on this arm. As a result, the latching device 12, which is arranged on the control lever 3 in a region underneath the transverse axle 7, can be seen. With this latching device 12, the control lever 3 presses on the two nubs 51.2 of the forwardly pointing arms of the guiding element 50. The further the control lever 3 is pulled in the upward direction in the blocking position, the further the latching device 12 is drawn over the nubs 51.2 of the guiding element 50. The guiding element 50 and the control plate 20.3 mounted therein are thereby also drawn forward in the longitudinal direction of the ski. Since, as a result, the second sliders 22.1, 22.2 are drawn together by the second slotted links 21.1, 21.2, the two side levers 20.1, 20.2 and the two pivoting levers 5.1, 5.2 with the holding spurs 6.1, 6.2 are drawn further together (see FIG. 6*a*). Therefore, in the blocking position, the holding spurs 6.1, 6.2 are at a third distance from each other, which is equal to or less than the second distance. To what extent the third distance is effective depends on the ski boot that is mounted in the automatic front unit 1. In comparison with the securing position, in which the holding spurs 6.1, 6.2 are at the second distance from each other, in the blocking position the two holding spurs 6.1, 6.2 are drawn together by the pulling up of the control lever 3, until they bear in the lateral bearing bushes of the ski boot. By bearing in this way, further pulling up of the control lever 3 is prevented by way of the pivoting levers 5.1, 5.2 and the positive control device 20. How far the control lever 3 can be pulled up in the blocking position consequently depends on the width of the ski boot, or on the distance between the lateral bearing bushes in the toe region of the ski boot.

This drawing together of the two holding spurs 6.1, 6.2 in the blocking position may also take place by a slightly modified mechanism. For example, the forwardly running arms of the guiding element 50 may have a latching device that runs forward in the upward direction in a substantially semicircular manner, the curve radius decreasing in the upward direction. In this modification, a nub may be respectively arranged on each side of the control lever 3, in the region underneath the transverse axle 7. With these nubs, the control lever 3 can press onto the two latching devices of the forwardly pointing arms of the guiding element 50. The further the control lever 3 is pulled in the upward direction in the blocking position, the further the nubs are drawn over the latching devices of the guiding element 50. The upwardly progressively decreasing curve radius of the latching devices has the effect here that the guiding element 50 and the control plate 20.3 mounted therein are drawn forward in the longitudinal direction of the ski. As a result, the two pivoting levers 5.1, 5.2 with the holding spurs 6.1, 6.2 can be drawn together by way of the second slotted links 21.1, 21.2 and the second sliders 22.1, 22.2.

Along with the drawing together of the two holding spurs 6.1, 6.2 in the blocking position, the two catches 28.2 are inserted into the corresponding notches 27.2 in the control plate 20.3 (see FIG. 3) by the pulling up of the control lever 3. As a result, a movement of the control plate 20.3, and consequently of the positive control device 20 as a whole, in the transverse direction of the ski is blocked.

When the control lever 3 is pivoted from the blocking position downward into the securing position, the latching device 12 is moved away from the nubs 51.2 of the guiding element 50 in the rearward direction. The latching element 12 thereby butts against the first stop 52 of the guiding element 15. When the control lever 3 is then pivoted further downward into the release position, the latching device 12 presses the first stop 52 in the rearward direction. As a result, the guiding element 50 with the control plate 20.3 mounted therein is moved in the rearward direction against the ram 35 and against the pretensioning of the spiral spring 36 (see FIG. 4*b*).

Figure 7A:
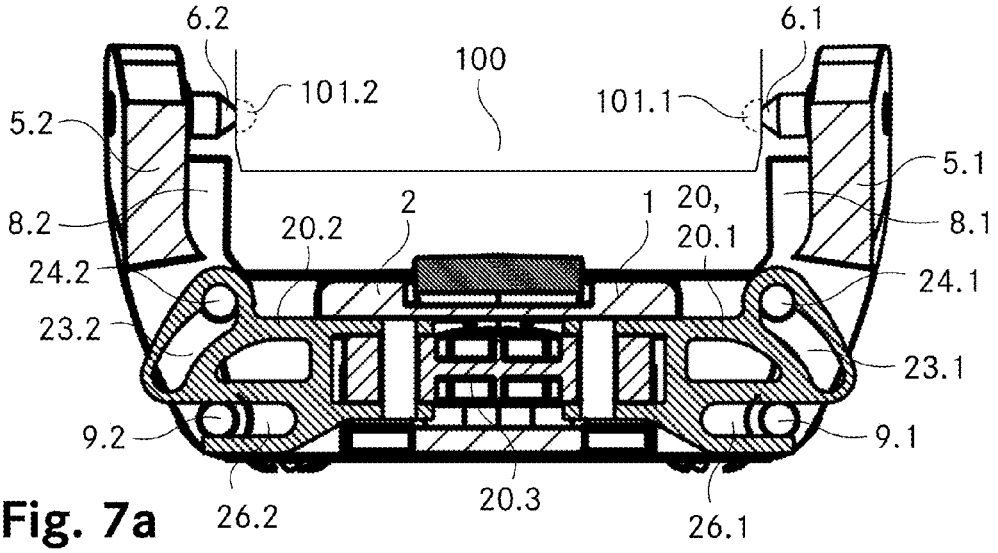
Figure 7B:
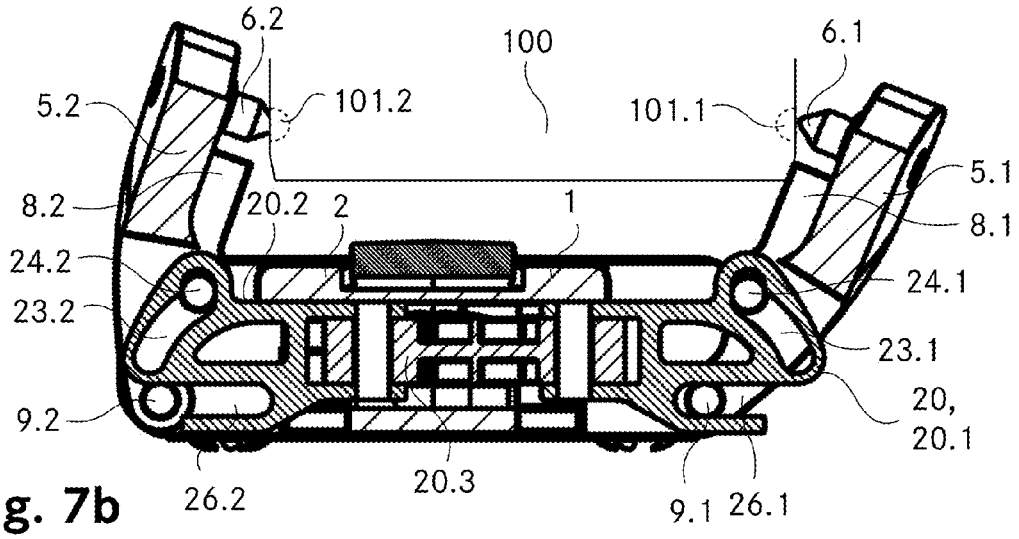
Figure 7C:
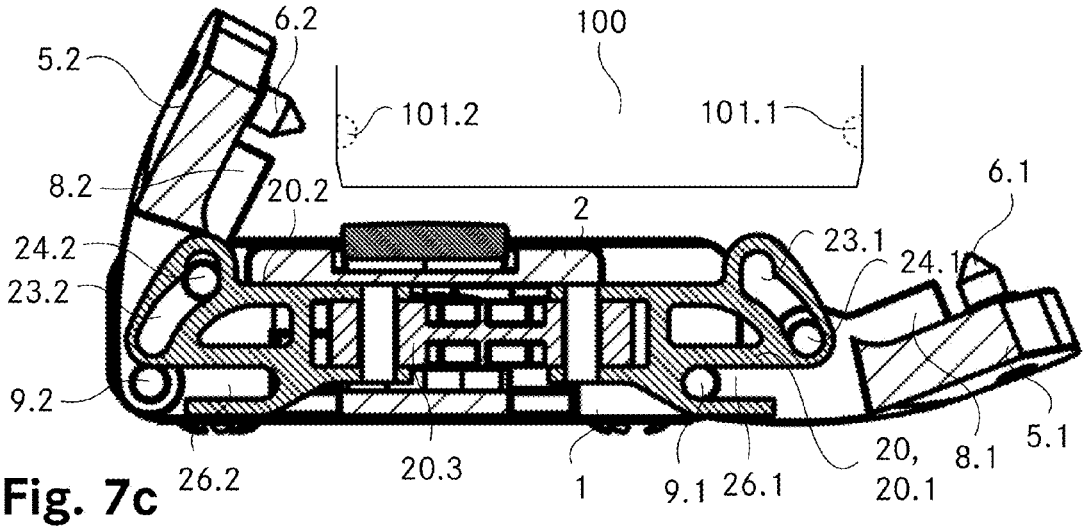

FIGS. 7*a*, 7*b* and 7*c* each show, when seen from the front, a vertical cross section through the automatic front unit 1, extending through the positive control device 20, and a schematically represented section through a lower region of the ski boot 100. The sequence of the figures illustrates a lateral safety release of the automatic front unit 1. The ski boot 100 is thereby detached from the automatic front unit 1 to the right in the representation. When seen in the forward skiing direction, the movement of the ski boot 100 does in fact go to the left. Here, however, the references to the "right" and "left" are based on the representation shown.

In FIG. 7*a*, the automatic front unit 1 is in the securing position. The representation corresponds to the representation of the automatic front unit 1 shown in FIG. 5*c*. The additional schematic representation of the ski boot 100 shows how the ski boot 100 is mounted in the automatic front unit 1. It can be seen from this that a lower region of the sole of the ski boot 100 is almost in contact with the control jaws 8.1, 8.2 of the two pivoting levers 5.1, 5.2. The positive control device 20, consisting of the control plate 20.3 and the two side levers 20.1, 20.2, is in the center of the ski, centered in the automatic front unit 1. As already described, however, in the securing position the positive control device 20 can be moved in the transverse direction of the ski. (This movement is blocked in the blocking position.) When there is such a movement, the two pivoting levers 5.1, 5.2 are pivoted about the pivots 9.1, 9.2 in a coupled state within a dynamic region in the transverse direction of the ski. As a result, the two holding spurs 6.1 6.2 are moved in a coupled state, at the second distance from each other, on a dynamic path in the transverse direction of the ski. This is represented in FIG. 7*b*. Here, the automatic front unit 1 is still in the securing position. However, the two pivoting levers 5.1, 5.2 have been pivoted to the right, almost up to one end of the dynamic region, and the positive control device 20 has been moved almost up to one end of a positive control path. Since the two pivoting levers 5.1, 5.2 have been pivoted to the right, the two holding spurs 6.1, 6.2 have also been moved together with the ski boot 100 almost up to one end of a dynamic path. In this position, the lower region of the sole of the ski boot 100 is in contact on the right with the control jaw 8.1 of the corresponding pivoting lever 5.1. By butting against the control jaw 8.1 in this way, the holding spur 6.1 of this pivoting lever 5.1 just comes away from the corresponding bearing bush 101.1 of the ski boot 100. Correspondingly, the holding spur 6.1 cannot dig into the bearing bush 101.1 of the ski boot 100 and also cannot prevent detachment of the ski boot 100 from the automatic front unit 1 by getting caught on the sole of the ski boot 100.

In the state in which the positive control device 20 is centered in the center of the ski, the two first sliders 24.1, 24.2 are substantially above the pivots 9.1, 9.2, about which the two pivoting levers 5.1, 5.2 can be pivoted (FIG. 7*a*). When the positive control device 20 has been moved to the right, the two pivoting levers 5.1, 5.2 have been pivoted to the right. As shown in FIG. 7*b*, consequently the two first sliders 24.1, 24.2 have also been pivoted to the right. On account of their arrangement in relation to the pivots 9.1, 9.2, the two first sliders 24.1, 24.2 have moreover also been moved slightly in the downward direction. Therefore, they are no longer at the upper end, but between the upper end and the kink of the first slotted links 23.1, 23.2.

When the positive control device 20 has been moved to the right up to the end of the positive control path and the two pivoting levers 5.1, 5.2 have been pivoted to the right up to one end of the dynamic region, the two first sliders 24.1, 24.2 are in the kink of the first slotted links 23.1, 23.2. In this case, on account of the geometry of the first slotted links 23.1, 23.2, the first slider 24.1 of the left-hand pivoting lever 5.2 butts against the first slotted link 23.2 of the corresponding side lever 20.2 and thereby hinders the positive control device 20 from further movement to the right. At the same time, the positive control device 20 has been moved so far to the right that the first slider 24.1 of the right-hand pivoting lever 5.1 has been released from the kink in the first slotted link 23.1 and can move freely in the arcuate portion of the first slotted link 23.1 of the corresponding side lever 20.1. This allows the right-hand pivoting lever 5.1 to tilt freely in the downward direction, whereby the automatic front unit 1 is in a safety release position (FIG. 7*c*). When the right-hand pivoting lever 5.1 has tilted away, the ski boot 100 has come out and been released by the automatic front unit 1.

In the same way as already shown by FIGS. 7*a*, 7*b* and 7*c*, FIGS. 8*a*, 8*b* and 8*c* illustrate a lateral safety release of the automatic front unit 1. In the representations, the automatic front unit 1 is respectively in the same positions as in the representations of FIGS. 7*a*, 7*b* and 7*c*. However, FIGS. 8*a*, 8*b* and 8*c* in each case show the automatic front unit 1 from below, the baseplate 30 and the guiding element 50 (see FIG. 3) having been left out.

Figure 8A:
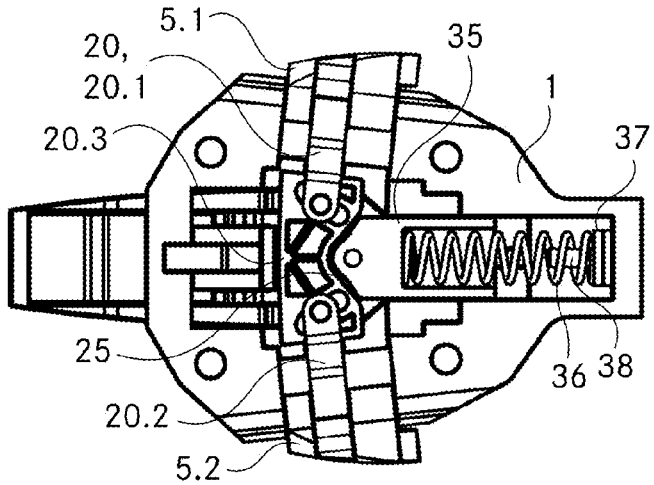
Figure 8B:
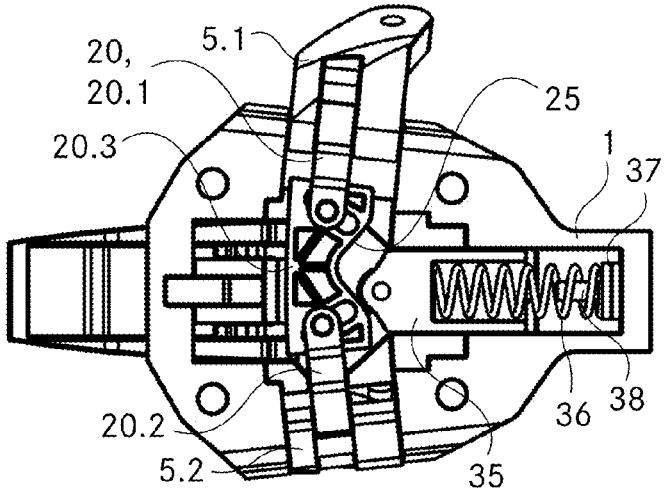
Figure 8C:
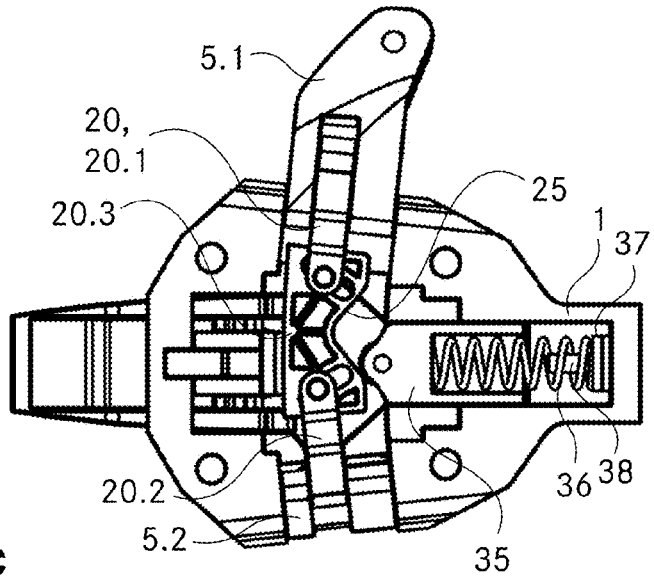

FIG. 8*a* corresponds to FIG. 5*a*. It shows the positive control device 20, consisting of the control plate 20.3 and the two side levers 20.1, 20.2, centered in the center of the ski in the automatic front unit 1. FIG. 8*b* shows the positive control device 20 in a position close to the end of the positive control path. Correspondingly, the two pivoting levers 5.1, 5.2 have also been pivoted almost up to the end of the dynamic region. Furthermore, FIG. 8*c* shows the positive control device 20 at the end of the positive control path. The two pivoting levers 5.1, 5.2 have been pivoted up to the end of the dynamic region, the pivoting lever 5.1, which lies in the pivoting direction, having been released by the positive control device 20 and tilted in the downward direction.

As already described in conjunction with FIG. 3, the control plate 20.3 has a laterally flattened indentation 25. Since, in FIGS. 8*b* and 8*c*, the control plate 20.3 has been moved laterally away from its position in the center of the ski, the ram 35 has been pressed by the corresponding flank of the indentation 25 in the control plate 20.3 out of the indentation 25 in the rearward direction against the pretensioning of the spiral spring 36. On account of the flank of the indentation 25 that is aligned obliquely in relation to the spring force, a driving-back force is thereby exerted on the control plate 20.3, driving the control plate 20.3 back into its position in the center of the ski. This driving-back force and the path that the ski boot mounted in the automatic front unit 1 covers from its position in the center of the ski to the end of the dynamic path determine a maximum energy that the automatic front unit 1 can absorb without a lateral safety release occurring. This maximum energy may be set by the pretensioning of the spiral spring 36, by means of setting by using the adjusting screw 38 and the locking nut 37.

The lateral safety release, which is illustrated in FIGS. 7*a*, 7*b*, 7*c* as well as 8*a*, 8*b* and 8*c*, may also take place toward the other side that is not represented here. The releasing operation for this proceeds in the same way.

Figure 9:
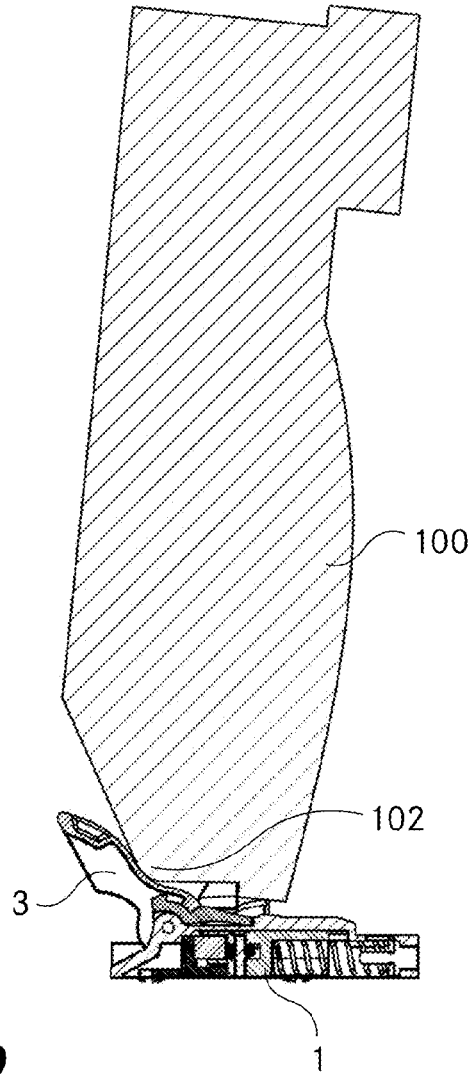
FIG. 9 shows a vertical longitudinal section through the automatic front unit in the blocking position, a ski boot being mounted in the automatic front unit.

The automatic front unit 1 makes possible not only a lateral safety release, but also a release in the forward direction. This frontal release may take place when the automatic front unit 1 is in the securing position or in the blocking position. In order to illustrate this, FIG. 9 shows a vertical longitudinal section through the automatic front unit 1 in the blocking position. In this case, a ski boot 100 is mounted in the automatic front unit 1. A heel of the ski boot 100 is free, whereby the ski boot 100 can be pivoted in the upward direction with the heel. The ski boot 100 is correspondingly represented tilted forward, a toe region 102 of the ski boot 100 being in contact with the control lever 3. If a skier who is using an automatic front unit 1 falls in the forward direction, the ski boot 100 can be tilted forward further than is represented in FIG. 9. When the automatic front unit 1 is in the blocking position, as represented in FIG. 9, in the event of such a fall the control lever 3 is pressed downward by the toe region 102 of the ski boot 100 from the blocking position into the securing position, whereby the automatic front unit 1 is transferred from the blocking position into the securing position. If the ski boot is then tilted forward still further, the control lever 3 is pressed downward even slightly further. The two pivoting levers 5.1, 5.2 are thereby pivoted apart and the ski boot 100 is released by the automatic front unit 1. For this purpose, the control lever 3 does not have to be pressed entirely from the securing position into the release position and the automatic front unit 1 does not have to be transferred completely into the release position. It is sufficient if, starting from the securing position, the ski boot 100 presses the control lever 3 downward slightly and the two pivoting levers 5.1, 5.2 are pivoted slightly apart.

The automatic front unit 1 can be used in a ski-touring binding system together with an automatic heel unit (not shown). In such a system, the automatic heel unit should make it possible for the ski boot 100 to be mounted in a heel region. Correspondingly, such a system makes possible a downhill position, in which the automatic front unit 1 is in the securing position and in which the ski boot 100 is mounted in its toe region in the automatic front unit 1 and in its heel region on the automatic heel unit. Furthermore, such a ski-touring binding system makes possible a climbing position, in which the ski boot 100 is mounted in the automatic front unit 1 and is released by the automatic heel unit. In this climbing position, the automatic front unit 1 may be in the securing position or in the blocking position. In both positions, it makes a pivoting movement of the ski boot 100 possible about a transverse axis of the ski and correspondingly makes a walking movement by a skier possible.

As described above, in the securing position, the automatic front unit 1 makes a lateral safety release possible. If a ski boot 100 is mounted in a ski-touring binding system with the automatic front unit 1 and the ski-touring binding system is in the downhill position, the ski-touring binding system thereby makes a lateral safety release possible. If, for example, the ski boot 100 is mounted on the automatic heel unit by holding spurs pointing from the rear to the front, when there is such a lateral safety release the ski boot 100 can carry out a rotating movement. In this case, it is first detached laterally from the automatic front unit 1, while still being held by the holding spurs of the automatic heel unit. As soon as the ski boot 100 has come out from the automatic front unit 1, it can also be released by the automatic heel unit, by being moved away or turned away from the holding spurs of the automatic heel unit. There is consequently no need for the automatic heel unit to provide a possibility for a lateral safety release. It is sufficient if the automatic heel unit makes a safety release in the forward direction possible.

Figure 10:
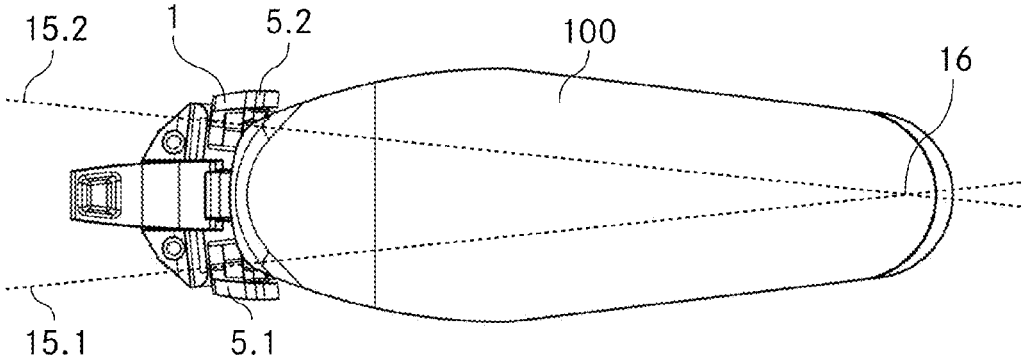
FIG. 10 shows a plan view of the automatic front unit in the securing position, with a ski boot held therein, FIGS. 11*a, b, c* show views of the automatic front unit from below to illustrate a possible way of implementing the interaction of a ram with the positive control device, FIGS. 12*a, b, c* show views of the automatic front unit from below to illustrate a further possible way of implementing the interaction of the ram with the positive control device, FIGS. 13*a, b* show cross sections through the automatic front unit, extending through the positive control device, to illustrate possible embodiments that could facilitate a lateral safety release of the automatic front unit, FIGS. 14*a, b, c, d* show an oblique view of a further automatic front unit according to the invention in the release position, in the securing position and in the safety release position.

The automatic front unit 1 is optimized for a lateral safety release in the case of a ski-touring binding system, in which the automatic heel unit does not make a lateral safety release possible. This optimization is illustrated in FIG. 10, which is a plan view of the automatic front unit 1 in the securing position, with the ski boot 100 held therein. Thus, FIG. 10 shows two straight lines along which are aligned the pivots 9.1, 9.2 (see FIG. 3), about which the two pivoting levers 5.1, 5.2 can be pivoted. These two straight lines 15.1, 15.2 converge rearwardly at an angle of 6 degrees to the longitudinal direction of the ski and intersect at a point 16 in the heel region of the ski boot 100. Since the automatic heel unit does not make a lateral safety release possible, when there is a lateral safety release the ski boot 100 is turned about a vertical axis in the vicinity of the point 16, until it has come out from the automatic front unit 1. As a result, the pivoting movement of the pivoting lever 5.1, 5.2 lying in the direction of movement proceeds perpendicularly to the direction of movement of the ski boot 100. Correspondingly, the alignment of the pivots 9.1, 9.2 is optimized for a rotating movement of the ski boot 100 when there is a lateral safety release.

As can be seen from FIGS. 8*a*, 8*b* and 8*c*, this optimization has the consequence that the two side levers 20.1, 20.2 of the positive control device 20 are not aligned along a straight line running at right angles to the longitudinal axis of the ski. They are each aligned at right angles to the corresponding pivot 9.1, 9.2, and consequently each deviate by 6 degrees from a straight line that is aligned perpendicularly to the longitudinal direction of the ski.

Figure 11C:
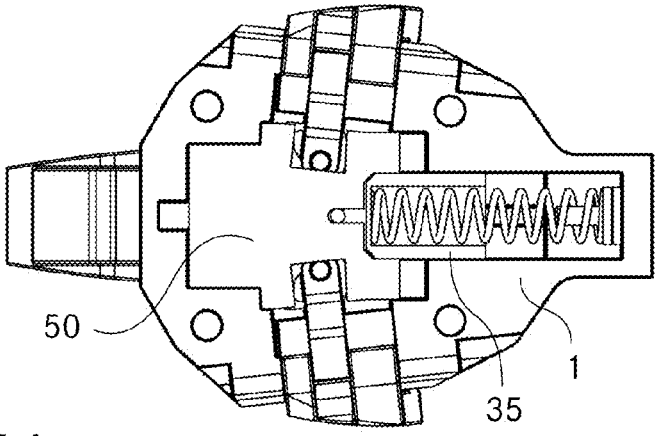

In a way similar to FIGS. 8*a* and 8*b*, FIGS. 11*a* and 11*b* show the automatic front unit 1 in the securing position and in a position in which the positive control device 20 is at the end of the positive control path. In this case, the automatic front unit 1 is respectively represented from below, the baseplate 30 and the guiding element 50 having been left out. FIG. 11*c* in turn shows the automatic front unit 1 in the securing position from below, the baseplate 30 having been left out, while the guiding element 50 is shown.

The automatic front unit 1 that is shown in FIGS. 11*a*, 11*b* and 11*c* has two differences in comparison with the previously shown automatic front unit 1. These differences illustrate further possible embodiments for the automatic front unit 1. The first difference is that the ram 35 is guided by a nub in a notch in the guiding element 50 that is aligned in the longitudinal direction of the ski (see FIG. 11*c*). Since the ram 35 is correspondingly guided above and below in the longitudinal direction of the ski, better guidance is obtained for the ram 35 in the longitudinal direction of the ski, so that a better force transfer from the ram 35 to the control plate 20.3 is achieved, whereby frictional losses are minimized. The second difference is that the laterally flattened indentation 25 has to each side a hollow 42.1, 42.2, in which the steel disk 40 of the ram 35 can engage when the automatic front unit 1 is in the safety release position (see FIGS. 11*a* and 11*b*). As a result, the driving-back force acting on the control plate 20.3 can be minimized or made to cease completely in the safety release position. Correspondingly, the pivoting away of the corresponding pivoting lever 5.1 is made easier, since a frictional resistance for the pivoting movement of the pivoting lever 5.1 is likewise minimized or made to cease by the minimized or ceased driving-back force.

Figure 12A:
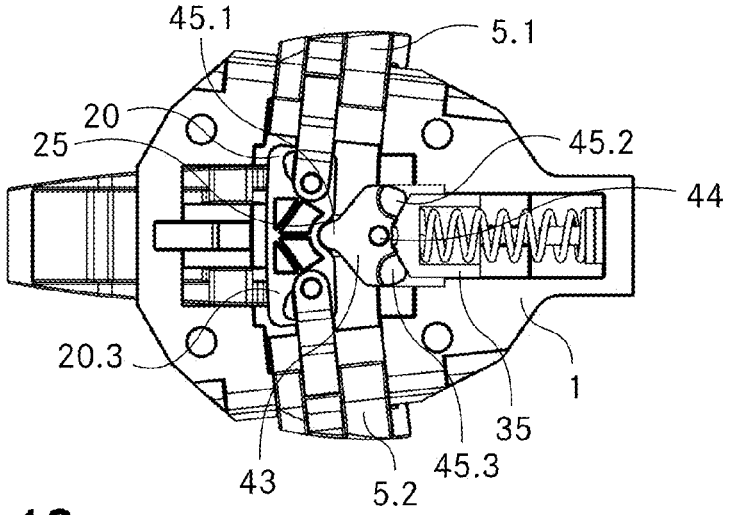
Figure 12B:
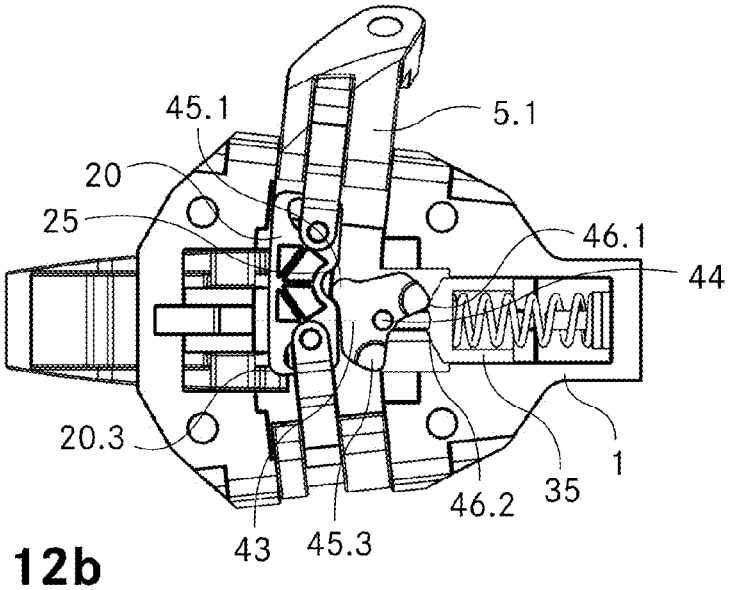
Figure 12C:
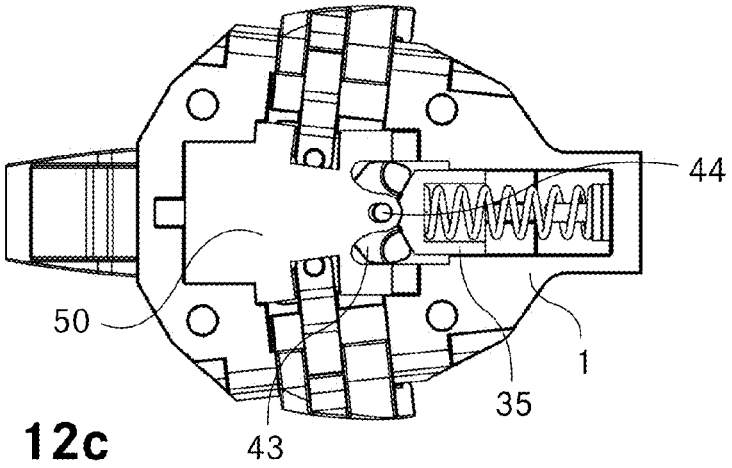

FIGS. 12*a*, 12*b* and 12*c* show an identical view of the automatic front unit 1 to FIGS. 11*a*, 11*b* and 11*c*, although FIGS. 12*a*, 12*b* and 12*c* illustrate a further possible embodiment. Here, the ram 35 does not have a steel disk 40 at its tip. Instead of the steel disk 40, a pivoting element 43 is arranged between the ram 35 and the control plate 20.3. This pivoting element 43 is mounted in its center pivotably about a vertically aligned pivoting pin 44. To the front, it has a rounded, first foot 45.1, which engages in the laterally flattened indentation 25 of the control plate 20.3. On each of both sides of the center of the ski, the pivoting element also has behind the pivoting pin 44 a rearwardly aligned, second foot 45.2 and a rearwardly aligned third foot 45.3. When the positive control device 20 is in the center of the positive control path, these two feet 45.2, 45.3 are supported in the rearward direction against the ram 35 (see FIG. 12*a*). When the positive control device 20 is moved along the positive control path, the first foot 45.1 of the pivoting element 43 is moved along with it, whereby the pivoting element 43 is pivoted about its pin 44 (see FIG. 12*b*). The foot 45.2 of the pivoting element that lies in the direction of movement of the positive control device 20 thereby presses the ram 35 in the rearward direction, while the other foot 45.3 is no longer in contact with the ram 35. Since, as a result, the pivoting element 43 is subjected to the forwardly directed force on one side, by the ram 35 acting by way of this one foot 45.2, a torque acts on the pivoting element 43 and drives the positive control device 20 back into the center of the positive control path by way of the first foot 45.1 of the pivoting element 43.

When the positive control device 20 is moved up to one end of the positive control path, the second or third foot 45.2, 45.3 of the pivoting element 43 that is in contact with the ram 25 latches in a corresponding hollow 46.1, 46.2 in the front side of the ram 35 (FIG. 12*b*). As a result, the force transfer between the ram 35 and the pivoting element 43 is minimized or made to cease, whereby the driving-back force that acts on the positive control device 20 is also minimized or made to cease completely. Correspondingly, the pivoting away of the corresponding pivoting lever 5.1, 5.2 is made easier, since a frictional resistance for the pivoting movement is likewise minimized or made to cease by the minimized or ceased driving-back force.

In FIG. 12*c*, the automatic front unit 1 is shown in the securing position from below, the baseplate 30 having been left out, while the guiding element 50 is shown. It can be seen from this that, in the case of this possible embodiment, the pivoting pin 44 of the pivoting element 43 is mounted in the guiding element 50, although the pivoting pin 44 can be moved slightly in the longitudinal direction of the ski. This achieves the effect that, in the blocking position, the ram 35 together with the pivoting element 43 can follow the movement of the control plate 20.3 (here concealed by the guiding element 50) to some extent in the longitudinal direction of the ski.

Figure 13A:
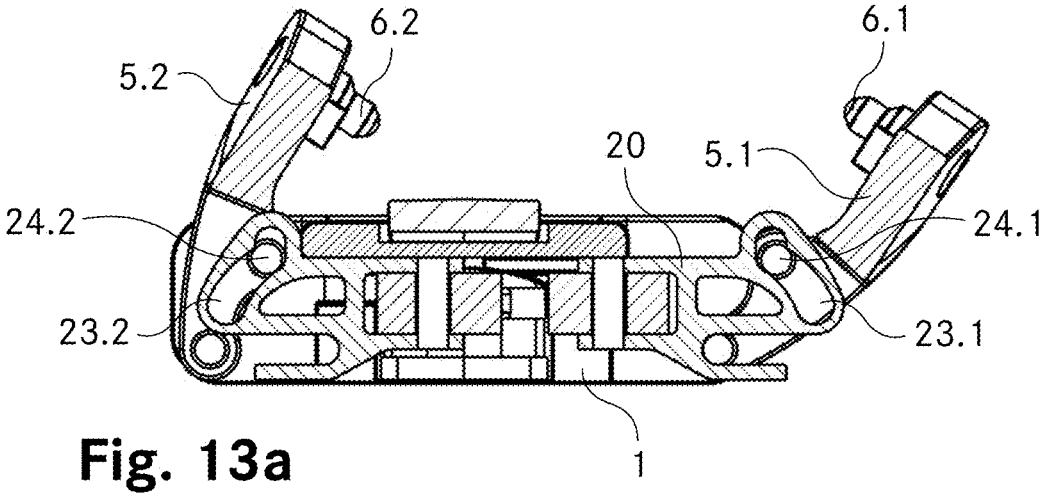
Figure 13B:
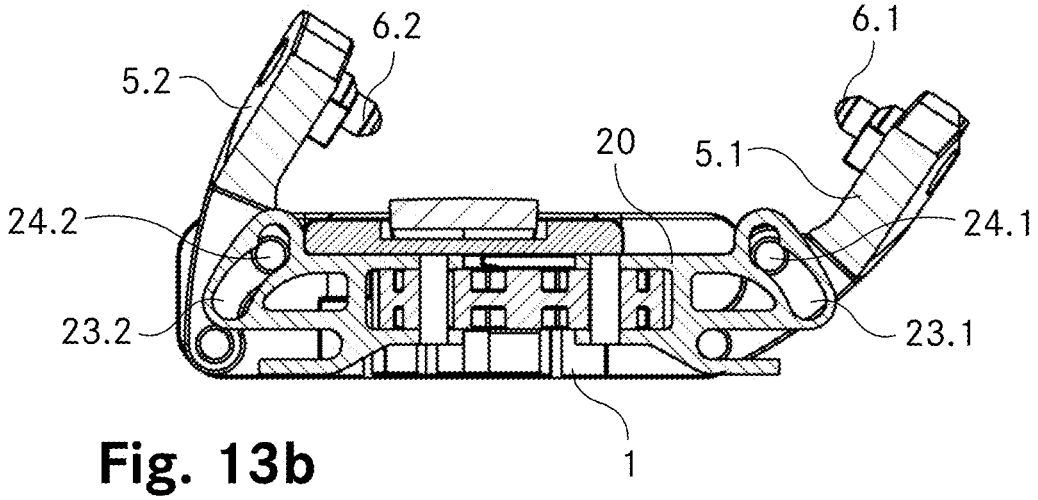

FIGS. 13*a* and 13*b* each show, when seen from above, a vertical cross section through the automatic front unit 1, extending through the positive control device 20. In both figures, the positive control device 20 of the automatic front unit 1 is at one end of the positive control path. In FIG. 13*a*, the possible embodiment that is represented in FIGS. 11*a*, 11*b* and 11*c* is shown, while in FIG. 13*b* the possible embodiment that is represented in FIGS. 12*a*, 12*b* and 12*c* is shown. Both differ from the previously described possible embodiments in that the arcuate portions of the first slotted links 23.1, 23.2 become wider in the downward direction. This allows the first sliders 24.1, 24.3 to move with less frictional resistance in the arcuate portion of the first slotted links 23.1, 23.2. As a result, the pivoting away of the corresponding pivoting lever 5.1, 5.2 in the safety release position is made easier.

Independently of the possible embodiments described in FIGS. 11*a*, 11*b*, 11*c*, 12*a*, 12*b* and 12*c*, this widening of the arcuate portions of the first slotted links 23.1, 23.2 may also be provided in the case of the possible embodiment of the automatic front unit 1 that is represented in FIGS. 1-10. There is then the possibility that the first slotted links 23.1, 23.2 become wider in the downward direction, as shown here, or else that they are constantly wider over the entire arcuate portions than at their upper ends.

In comparison with the possible embodiments shown in the preceding figures, the holding spurs 6.1, 6.2, which are shown in FIGS. 13*a*, 13*b*, have rounded free ends. This can achieve the effect that, when there is a lateral safety release, the ski boot can come out of the automatic front unit 1 more easily. However, this has the effect that the mounting of the ski boot in the automatic front unit 1 is impaired to some extent. There is correspondingly possibility that, on the automatic front unit 1, the shape of the free ends of the holding spurs 6.1, 6.2 is optimized between optimal mounting of the ski boot and optimal releasability of the ski boot from the automatic front unit 1. It should be mentioned in this respect that the holding means may, however, also be formed quite differently then the holding spurs 6.1, 6.2 represented here.

Figure 14A:
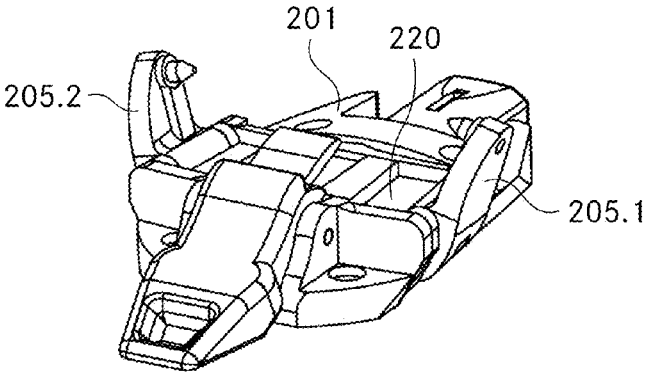
Figure 14B:
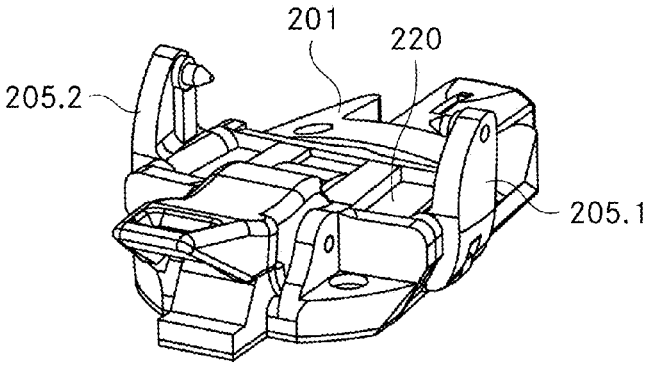
Figure 14C:
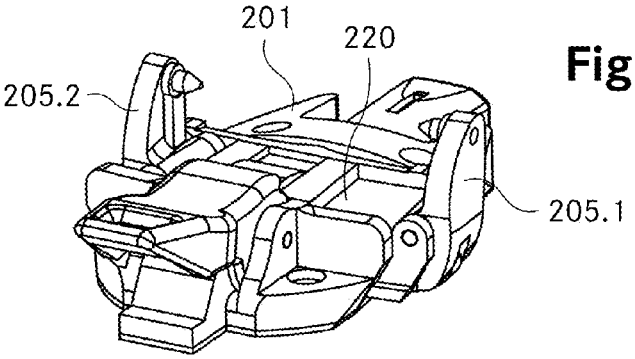
Figure 14D:
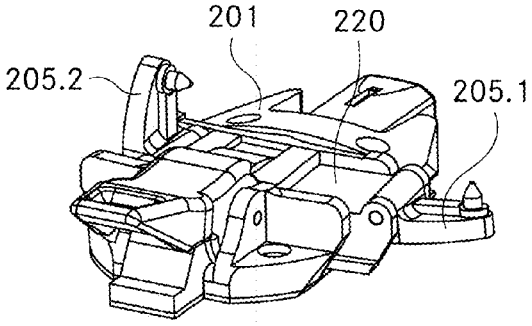

FIGS. 14*a*, 14*b*, 14*c* and 14*d* each show an oblique view of a further automatic front unit 201 according to the invention. In FIG. 14*a*, this automatic front unit 201 is represented in the release position. In each of FIGS. 14*b* and 14*c*, the automatic front unit 201 is shown in the securing position, the positive control device 220 being in the center of the positive control path in FIG. 14*b*, while it is at one end of the positive control path in FIG. 14*c*. By contrast, the automatic front unit 201 in FIG. 14*d* is shown in the safety release position. In all four FIGS. 14*a*, 14*b*, 14*c* and 14*d*, the automatic front unit 201 is aligned from oblique top right to oblique top left. When the automatic front unit 201 is mounted on a ski (not shown), top right corresponds in these figures to the rear of the ski, while bottom left corresponds to the front of the ski. Therefore, in these figures the longitudinal direction of the ski runs along an axis from top right to bottom left. Furthermore, in FIGS. 14*a*, 14*b*, 14*c* and 14*d*, top and bottom also correspond to top and bottom on the automatic front unit 201.

Among the ways in which the automatic front unit 201 according to the invention that is shown here differs from the previously described automatic front unit 1 according to the invention is that the pivots (see FIG. 15) of the two pivoting levers 205.1, 205.2 are mounted on the positive control device 220 and that, in the securing position, the positive control device 220 can be moved together with the two pivoting levers 205.1, 205.2 along the positive control path substantially in the transverse direction of the ski. It can correspondingly be seen in FIG. 14*c* that the two pivoting levers 205.1, 205.2 have been displaced together with the positive control device 220 with respect to the center of the positive control path (FIG. 14*b*) along a linear path in the transverse direction of the ski. As can be seen in FIG. 14*d*, in the case of the automatic front unit 201 shown here the pivoting lever 205.1 lying in the direction of movement of the positive control device 220 can likewise be tilted away in the safety release position, whereby a ski boot (not shown here) that is held in the automatic front unit 201 can be released.

Figure 15:
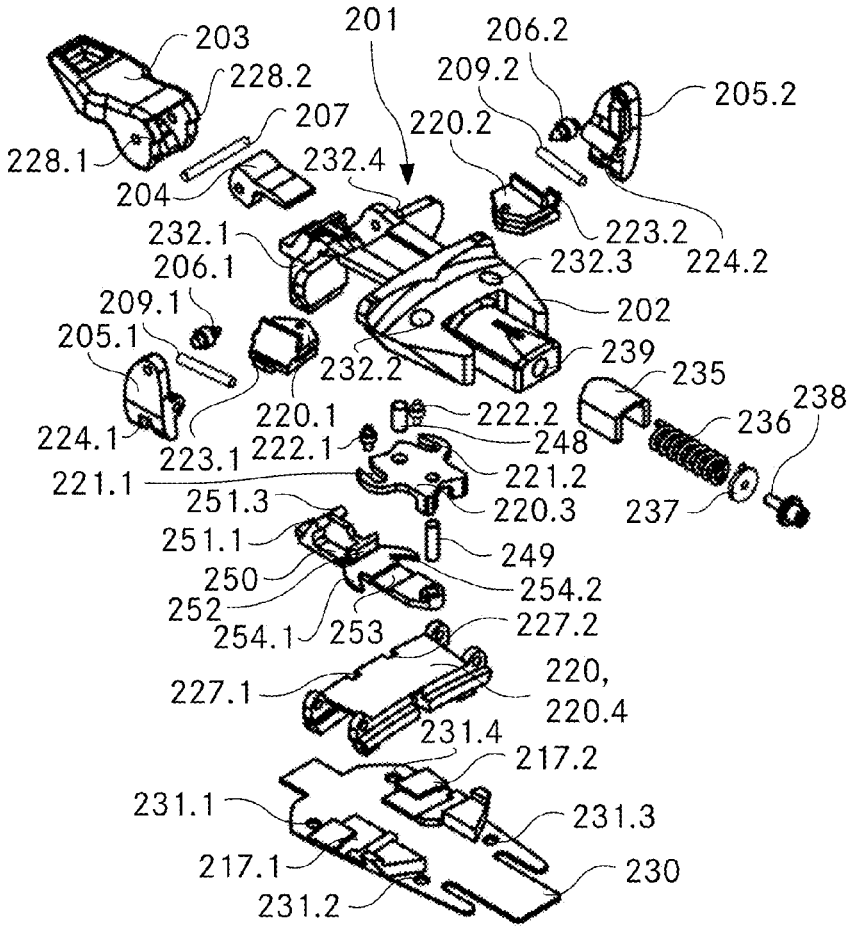
FIG. 15 shows an exploded drawing of the further automatic front unit, FIGS. 16*a, b* show two enlarged details from the exploded drawing shown in FIG. 15, FIGS. 17*a, b* show two different sectional views of the further automatic front unit in the release position, FIGS. 18*a, b* show two different sectional views of the further automatic front unit in the securing position, the positive control device being in the center of the positive control path, FIGS. 19*a, b* show two different sectional views of the further automatic front unit in the securing position, the positive control device being almost at one end of the positive control path, FIGS. 20*a, b* show two different sectional views of the automatic front unit in the safety release position, FIGS. 21*a, b* show two further sectional views of the further automatic front unit in the release position.

FIG. 15 shows an exploded drawing of the automatic front unit 201 shown in FIGS. 14*a*, 14*b*, 14*c* and 14*d*. By contrast with FIGS. 14*a*, 14*b*, 14*c* and 14*d*, however, the perspective of the representation is different. Thus, in FIG. 15 "rear" is bottom right, while "front" is top left.

It can be seen in FIG. 15 that the automatic front unit 201 comprises a substantially flat baseplate 230, which closes off in the downward direction the housing 202 that is otherwise open in the downward direction. This baseplate 230 may be produced from metal or else from another material, such as for example plastic. On both sides of a strip running in the longitudinal direction of the baseplate 230 there are on the baseplate 230 elevations 217.1, 217.2, which serve as guides for the positive control device 220 and for a guiding element 250. The baseplate 230 has in a substantially square arrangement four vertically aligned openings 231.1, 231.2, 231.3, 231.4. When the automatic front unit 201 has been assembled, these openings 231.1, 231.2, 231.3, 231.4 coincide with four vertically aligned openings 232.1, 232.2, 232.3, 232.4 in the housing 202. In the housing 202, one of these openings 232.1, 232.2, 232.3, 232.4 is respectively arranged in front of and behind the pivoting levers 205.1, 205.2. They serve the purpose of fastening the automatic front unit 201 on a ski by means of screws.

A number of elements are arranged in an interior space of the automatic front unit 201 that is enclosed by the housing 202 and the baseplate 230. Thus, a ram 235 produced from plastic is arranged in a rear region of the housing 202, in the center of the ski. This ram 235 is aligned in the longitudinal direction of the ski and guided in the longitudinal direction of the ski. In its rear region, the ram 235 has an opening, in which a spiral spring 236 aligned in the longitudinal direction of the ski is inserted. This spiral spring 236 butts with its rear end against a locking nut 237, which is screwed with a thread onto an adjusting screw 238 aligned in the longitudinal direction of the ski. In the mounted state of the automatic front unit 201, a head of the adjusting screw 238 is mounted in an opening 239 in a rearwardly aligned side wall of the housing 202. In this case, the adjusting screw 238 can be turned from the outside through the opening 239.

In front of the ram 235, the guiding element 250 produced from steel, aluminum or plastic is mounted in the housing 202, on the baseplate 230. This guiding element 250 has, in a rear region, a bearing bush for mounting a second vertical pin 249 and, in a front region, on each of both sides, an upwardly pointing nub 251.1, 251.2. Furthermore, the guiding element 250 has in a central region, when seen in the longitudinal direction of the ski, a plate which is aligned vertically and in the transverse direction of the ski, forms a front stop 252 and delimits in a forward direction a central region 253 of the guiding element 250. This central region 253 is in the form of a plate and is aligned horizontally. It has on each of both sides an arm 254.1, 254.2, which arms are directed laterally outward in the rearward direction from the front. On the central region 253, the positive control device 220 is mounted movably in the transverse direction of the ski. In this case, it is guided between the front stop 252 and the second vertical pin 249, and is correspondingly hindered from a movement in relation to the guiding element 250 in the longitudinal direction of the ski.

As can be seen here in the exploded drawing, the positive control device 220 comprises two side levers 220.1, 220.2, a pivoting element 220.3 and a carriage 220.4. The carriage 220.4 is mounted movably in the transverse direction of the ski between the guiding element 250 below and the housing 202 above, as well as at the front and rear. It comprises a substantially flat, horizontally aligned, upper surface and, at the front and rear, in each case a surface that is aligned substantially vertically in the transverse direction of the ski. Therefore, a vertical cross section in the longitudinal direction of the ski through the carriage 220.4 has an n-shaped shape that is open in the downward direction and flattened in the upward direction. In the mounted state of the automatic front unit 201, the pivoting element 220.3 is arranged such that it reaches from the rear under the upper surface of the carriage 220.4. In this case, the pivoting element 220.3 is mounted in its front region on the carriage 220.4 pivotably in a horizontal plane and movably in the longitudinal direction of the ski by a first vertical pin 248. In order to make the pivoting movement of the pivoting element 220.3 easier, the first vertical pin 248 has a roller running around the first vertical pin 248. When seen in the transverse direction of the ski, on each of both sides of the pivoting element 220.3 one of the two side levers 220.1, 220.2 is mounted on the carriage 220.4 such that it can be displaced under the upper surface of the carriage 220.4 in the transverse direction of the ski. In addition, the two side levers 220.1, 220.2 are each mounted on the pivoting element 220.3 by a second slotted link 221.1, 221.2 in the pivoting element 220.3 with a second slider 222.1, 222.2 mounted therein and arranged on the corresponding side lever 220.1, 220.2. These two second sliders 222.1, 222.2 each comprise a roller, which encloses the cylindrical core of the corresponding second slider 222.1, 222.2. These rollers serve the purpose that the second sliders 222.1, 222.2 can be moved with less frictional losses in the corresponding second slotted link 221.1, 221.2.

The second slotted links 221.1, 221.2 are arranged in such a way that they allow a movement of the pivoting element

220.3 in the longitudinal direction of the ski in relation to the rest of the positive control device 220, and consequently the side levers 220.1, 220.2, and also allow a rotating movement of the pivoting element 220.3 in relation to the rest of the positive control device 220, and consequently the side levers 220.1, 220.2. When there is a rotating movement of the pivoting element 220.3, the two side levers 220.1, 220.2 are kept at the same distance from each other, while they are pushed apart or drawn together by a relative movement in the longitudinal direction of the ski. The drawing together is in this case assisted by the two arms 254.1, 254.2 of the central region 253 of the guiding element 250, which may likewise interact with the second sliders 222.1, 222.2 when the guiding element 250 is displaced in the rearward direction.

At both lateral ends of the carriage 220.4, one of the two pivoting levers 205.1, 205.2 is respectively mounted in an upper region pivotably about a pivot 209.1, 209.2. These two pivots 209.1, 209.2 are arranged in a plane parallel to the ski, two straight lines, which are defined by the two pivots 209.1, 209.2, being aligned almost parallel to the ski and converging rearwardly at an angle of approximately 6 degrees to. In a lower region underneath the pivots 209.1, 209.3, the two pivoting levers 205.1, 205.2 are mounted on outer ends of the side levers 220.1, 220.2. For this purpose, the two pivoting levers 205.1, 205.2 have at each of their lower ends a first slider 224.1, 224.2, which respectively has a cylindrical cross section and is aligned parallel to the pivot 209.1, 209.3 of the corresponding lever 205.1, 205.2. In the securing position and in the release position, these two first sliders 224.1, 224.2 are each respectively mounted in a first slotted link 223.1, 223.2 of the corresponding side lever 220.1, 220.2.

On its front, upper side edge, the carriage 220.4 has second notches 227.1, 227.2. Two catches 228.1, 228.2 that are attached to the control lever 203 can engage in these two notches 227.1, 227.2. This allows the carriage 220.4 to be hindered from a movement in the transverse direction of the ski in the blocking position.

When the automatic front unit 201 is in the securing position, the carriage 220.4 can be moved along the positive control path in the transverse direction of the ski. The two side levers 220.1, 220.2 and the two pivoting levers 205.1, 205.2 are thereby also moved along with the carriage 220.4. At the same time, moreover, the pivoting element 220.3, which in its front region is mounted on the carriage 220.4 by the first pin 248 and its rear region is mounted on the guiding element 250 by the second pin 249, is pivoted along the positive control path. As a result, the two second sliders 222.1, 222.2 are moved in the second slotted links 221.1, 221.2, the two side levers 220.1, 220.2 being kept at the same distance from each other.

In the mounted state of the automatic front unit 201, the spiral spring 236 is pretensioned between the ram 235 and the locking nut 237. In the rearward direction, it is supported on an inner side of the housing 202 by way of the locking nut 237 and the adjusting screw 238. By turning the adjusting screw 238, whereby the locking nut 237 is moved in the forward or rearward direction, the pretensioning of the spiral spring 236 can thereby be set. The spiral spring 236 correspondingly exerts a force that can be set to press the ram 235 in the forward direction, where the ram 235 is supported against the pivoting element 220.3. For this purpose, the ram 235 has a front end with two laterally beveled, vertically aligned surfaces, which fit into a v-shaped indentation in the rear end of the pivoting element 220.3. When the carriage 220.4 is in a center of the positive control path, the pivoting element 220.3 is aligned in the longitudinal direction of the ski and the ram 235 presses into the v-shaped indentation in the rear end of the pivoting element 220.3. When the carriage 220.4 is moved laterally along the positive control path, the pivoting element 220.3 is pivoted laterally in the way described. As a result, the v-shaped indentation in the rear end of the pivoting element 220.3 is also pivoted along with it, a flank of the v-shaped indentation that lies in the direction of movement of the positive control device 220 being pressed against the ram 235. As a result, the ram 235 is pressed in the rearward direction and a driving-back force is exerted on the pivoting element 220.3, driving the pivoting element 220.3 back into an alignment parallel to the longitudinal direction of the ski and driving the carriage 220.4 back into a central position of the positive control path. Therefore, by setting the pretensioning of the spiral spring 236, the strength of the driving-back force can be set.

Figure 16A:
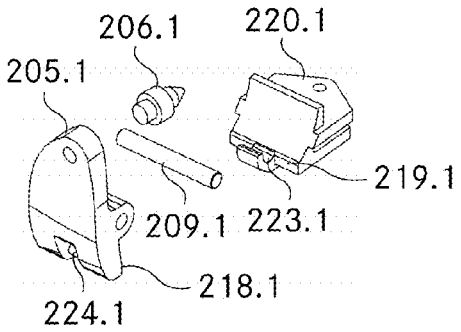
Figure 16B:
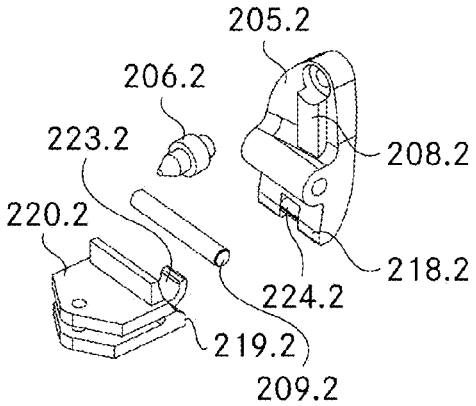

FIGS. 16*a* and 16*b* each show an enlarged detail from the exploded drawing of the automatic front unit 201 that is shown in FIG. 15. In them there can respectively be seen one of the two pivoting levers 205.1, 205.2, the holding spur 206.1, 206.2 that is arranged in the upper region of the corresponding pivoting lever 205.1, 205.2, the associated pivot 209.1, 209.2, and the associated side lever 220.1, 220.2. It can be seen as a result that, when seen in the longitudinal direction of the ski, the pivoting levers 205.1, 205.2 have a width which corresponds approximately to three times the length of the cylindrical first sliders 224.1, 224.2. It can also be seen that the cylindrical first sliders 224.1, 224.2 are arranged in a center of the pivoting levers 205.1, 205.2, when seen in the longitudinal direction of the ski. In front of and behind the respective cylindrical first slider 224.1, 224.2, the lower ends of the pivoting levers 205.1, 205.2 reach to approximately under the cylindrical first sliders 224.1, 224.2 and form on their side facing the center of the ski a stop 218.1, 218.2. These two stops 218.1, 218.2 may likewise be seen as part of the first sliders 224.1, 224.2. In the mounted state, they are respectively facing an opposing stop 219.1, 219.2 on the corresponding side lever 220.1, 220.2, both in the securing position and in the release position.

It can also be seen in the enlarged details of FIGS. 16*a* and 16*b* that, when seen in the longitudinal direction of the ski, the two side levers 220.1, 220.2 likewise have a width which corresponds approximately to three times the length of the cylindrical first sliders 234.1, 224.2. It can also be seen that the two side levers 220.1, 220.2 have on their side facing away from the center of the ski in the lower region an upwardly open hook, which is respectively part of the first slotted link 223.1, 223.2. These hooks have, when seen in the longitudinal direction of the ski, an extent which corresponds substantially to the length of the cylindrical first sliders 224.1, 224.2 and are respectively arranged in a center of the corresponding side lever 220.1, 220.2, when seen in the longitudinal direction of the ski. On each of both sides of the hooks, the two side levers 220.1, 220.2 have on their side facing away from the center of the ski a vertically aligned surface in the lower region, which surfaces form the stops 219.1, 219.2 of the first slotted links 223.1, 223.2. Above these lower regions, the two side levers 220.1, 220.2 each have on their side facing away from the center of the ski a surface with a concave, substantially quarter-cylindrical curvature. These curvatures respectively run from the outside at the bottom upwardly toward the center of the ski.

In the mounted state, the cylindrical first sliders 224.1, 224.2 are mounted in the hooks of the first slotted links 223.1, 223.2, both in the securing position and in the release position. At the same time, the stops 218.1, 218.2 of the pivoting levers 205.1, 205.2 are also arranged opposite the stops 219.1, 219.2 of the side levers 220.1, 220.2. Correspondingly, in the securing position and in the release position, a force acting on one of the holding spurs 206.1, 206.2 from the center of the ski outward has the effect of exerting a torque on the pivoting levers 205.1, 205.2 mounted at the pivots 209.1, 209.2, whereby the lower regions of the pivoting levers 205.1, 205.2 are pressed toward the center of the ski. The stops 218.1, 218.2 of the pivoting levers 205.1, 205.2 are thereby pressed against the stops 219.1, 219.2 of the side levers 220.1, 220.2 and the pivoting levers 205.1, 205.2 can be hindered from a pivoting movement by the side levers 220.1, 220.2.

In FIG. 16*b* it can also be seen that the pivoting levers 205.2 respectively have underneath the holding spur 206.2 a control jaw 208.2. In the embodiment shown here, the control jaws 208.2 are a substantially rectangular block, which is arranged on the side of the respective pivoting lever 205.2 that is facing the center of the ski, a longitudinal axis of the control jaws 208.2 being aligned such that it points from the holding spur 206.2 toward the pivot 209.2.

Figure 17A:
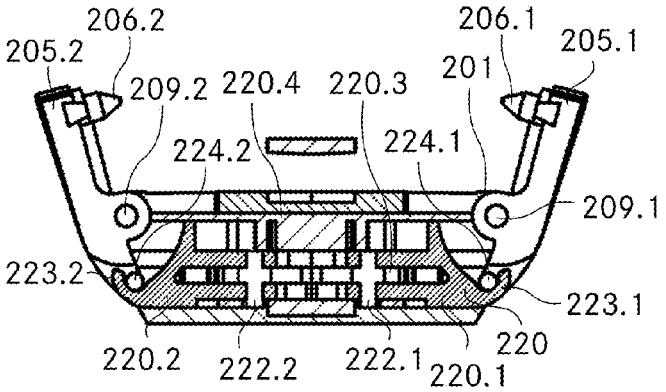
Figure 17B:
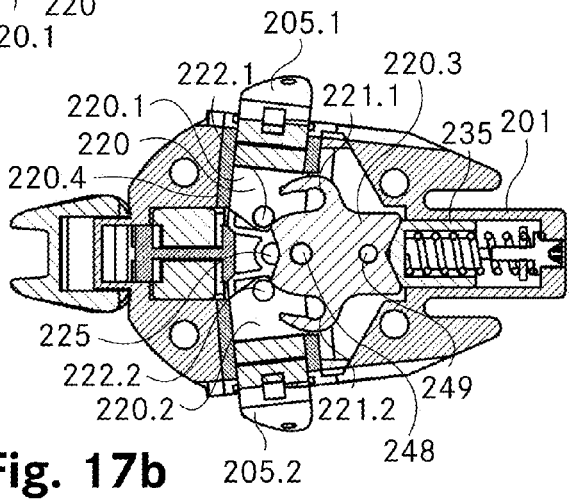

FIGS. 17*a* and 17*b* each show a cross section through the automatic front unit 201 in the release position. In FIG. 17*a*, the cross section extends in the vertical direction and in the transverse direction of the ski and a sectional view from the front is shown. In FIG. 17*b*, by contrast, the cross section extends in the horizontal direction and a sectional view from below is shown.

FIG. 17*a* shows that, when the automatic front unit 201 is in the release position, the two pivoting levers 205.1, 205.2 have been pivoted apart, so that the two holding spurs 206.1, 206.2 are at the first distance from each other. Since the cross section extends through a center of the side levers 220.1, 220.2 and the pivoting levers 205.1, 205.2, when seen in the longitudinal direction of the ski, it can be seen how the cylindrical first sliders 224.1, 224.2 are mounted in the hooks of the first slotted links 223.1, 223.2. Since the two side levers 220.1, 220.2 have been moved together, the lower regions of the pivoting levers 205.1, 205.2 have been moved together and the holding spurs 206.1, 206.2 situated above the pivots 209.1, 209.2 have been moved apart.

In FIG. 17*b* it can likewise be seen that the two side levers 220.1, 220.2 have been moved toward each other. It can also be seen that the pivoting element 220.3 has been moved in the rearward direction (which corresponds to the right in the figure) and pressed against the ram 235. A groove 225 in the underside of the carriage 220.4 and aligned in the longitudinal direction of the ski can be seen here in front of the front end of the pivoting element 220.3. In this groove 225, an upper end of the first vertical pin 248 is mounted rotatably about a vertical pin and displaceably in the longitudinal direction of the ski. This makes it possible that the pivoting element 220.3 is displaceable with respect to the rest of the positive control device 220 in the longitudinal direction of the ski, the first vertical pin 248 being moved along with the carriage 220.4 when the carriage 220.4 is moved in the transverse direction of the ski.

FIG. 17*b* also shows that, in the release position, the pivoting element 220.3 has been moved in the rearward direction to such an extent that a front end of the pivoting element 220.3 has been moved to almost behind the two second sliders 222.1, 222.2, and that therefore the two second sliders 222.1, 222.2 have been released by the second slotted links 221.1, 221.2 of the pivoting element 220.3 for a movement laterally away from the center of the ski. Correspondingly, in this position the side levers 220.1, 220.2 have not been moved together as far toward the center of the ski by the second slotted links 221.1, 221.2. In the embodiment shown here, this task is assumed by the two arms 254.1, 254.2, shown in FIG. 15, of the guiding element 250, which has likewise been moved in the rearward direction. On account of the sectional representation in FIG. 17*b*, the guiding element 250 cannot be seen however. In principle, however, there is the possibility that, in another embodiment, the two second slotted links 221.1, 221.2 of the pivoting element 220.3 reach further forward and keep the second sliders 222.1, 222.2, and consequently the two side levers 220.1, 220.2, drawn together in the release position too. In such an embodiment, however, the geometry of the pivoting element 220.3 must be adapted, in order that the pivoting element 220.3 can also continue to perform the other functions that are described below.

Figure 18A:
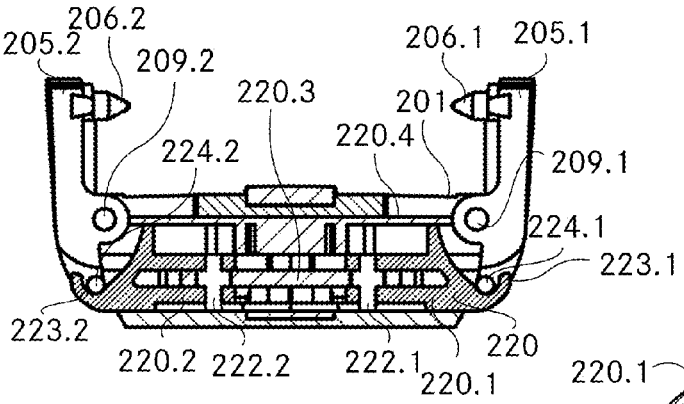
Figure 18B:
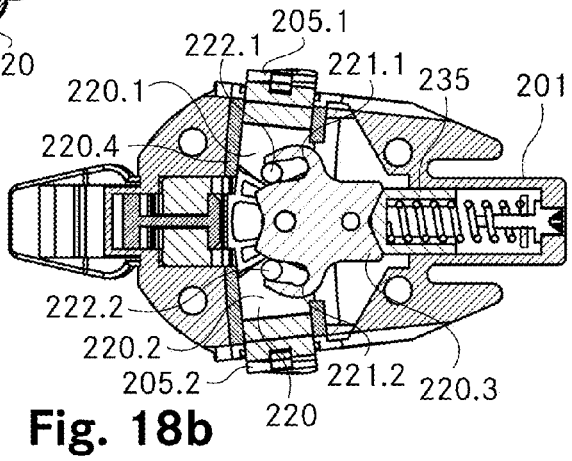

FIGS. 18*a* and 18*b* each show a cross section through the automatic front unit 201 in the securing position, the positive control device 220 being in the center of the positive control path. In FIG. 18*a*, the cross section extends in the vertical direction and in the transverse direction of the ski and a sectional view from the front is shown. In FIG. 18*b*, by contrast, the cross section extends in the horizontal direction and a sectional view from below is shown.

FIG. 18*a* shows that, when the automatic front unit 201 is in the securing position, the two pivoting levers 205.1, 205.2 have been pivoted together, so that the two holding spurs 206.1, 206.2 are at the second distance from each other. Since the cross section extends through a center of the side levers 220.1, 220.2 and the pivoting levers 205.1, 205.2, when seen in the longitudinal direction of the ski, it can be seen how the cylindrical first sliders 224.1, 224.2 are mounted in the hooks of the first slotted links 223.1, 223.2 in the securing position too. It can also be seen that here, by contrast with the release position, two side levers 220.1, 220.2, and consequently the lower regions of the pivoting levers 205.1, 205.2, have been moved apart, while the holding spurs 206.1, 206.2 situated above the pivots 209.1, 209.2 have been moved together.

It can also be seen in FIG. 18*b* that the two side levers 220.1, 220.2 have been moved away from each other. It can also be seen in FIG. 18*b* that the pivoting element 220.3 has been moved further forward (which corresponds to the left in the figure) in comparison with the release position and that the ram 235 has likewise been moved further forward. In this position of the pivoting element 220.3, the two second sliders 222.1, 222.2 are guided in the second slotted links 221.1, 221.2 of the pivoting element 220.3 and hindered from a movement in relation to each other in the transverse direction of the ski. Since the two second slotted links 221.1, 221.2 diverge laterally from the center of the ski from front to rear, in this position the second sliders 221.1, 221.2, and consequently the side levers 220.1, 220.2, have been moved apart in comparison with the release position.

Figure 19A:
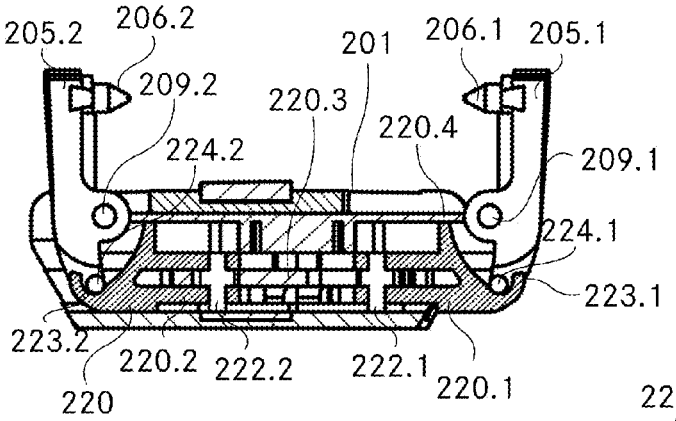
Figure 19B:
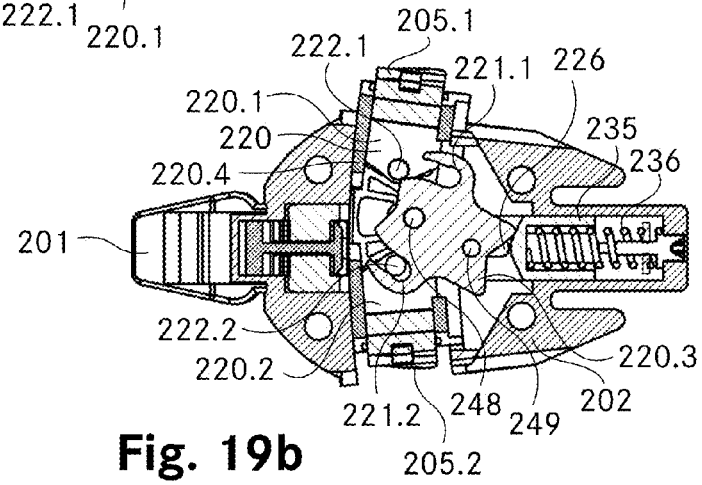

In the same way as already shown by FIGS. 18*a* and 18*b*, FIGS. 19*a* and 19*b* each illustrate a cross section through the automatic front unit 201 in the securing position. In FIG. 19*a*, the cross section extends in the vertical direction and in the transverse direction of the ski and a sectional view from the front is shown. In FIG. 19*b*, by contrast, the cross section extends in the horizontal direction and a sectional view from below is shown. By contrast with FIGS. 18*a* and 18*b*, in the representations shown here the positive control device 220 is almost at one end of the positive control path.

FIG. 19*a* shows that, when the automatic front unit 201 is in the securing position, with the positive control device 220 almost at one end of the positive control path, the two pivoting levers 205.1, 205.2 have likewise been pivoted together and that the two holding spurs 206.1, 206.2 are likewise at the second distance from each other. It can similarly be seen that the cylindrical first sliders 224.1, 224.2 are also still mounted in the hooks of the first slotted links 223.1, 223.2 and that the two sides levers 220.1, 220.2 have still likewise been moved apart, whereby the lower regions of the pivoting levers 205.1, 205.2 have been moved apart, while the holding spurs 206.1, 206.2 situated above the pivots 209.1, 209.2 have been moved together.

In FIG. 19*b* it can be seen that the pivoting element 220.3 has been pivoted in the direction of movement of the carriage 220.4 when the carriage 220.4 has been moved away from the center of the positive control path in the transverse direction of the ski. In order to make this pivoting movement of the pivoting element 220.3 possible, the pivoting element 220.3 is mounted in its front region at the first vertical pin 248 in the groove 225 (see FIG. 17*a*) on the carriage 220.4 and in its rear region at the second vertical pin 249 at the top in a groove 226, running in the longitudinal direction of the ski, in the housing 202 and at the bottom on the guiding element 250 that cannot be seen here. Since the pivoting element 220.3 is mounted pivotably and movably in the longitudinal direction of the ski both in the groove 225 in the carriage 220.4 and in the groove 226 in the housing 202, the pivoting element 220.3 is displaceable in the longitudinal direction of the ski. In this case, the position of the pivoting element 220.3 in the longitudinal direction of the ski caused by the mounting of the lower end of the second vertical pin 249 in the guiding element 250 is controlled by a corresponding positioning of the guiding element 250 in the longitudinal direction of the ski (also see in this respect FIGS. 15 and 21*a*, 22 and 23*a*).

In order to keep the distance between the two second sliders 222.1, 222.2, and consequently the holding spurs 206.1, 206.2, constant even during a movement of the positive control device 220 along the positive control path and an accompanying pivoting movement of the pivoting element 220.3, the two second slotted links 221.1, 221.2 converge from the rear to the front in a curved shape. In this case, arranged on both sides of the first vertical pin 248, they reach from behind the first vertical pin 248 to in front of the first vertical pin 248. When, as shown in FIG. 19*b*, the pivoting element 220.3 has been pivoted laterally with respect to an alignment parallel to the longitudinal direction of the ski, the two second slotted links 221.1, 221.2 have correspondingly also been pivoted along with it. The second slotted link 221.2, arranged on the side opposite from the direction of movement of the carriage 220.4, has thereby been moved in the forward direction, whereby the corresponding second slider 222.2 is further to the rear in the second slotted link 221.2. At the same time, in this position of the pivoting element 220.3, the second slotted link 221.1, lying in the direction of movement of the carriage 220.4, has been moved in the rearward direction to such an extent that the corresponding second slider 222.2 has been moved out of the second slotted link 221.1 and is at the front end of the pivoting element 220.3. This front end of the pivoting element 220.3 has a rearwardly reaching, v-shaped indentation, the flanks of this v shape forming, when seen in the horizontal plane, a front tip on each of both sides at the front end of the pivoting element 220.3. When, as shown here in FIG. 19*b*, the pivoting element 220.3 has been pivoted almost up to one end of the positive control path, the second slider 222.1, lying in the direction of movement of the carriage 220.4, is just at the front tip, which lies in the direction of movement of the carriage 220.4. In this case, the second slider 222.1 has been released by the corresponding second slotted link 221.1 and could be moved still further in the direction of movement of the carriage 220.4. However, such a further movement would have the result that the corresponding second side lever 220.1 would also be moved in this direction, whereby in turn the corresponding pivoting lever 205.1 would be pivoted. This would have the result that the holding spur 206.1 on this pivoting lever 205.1 would be moved toward the center of the ski, whereby the distance between the two holding spurs 206.1, 206.2 would be reduced. When, however, a ski boot (not shown) is held in the automatic front unit 201, the ski boot is held between the holding spurs 206.1, 206.2 and the two holding spurs 206.1, 206.2 cannot be moved any closer to each other. Correspondingly, the second slider 222.1 cannot be moved any further in the direction of movement of the carriage 220.4 in spite of being released by the corresponding second slotted link 221.1 during the use of the automatic front unit 201.

Figure 20A:
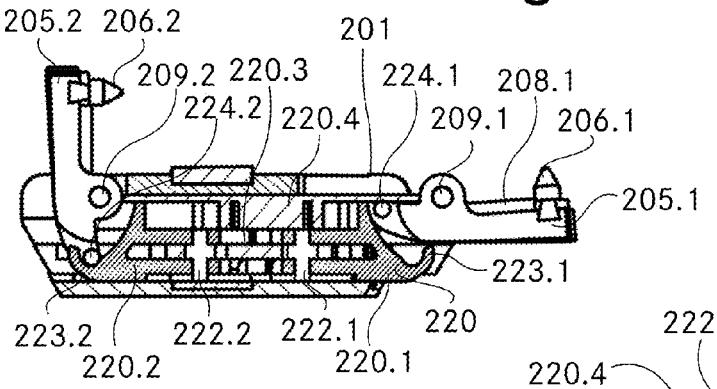
Figure 20B:
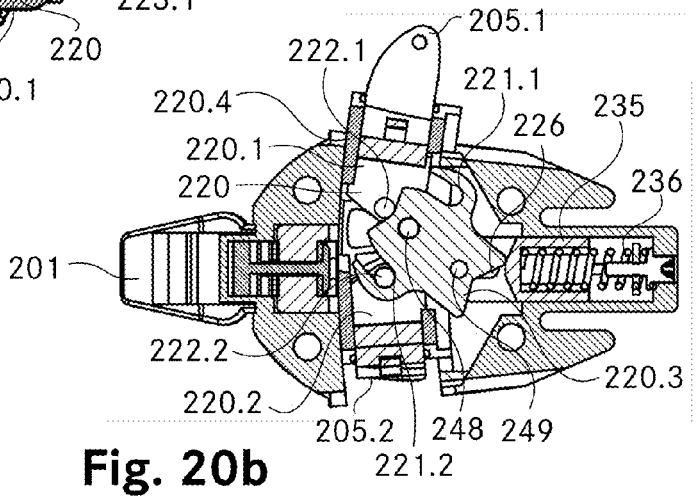

FIGS. 20*a* and 20*b* each show a cross section through the automatic front unit 201 in the safety release position. In FIG. 20*a*, the cross section extends in the vertical direction and in the transverse direction of the ski and a sectional view from the front is shown. In FIG. 20*b*, by contrast, the cross section extends in the horizontal direction and a sectional view from below is shown.

FIG. 20*a* shows that, when the automatic front unit 201 is in the safety release position, the positive control device 220 has been moved up to one end of the positive control path. In this case, the pivoting lever 205.2, which is arranged on the side opposite from this end of the positive control path, is in the same position as in the securing position (see FIGS. 18*a* and 19*a*). Thus, the cylindrical first slider 224.2 of this pivoting lever 205.2 is mounted in the hook of the corresponding first slotted link 223.2. By contrast with the securing position, however, the other of the two pivoting levers 205.1 has been pivoted downward to the side, whereby the holding spurs 206.1 of this pivoting lever 205.1 have been moved away and a ski boot has been released by the automatic front unit 201. It can be seen in this respect in FIG. 20*a* that, by this pivoting away of the pivoting lever 205.1, the first slider 224.1 of this pivoting lever 205.1 is no longer mounted in the hook of the corresponding first slotted link 223.1, but has been moved in the upward direction, toward the center of the ski, along the concave, substantially quarter-cylindrically curved surface of the corresponding side lever 220.1.

In FIG. 20*b* it can be seen that, in the safety release position too, the pivoting element 220.3 has been pivoted into the direction of movement of the carriage 220.4. As a difference from the representation in FIG. 19*b*, however, here the pivoting element 220.3 has been pivoted slightly further, whereby the two second slotted links 221.1, 221.2 have also been moved slightly further. Thus, the second slotted link 221.2, arranged on the side opposite from the direction of movement of the carriage 220.4, has now been moved in the forward direction to such an extent that the corresponding second slider 222.2 butts against the rear end of the second slotted link 221.2. This butting blocks further movement of the pivoting element 220.3, and consequently also of the carriage 220.4. At the same time, in this position of the pivoting element 220.3, the second slotted link 221.1, lying in the direction of movement of the carriage 220.4, has been moved in the rearward direction to such an extent that the corresponding second slider 222.1 has been moved out beyond the tip at the front end of the pivoting element 220.3. This makes it possible that, as shown here, the second slider 222.1 can be moved into the rearwardly reaching, v-shaped indentation in the front end of the pivoting element 220.3. When there is such a movement, the entire corresponding side lever 220.1 with the first slotted link 223.1 arranged on it is moved toward the center of the ski. This has the effect that, when this movement occurs, the first slider 224.1 of the corresponding pivoting lever 205.1 is also moved toward the center of the ski, until the cylindrical first slider 224.1 is released by the hook of the first slotted link 223.1 and the lower end of the pivoting lever 205.1 is released by the stop 219.1 (only shown in FIG. 16*a*) and the pivoting lever 205.1 can be pivoted away completely to the side.

In the case of a lateral safety release, this movement of the side lever 220.1 and the pivoting lever 205.1 is driven by a sideward-directed force, which acts on the ski boot held in the automatic front unit 201. This means that, when there is a lateral safety release, first the ski boot held in the automatic front unit 201 is pressed in the transverse direction of the ski, whereby the carriage 220.4 is moved up to one end of the positive control path. During this movement, the ski boot remains held in the carriage 220.4, energy being absorbed in this way by the movement of the carriage 220.4 and the positive control device 220 counter to the driving-back force of the spiral spring 236. If the energy of an impact is greater than the energy that can be absorbed by the automatic front unit 201, the ski boot that has also arrived at the end of the dynamic path also brings about a force on the pivoting lever 205.1 lying in the direction of movement. Because the side lever 220.1 belonging to this pivoting lever 205.1 is released by the pivoting element 220.3 toward the center of the ski at the end of the positive control path, the pivoting lever 205.1 can be pressed further away to the side by the ski boot. When the pivoting lever 205.1 is pressed away in this manner, at the beginning the ski boot is still held by the holding spur 206.1 in the bearing bush in the ski boot. However, as soon as the pivoting lever 205.1 has reached a certain pivoting angle, the control jaw 208.1 of the pivoting lever 205.1 begins to interact with the sole of the ski boot, whereby the holding spur 206.1 is freed from the bearing bush of the ski boot and the ski boot is correspondingly released.

During this pivoting movement of the pivoting lever 205.1, the second slider 222.1 of the side lever 220.1 is also pressed into the v-shaped indentation in the front end of the pivoting element 220.3. This mechanism has the effect that, by its positioning in the v-shaped indentation at the front end of the pivoting element 220.3, the second slider 222.1 prevents snapping back of the pivoting element 220.3 into an alignment parallel to the longitudinal direction of the ski. Correspondingly, the positive control device 220, consisting of the carriage 220.4, the two side levers 220.1, 220.2 and the pivoting element 220.3, is blocked in the safety release position. In spite of this blocking of the positive control device 220, however, the laterally pivoted-away pivoting lever 205.1 is freely pivotable between a laterally pivoted-away position and an almost upright position.

In order to bring the automatic front unit 201 from the safety release position back into the securing position, it is sufficient to set the laterally pivoted-away pivoting lever 205.1 upright. As a result, the cylindrical, first slider 224.1 is pivoted downward under the pivot 209.1, where it meets the hook of the corresponding first slotted link 223.1 and, by interacting with this hook, draws the side lever 220.1 sidewardly away from the center of the ski. Consequently, the second slider 222.1 of this side lever 220.1 is also drawn out from the v-shaped indentation in the front end of the pivoting element 220.3, whereby the pivoting element 220.3 is released. As soon as the pivoting element 220.3 has been released in this way, the pivoting element 220.3 and the entire positive control device 220 can be moved back toward the center of the positive control path by the driving-back force, which is brought about by the spiral spring 236.

Figure 21A:
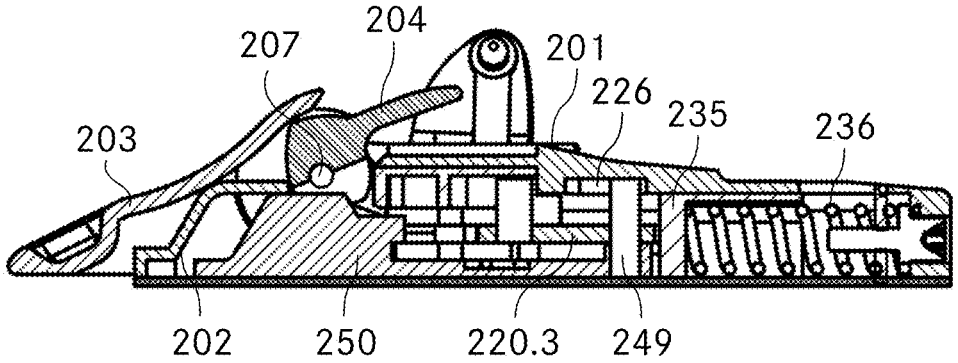
Figure 21B:
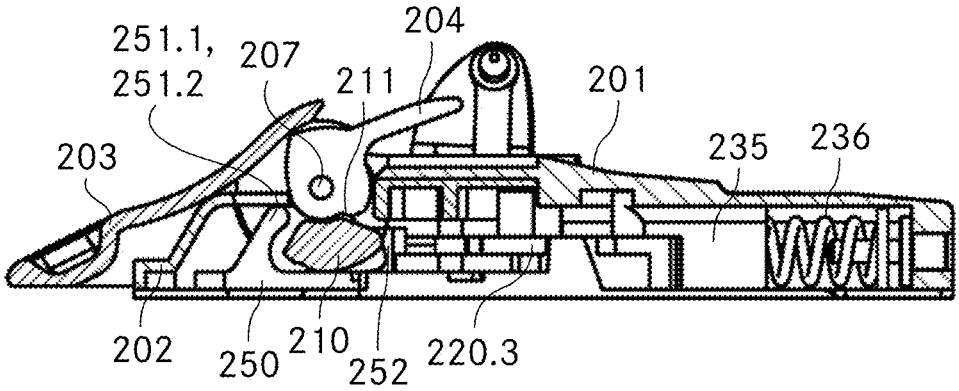

FIGS. 21*a* and 21*b* each show a vertical longitudinal cross section through the automatic front unit 201 in the release position. In FIG. 21*a*, the cross section extends along the center of the ski, while in FIG. 21*b* it is offset slightly from the center of the ski to the side. In both figures it can be seen that the control lever 203 in the release position is aligned with its free end forward in the longitudinal direction of the ski and that the tread spur 204 is aligned with its free end obliquely upward in the rearward direction, protruding from the housing 202. It can also be seen in both figures that, in the release position, the guiding element 250 has been displaced in the rearward direction with respect to the housing 202. In the representation in FIG. 21*a* it can also be seen that the second vertical pin 249, which is mounted with its lower end on the guiding element 250, has consequently also been moved in the rearward direction in the groove 226 in the housing 202.

In FIG. 21*b*, the interaction between the control lever 203, the tread spur 204 and the guiding element 250 is illustrated. The control lever 203 and the tread spur 204 are both mounted on the housing 202 pivotably about the transverse axle 207 of the ski that is aligned horizontally in the transverse direction of the ski. In this case, the control lever 207 has on each of both sides underneath the transverse axle 207 of the ski a rounded block 210. When seen in the longitudinal direction of the ski, these blocks 210 are arranged between the nubs 251.1, 251.2 and the stop 252 of the guiding element 250. In the release position, in which the control lever 203 has been pivoted with its free end downward into an alignment substantially parallel with the ski, these blocks 210 have been correspondingly moved in the rearward direction under the transverse axle 207 of the ski. As a result, they press against the stop 252 and keep the guiding element 250 moved in the rearward direction. Correspondingly, by way of the second vertical pin 249, at the same time the pivoting element 220.3 has also been moved in the rearward direction against the ram 225 and counter to the driving-back force brought about by the spiral spring 236, and the two pivoting levers have been moved apart in the way described above. In order that the guiding element 250 is not moved in the forward direction against the two blocks 210 by the driving-back force, the stop 252 of the guiding element 250 has on its front side a convex bulge. This bulge is dimensioned and positioned in such a way that, in the release position, the two blocks 210 bear just above the bulge, whereby a relative movement of the blocks 210 in relation to the bulge is prevented, and correspondingly a forward movement of the guiding element 250 is blocked.

When, by actuation of the control lever 203, the automatic front unit 201 is brought into the release position and the two blocks 210 are moved in the rearward direction, the blocks 210 not only press the guiding element 250 in the rearward direction. They also additionally press in their rear, upper region against a stop 211 on the tread spur 204 that is arranged underneath the transverse axle 207 of the ski, whereby the free end of the tread spur 204 is pivoted in the upward direction. If it is then intended for a ski boot to be clamped in the automatic front unit 201, it is sufficient to lower the ski boot, positioned correctly in the longitudinal direction of the ski, onto the automatic front unit 201. As soon as the sole of the ski boot presses the free end of the tread spur 204 in the downward direction, the blocks 210 are pressed in the rearward direction by way of the stop 211. The pressure on the blocks 210 is in this case sufficient for them to be moved over the bulge on the front side of the stop 252 of the guiding element 250, whereby the guiding element 250 is released in the forward direction and can be moved in the forward direction by the spiral spring 236. By this movement of the guiding element 250, the blocks 210 are also moved further in the forward direction by way of the stop 252, and the control lever 203 is pivoted into a position in which its free end points slightly obliquely upward in the forward direction. Moreover, by the movement of the guiding element 250, the pivoting element 220.3 is also moved in the forward direction, whereby the two pivoting levers are pivoted together. Correspondingly, as a result the automatic front unit 201 is transferred into the securing position, in which the ski boot is held in the holding spurs.

Figure 22:
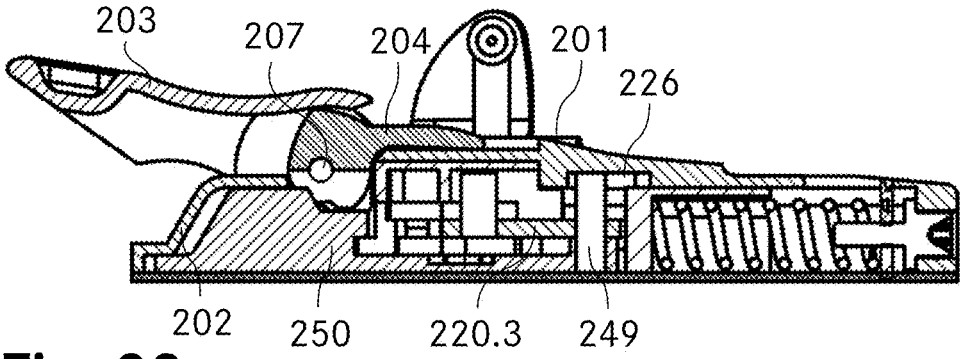
FIG. 22 shows a further sectional view of the further automatic front unit in the securing position, FIGS. 23*a, b* show two sectional views of the further automatic front unit in the blocking position, FIGS. 24*a, b, c* show three sectional views of a cross-sectional representation of the further automatic front unit in the release position, the securing position and the blocking position.

FIG. 22 shows a vertical longitudinal cross section along the center of the ski, through the automatic front unit 201 in the securing position. It can be seen in this case that the control lever 203 is pointing obliquely upward in the forward direction and that the tread spur 204 is pointing with its free end horizontally in the rearward direction and is resting on the housing 202. It can also be seen that the guiding element 250 has been moved in the forward direction in the housing 202 and that, as a result, the second vertical pin 249, and consequently the pivoting element 220.3, have also been moved in the forward direction.

Figure 23A:
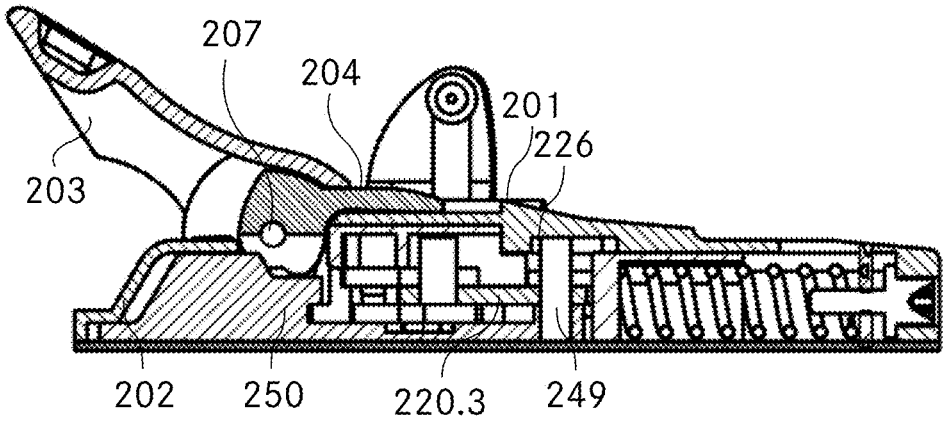
Figure 23B:
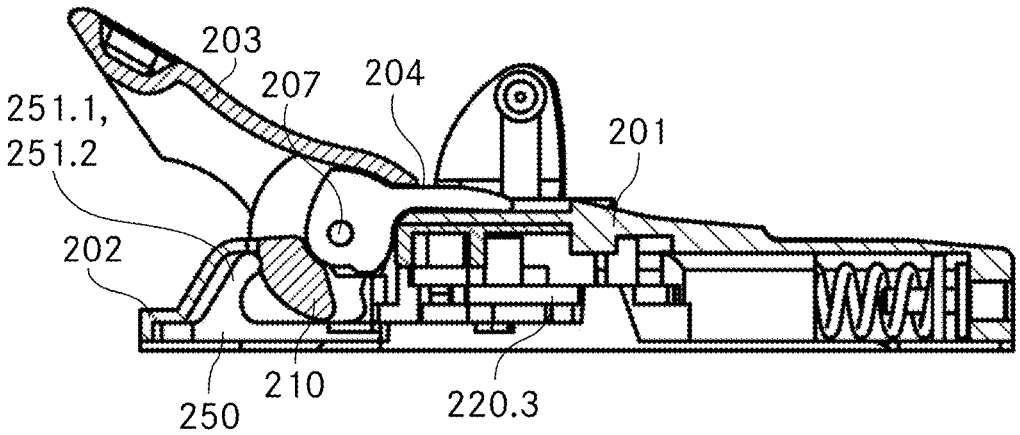

As already shown by FIGS. 21*a* and 21*b*, FIGS. 23*a* and 23*b* each show a vertical longitudinal cross section through the automatic front unit 201. In FIG. 23*a*, the cross section in turn extends along the center of the ski, while in FIG. 23*b* it is offset slightly from the center of the ski to the side. By contrast with FIGS. 21*a* and 21*b*, here the automatic front unit 201 is in the blocking position. This can be seen from the fact that the free end of the control lever 203 has been pulled further in the upward direction in comparison with the release position (FIGS. 21*a* and 21*b*) and the securing position (see FIG. 22). A transfer of the control lever 203 into this position has the effect that the two blocks 210 press with their front ends against the nubs 251.1, 251.2 of the guiding element 250. As a result, the guiding element 250 is drawn forward slightly further in the housing 202, until indentations in the front lower end of the blocks 210 have been drawn over the nubs 251.1, 251.2 and latch onto them. This latching has the effect of preventing an unintentional return of the automatic front unit 201 into the securing position. The further forward movement of the guiding element 250 thereby performed has the result that the second vertical pin 249 and the pivoting element 220.3 are also drawn forward slightly further.

Figure 24A:
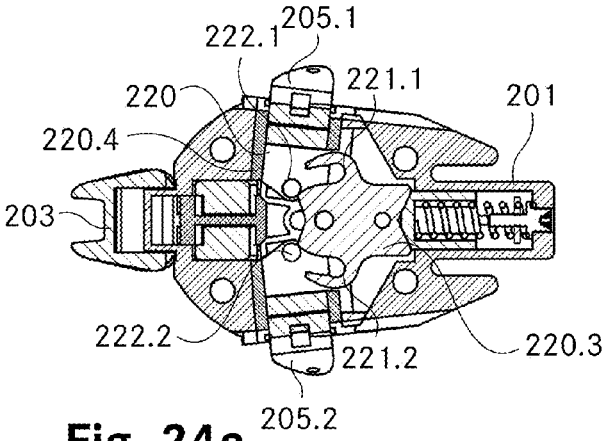
Figure 24B:
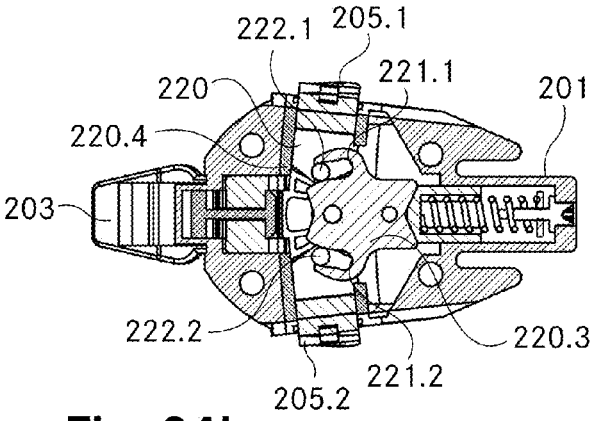
Figure 24C:
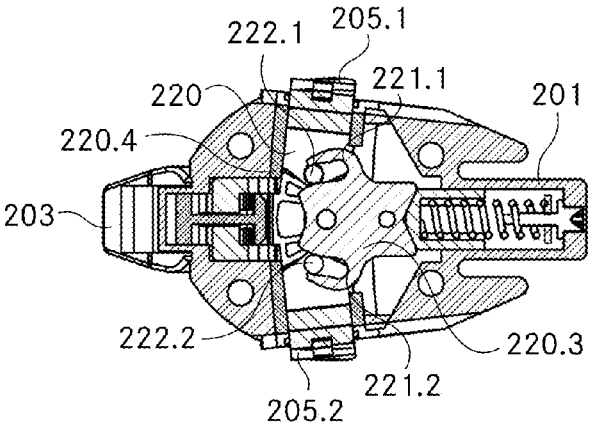

FIGS. 24*a*, 24*b* and 24*c* each show a horizontal cross section through the automatic front unit 201. In FIG. 24*a*, the automatic front unit 201 is shown in the release position, while in FIG. 24*b* it is represented in the securing position with the positive control device 220 in the center of the positive control path and in FIG. 24*c* it is represented in the blocking position. Consequently, FIG. 24*a* shows the same representation as FIG. 17*b*, while FIG. 24*b* shows the same representation as FIG. 18*b*.

By contrast with the figures previously shown, the sequence of FIGS. 24*a*, 24*b* and 24*c* illustrates how the pivoting element 220.3 is positioned in the longitudinal direction of the ski in the release position, the securing position and the blocking position. Thus it can be seen in FIG. 24*a* that the pivoting element 220.3 in the release position has been moved to almost behind the two second sliders 222.1, 222.2. By contrast, the pivoting element 220.3 in the securing position and in the blocking position is further forward, so that the two second sliders 222.1, 222.2 are guided on each of both sides in the second slotted links 221.1, 221.2. By contrast with the securing position, the pivoting element 220.3 in the blocking position has been drawn forward even slightly further. As a result, the two second sliders 222.1, 222.2 have been placed slightly further to the rear in the two first slotted links 221.1, 221.2, and correspondingly moved slightly further apart. This has the effect that the two side levers 220.1, 220.2 have also been moved slightly further apart and the two pivoting levers 205.1, 205.2 have correspondingly been pivoted together slightly with their upper ends. This means that, when there is a transfer of the automatic front unit 201 from the securing position into the blocking position, the two holding spurs are moved slightly closer together. If in this case a ski boot is held in the automatic front unit 201, as a result the holding spurs are pressed further into the two lateral bearing bushes in the toe region of the ski boot during the transfer into the blocking position, whereby the ski boot is held even better.

At the same time, in the blocking position, the carriage 220 is also blocked in the center of the positive control path. As shown in FIG. 15, on its front, upper side edge, the carriage 220.4 has for this purpose two notches 227.1, 227.2. Two catches 228.1, 228.2 that are attached to the control lever 203 can engage in these two notches 227.1, 227.2 when the control lever 203 is brought into the blocking position. This blocking has the advantage that an unintentional lateral release is prevented when the ski boot is held only in the automatic front unit 201 and has been released by the automatic heel unit, for example when climbing.

It can also be seen in the cross-sectional representations of FIGS. 24*a*, 24*b* and 24*c* that the control lever 203 is positioned differently in the release position, the securing position and the blocking position. Both in the blocking position and in the securing position, the free end of the control lever 203 has been pulled up in comparison with the release position. Therefore, as already shown in FIG. 9 for the automatic front unit 1, the automatic front unit 201 also makes a release in the forward direction possible, by the ski boot in the automatic front unit 201 being pivoted in the forward direction until a tip of the ski boot presses the control lever 203 downward into the release position. This frontal release may take place both when the automatic front unit 201 is in the securing position and when it is in the blocking position.

In particular in the cross-sectional representations such as for example of FIGS. 24*a*, 24*b* and 24*c*, it can be seen that the carriage 220.4 is not of a straight shape in the transverse direction of the ski but is slightly curved to the rear on both sides. This curvature corresponds to a segment of a circle with a radius of approximately 300 mm. Moreover, as already mentioned, the two pivots 209.1, 209.2 are not aligned in the longitudinal direction of the ski but so as to converge rearwardly at an angle of 6 degrees. As already shown in FIG. 10 for the automatic front unit 1, this has to do with the automatic front unit 201 being able to be used together with an automatic heel unit (not shown) in a ski-touring binding system. Thus, the automatic front unit 201 likewise makes a lateral safety release possible in the securing position. If, for example, the ski boot is mounted on the automatic heel unit by holding spurs pointing from the rear to the front, when there is such a lateral safety release the ski boot can carry out a rotating movement. In this case, it is first detached laterally from the automatic front unit 201, while still being held by the holding spurs of the automatic heel unit. As soon as the ski boot has come out from the automatic front unit 201, it can also be released by the automatic heel unit, by being moved away or turned away from the holding spurs of the automatic heel unit. There is consequently no need for the automatic heel unit to provide a possibility for a lateral safety release. It is sufficient if the automatic heel unit makes a safety release in the forward direction possible.

For these reasons, the automatic front unit 201 is optimized for a lateral safety release in the case of a ski-touring binding system, in which the automatic heel unit does not make a lateral safety release possible. Thus, when there is a lateral safety release the ski boot is turned about a vertical axis, until it has come out from the automatic front unit 201. On account of the alignment of the pivots 209.1, 209.2, the pivoting movement of the pivoting lever 205.1, 205.2 lying in the direction of movement proceeds perpendicularly to the direction of movement of the ski boot. Correspondingly, the alignment of the pivots 209.1, 209.2 is optimized for a rotating movement of the ski boot when there is a lateral safety release.

This optimization also has the consequence that the carriage 220.4 is curved and the two side levers 220.1, 220.2 of the positive control device 220 are not aligned along a straight line running at right angles to the longitudinal axis of the ski but are each mounted displaceably in the carriage 220.4 such that they are aligned at right angles to the corresponding pivot 209.1, 209.2.

Figure 25:
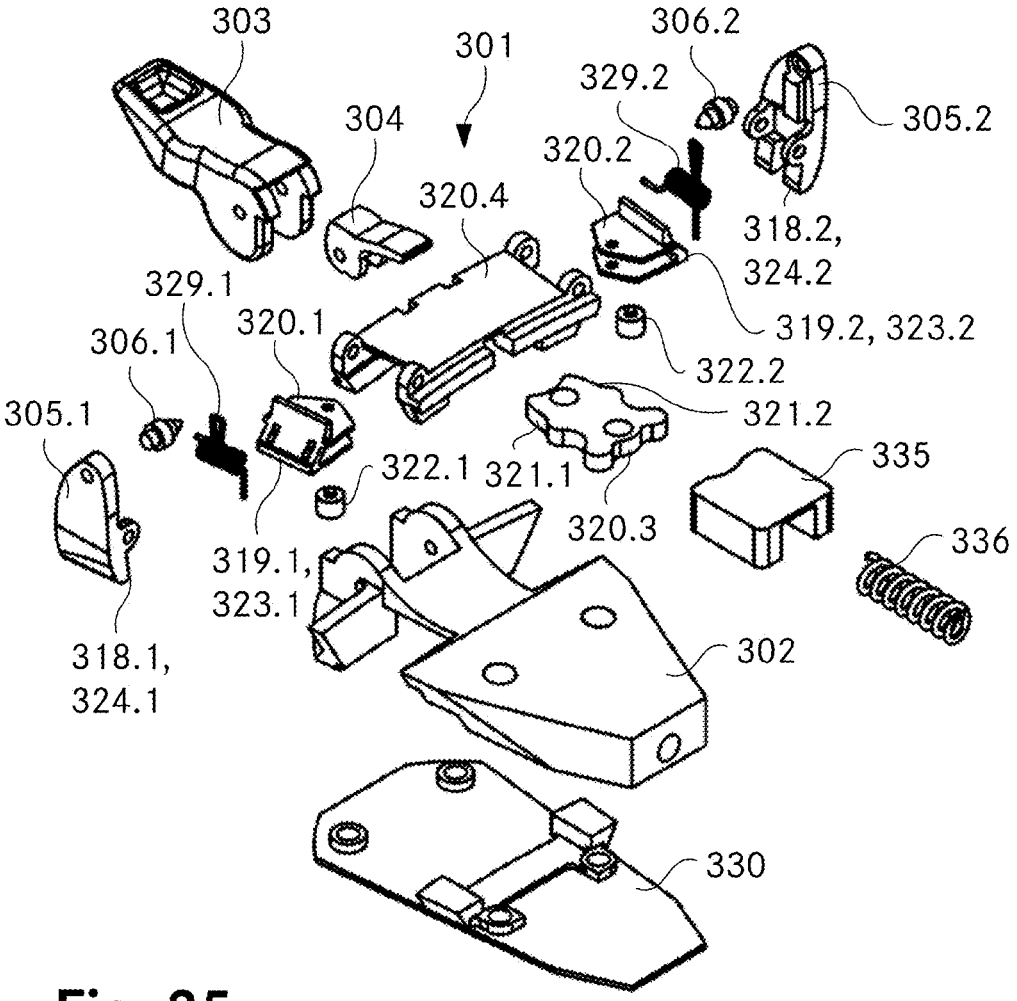
FIG. 25 shows an exploded drawing of a further automatic front unit according to the invention.

FIG. 25 shows an exploded drawing of a further automatic front unit 301 according to the invention from the perspective of an oblique view, in which "rear" in the figure lies at the bottom right, while "front" lies at the top left. In order to improve the overall clarity of the representation, not all of the elements of the automatic front unit 301 are shown, but only those that are most important for understanding.

The automatic front unit 301 shown here is designed very similarly to the automatic front unit 201, which is shown in FIGS. 14*a* to 24*c*. Correspondingly, the operating mode of the two automatic front units 201, 301 is also very similar. Structural differences and differences in the operating mode of the two automatic front units 201, 301 are described below. Elements and positions of the automatic front unit 301 shown here that are not described in more detail correspond to the elements and positions of the automatic front unit 201 described above. Thus, as already in the case of the automatic front unit 201 described above, the automatic front unit 301 comprises, inter alia, a substantially flat baseplate 330, a housing 302, a control lever 303, a ram 335 and a spiral spring 336. Furthermore, alongside the two pivoting levers 305.1, 305.2, the automatic front unit 301 likewise comprises a positive control device 320, which for its part comprises two side levers 320.1, 320.2, a pivoting element 320.3 and a carriage 320.4.

By contrast with the automatic front unit 201 that is shown in FIGS. 14*a* to 24*c*, in the case of the automatic front unit 301 shown here the ram 335 and the pivoting element 320.3 of the positive control device 320 are differently shaped. Thus, for example, the ram 235 does not have a point at its front end, but instead a surface aligned vertically and in the transverse direction of the ski, with a round, concave indentation arranged in its center, while the pivoting element 320.3 does not have a horizontal, substantially v-shaped indentation in its rear end, but instead two rounded feet pointing laterally in the rearward direction. The interaction of these feet with the front end of the ram 335 brings about a different progression of the strength of the driving-back force in dependence on the alignment of the pivoting element 320.3. Both the shape of the front end of the ram 235 and the shape of the rear end of the pivoting element 320.3 with or without feet pointing laterally in the rearward direction may, however, also be modified, in order to optimize the progression of the strength of the driving-back force in dependence on the alignment of the pivoting element 320.3 for a lateral safety releasing operation.

Furthermore, by contrast with the pivoting element 220.3 of the automatic front unit 201, the pivoting element 320.3 does not comprise an arm on each of both sides. Correspondingly, the second slotted links 321.1, 321.2 on the pivoting element 320.3 do not enclose the second sliders 322.1, 322.2, but instead only support the second sliders 322.1, 322.2 against a movement toward the center of the ski. This one-sided support also applies to the first slotted links 323.1, 323.2 and the first sliders 334.1, 324.2. Thus, the side levers 320.1, 320.2 do in fact each comprise a first slotted link 323.1, 323.2 on their sides facing away from the center of the ski. However, by contrast with the first slotted links 223.1, 223.2 of the side levers 220.1, 220.2 of the automatic front unit 201, the first slotted links 323.1, 323.2 of the automatic front unit 301 shown here do not comprise any hooks, but just in each case a stop 319.1, 319.2, against which the first sliders 324.1, 324.2, consisting of an opposing stop 318.1, 318.2, bear. In order to press the first sliders 324.1 324.2 against the first slotted links 323.1, 323.2 and the second sliders 322.1, 322.2 against the second slotted links 321.1, 321.2, the automatic front unit 301 shown here comprises two leg springs 329.1, 329.2 (also see in this respect FIG. 26). In each case, one of these leg springs 329.1, 329.2 is guided around one of the pivots (not shown here) of the pivoting levers 305.1, 305.2. In this case, the leg springs 329.1, 329.2 are respectively supported against the carriage 320.4 and the corresponding pivoting lever 305.1, 305.2 and press the upper part of this pivoting lever 305.1, 305.2 in the outward direction, in order that the two holding spurs 306.1, 306.2 are in each case pressed apart as far as possible. As a result, the second sliders 322.1, 322.2, which are arranged in the lower region of the pivoting levers 305.1, 305.2, are pressed against the second slotted links 321.1, 321.2, which are arranged on the side levers 320.1, 320.2. Furthermore, the leg springs 329.1, 329.2 are in each case additionally supported on the respective side lever 320.1, 320.2, whereby the side levers 320.1, 320.2 are pressed toward the center of the ski. Correspondingly, the first sliders 324.1, 324.2, which are arranged on the side levers 320.1, 320.2, are also pressed against the first slotted links 323.1, 323.2, which are arranged on the pivoting element 320.3. This makes it possible that the upper ends of the pivoting levers 305.1, 305.2 have in each case been moved apart as far as possible. At the same time, however, if need be they can be pivoted toward the center of the ski. This may be advisable, for example, if no ski boot is being held in the automatic front unit 301. If a ski with the automatic front unit 301 is then dropped or falls over and falls onto the automatic front unit 301, the pivoting levers 305.1, 305.2 are subjected to less stress, since they can be moved back toward the center of the ski counter to the spring force of the spiral springs 329.1, 329.2. Correspondingly, this reduces the risk of the automatic front unit 301 being damaged.

It goes without saying that there are also possibilities for varying this embodiment of the automatic front unit 301. Thus, for example, the two leg springs 329.1, 329.2 may be supported only on the carriage 320.4 and on the respective pivoting lever 305.1, 305.2. The two leg springs 329.1, 329.2 may, however, also be supported elsewhere and in some other way, and may also be replaced by a different kind of elastic element, which may exert a tensile or compressive force. Furthermore, there is the possibility that each side of the respective pivoting levers 305.1, 305.2 is pressed or drawn against the corresponding side lever 320.1, 320.2 by a first elastic element, while the respective side lever 320.1, 320.2 is pressed or drawn toward the center of the ski by a second elastic element.

The exploded drawing in FIG. 25 does not show a guiding element that corresponds to the guiding element 250 of the automatic front unit 201 shown in FIGS. 14*a* to 24*c*. The automatic front unit 301 shown in FIG. 25 may likewise comprise such a guiding element. However, if the second slotted links 321.1, 321.2 on the pivoting element 320.3 only converge slightly when seen from the rear to the front, it is possible to dispense with such a guiding element. This is because the spiral spring 336 brings about sufficient force on the ram 335 and the pivoting element 320.3 that the pivoting element 320.3 can be moved forward as soon as the control lever 303 clears a space in front of the pivoting element 320.3 and because a force directed toward the center of the ski that acts on the two side levers 320.1, 320.2 is not sufficient to press the pivoting element 320.3 in the rearward direction by way of the second sliders 322.1, 322.2 and the second slotted links 321.1, 321.2. In such a case, however, one or more elements may still be provided between the control lever 303 and the pivoting element 320.3. Such elements that are mounted in between may, for example, ensure the interaction already described for the automatic front unit 201 between the control lever 303, the tread spur 304 and the position of the pivoting element 320.3.

Figure 26:
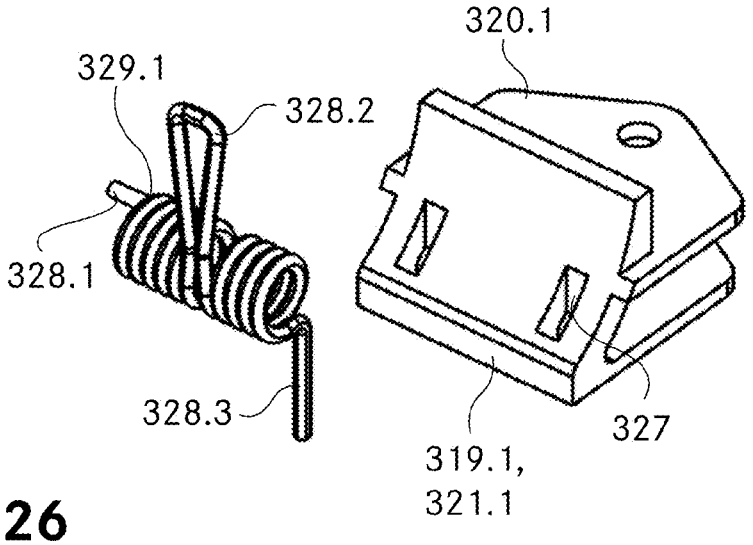
FIG. 26 shows an enlarged detail from the exploded drawing shown in FIG. 25, FIGS. 27*a, b, c* show three views from below of the further automatic front unit shown in FIGS. 25-26, in the securing position and in the safety release position.

FIG. 26 shows an enlarged detail from the exploded drawing of the automatic front unit 301 shown in FIG. 25. In it there can be seen one of the two side levers 320.1 and the leg springs 329.1 belonging to the corresponding side. It can be seen that the leg spring 329.1 has a forwardly pointing leg 328.1, which in the assembled state of the automatic front unit 301 is supported on an upper side of the carriage 320.4, and that the leg spring 329.2 has an upwardly pointing leg 328.2, which in the assembled state of the automatic front unit 301 is supported against the pivoting lever 305.1. It can also be seen that the leg spring 329.1 has a downwardly pointing leg 328.3, which in the assembled state of the automatic front unit 301 is inserted in an opening 327 in the side lever 320.1, whereby a movement of the side lever 320.1 both away from the center of the ski and toward the center of the ski can be controlled by the leg spring 329.1.

In the enlarged detail of the exploded drawing in FIG. 26 it can also be seen that the side lever 320.1 has in a central region and a region facing the center of the ski an upper plate and a lower plate. Between these two plates there is an intermediate space, in which the second slider 322.1 is arranged. In the assembled state of the automatic front unit 301, the pivoting element 320.3 is arranged level with this intermediate space and can partly be moved into this intermediate space when there is a pivoting movement. It can also be seen that the upper one of the two plates reaches slightly beyond the rest of the side lever 320.1 to the side of the side lever 320.1, i.e. to the front and to the rear when seen in the longitudinal direction of the ski. This creates to the side of the side lever 320.1 a kind of linear guide, with which the side lever 320.1 is mounted in the carriage 320.4 movably in the transverse direction of the ski. Both the side levers 320.1, 320.2 of the automatic front unit 301 shown here and also the side levers 220.1, 220.2 of the automatic front unit 201 shown in FIGS. 14*a* to 24*c* have this plate-like construction and this kind of linear guide. This type of construction is only one possible example. A person skilled in the art is free to form the two side levers and their mounting in or on the carriage 220.4 or 320.4 differently.

Figure 27A:
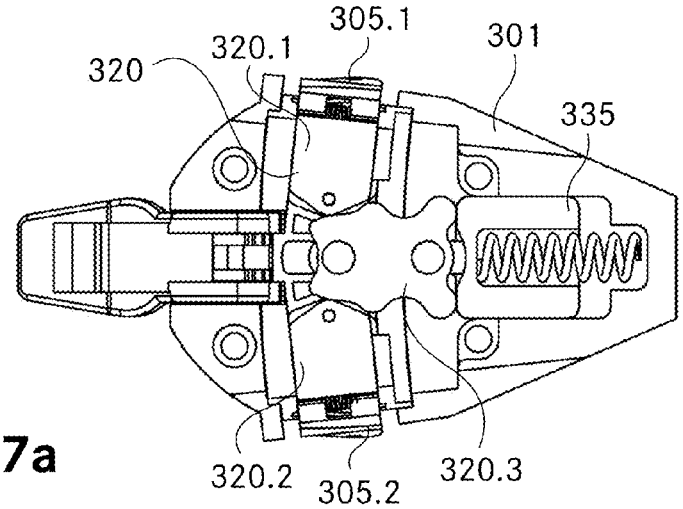
Figure 27B:
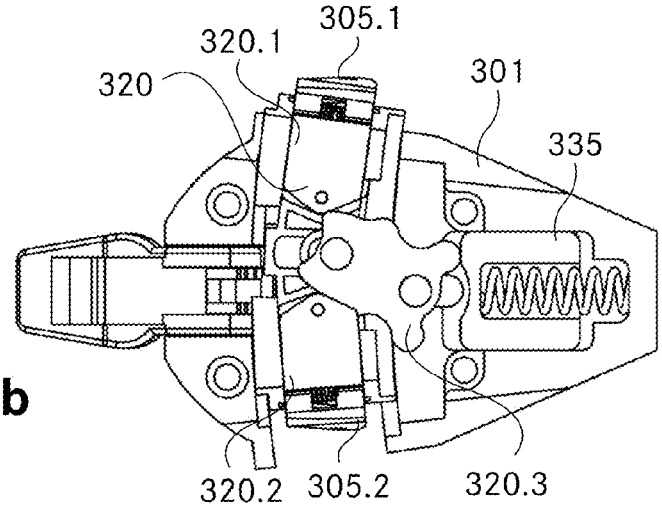
Figure 27C:
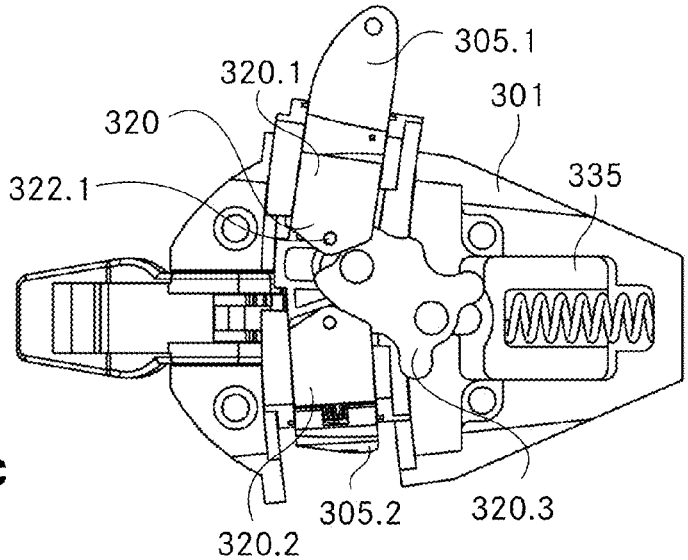

FIGS. 27*a*, 27*b* and 27*c* show a view from below of the automatic front unit 301 shown in FIGS. 25 and 26, the baseplate 330 having been left out. In FIGS. 27*a* and 27*b*, the automatic front unit 301 is in the securing position. In FIG. 27*a*, the positive control device 320 is shown in the center of the positive control path, while in FIG. 27*b* it is represented almost at one end of the positive control path. By contrast with this, in FIG. 27*c* the automatic front unit 301 is in the safety release position and one of the two pivoting levers 305.1 has been swung down. In this case, the side lever 320.1, which belongs to the swung-down pivoting lever 305.1, has been pushed toward the center of the ski. As a result, the corresponding second slider 322.1 is in front of the pivoting element 320.3 pivoted to the side, and blocks a movement of the pivoting element 320.1 back into an alignment parallel to the ski. In order to return the automatic front unit 301 into the securing position, it is sufficient to pivot the pivoting lever 305.1 back in the upward direction. As a result, space is cleared by the pivoting lever 305.1 on the side of the side lever 320.1 that is facing away from the center of the ski. Therefore, the side lever 320.1 can be moved outward, away from the center of the ski, by the leg spring 329.1 (see FIG. 25), whereby the pivoting element 320.3 is released. This allows the positive control device 320 to be moved back into the center of the positive control path. This function of the leg springs 329.1, 329.2 may, however, also be performed by other elements. Thus, for example, a lever may be arranged in each case between the pivoting lever 305.1, 305.2 and the corresponding side lever 320.1, 320.2. By means of such a lever, the side lever 302.1, 302.2 of a swung-down pivoting lever 305.1, 305.2 can be drawn outward when the swung-down pivoting lever 305.1, 305.2 is pivoted in the upward direction by the skier. In order that such levers do not lead to any damage to the automatic front unit 301 when one of a pivoting levers 305.1, 305.2 is pivoted with its upper region toward the center of the ski, the levers may also be arranged loosely between the pivoting levers 305.1, 305.2. It is sufficient in this respect if the levers only draw the corresponding side lever 320.1, 320.2 outward when a pivoting lever 305.1, 305.2 is being pivoted in the upward direction.

Since, by contrast with the views from below that are shown for the automatic front unit 201, the representations shown in FIGS. 27*a*, 27*b* and 27*c* are not horizontal sectional representations, it can be seen here that, depending on the positioning of the positive control device 320 on the positive control path, the pivoting element 320.3 has been moved partly between the plates of the side levers 320.1, 320.2. The interaction of the ram 335 with the feet pointing laterally in the rearward direction of the pivoting element 320.3 can also be seen here, differing from the v-shaped indentation in the pivoting element 220.3 and the substantially pointed-at-the-front-end ram 235 of the automatic front unit 201 shown in FIGS. 14*a* to 24*c*.

In a variant of the automatic front unit 301 shown in FIGS. 25 to 27*c*, the two side levers 320.1, 322.2 may, however, also be formed in some other way. For example, unlike in the exemplary embodiment of the automatic front unit 301, they may not be mounted in the carriage 320.4 displaceably in the transverse direction of the ski, but each be mounted on the carriage 320.4 pivotably about a vertical pivot. This makes it possible for the two side levers to act as a lever arm, by a force that is transferred from the pivoting levers 305.1, 305.2 to the pivoting element 320.3 being stepped up or stepped down. For this purpose, the side levers may, for example, each have a substantially elongate shape and each be aligned substantially in the longitudinal direction of the ski, the vertical pivot being arranged in the region of a first end of the side lever in the case of each side lever. If, moreover, the side levers each interact in their central region, when seen in their longitudinal direction, with the corresponding pivoting lever and interact in a region of their second end with the pivoting element, a stepping down of a force transferred from the pivoting levers to the pivoting element is achieved. This has the result, for example, that the frictional force between the side levers and the pivoting element is reduced. This leads to a reduced movement resistance when there is a movement of the positive control device along the positive control path, because primarily a relative movement between the side levers and the pivoting element thereby takes place, while a relative movement between the side levers and the pivoting levers only takes place in the event of a lateral safety release, when a pivoting lever is pivoted laterally in the downward direction.

Figure 28:
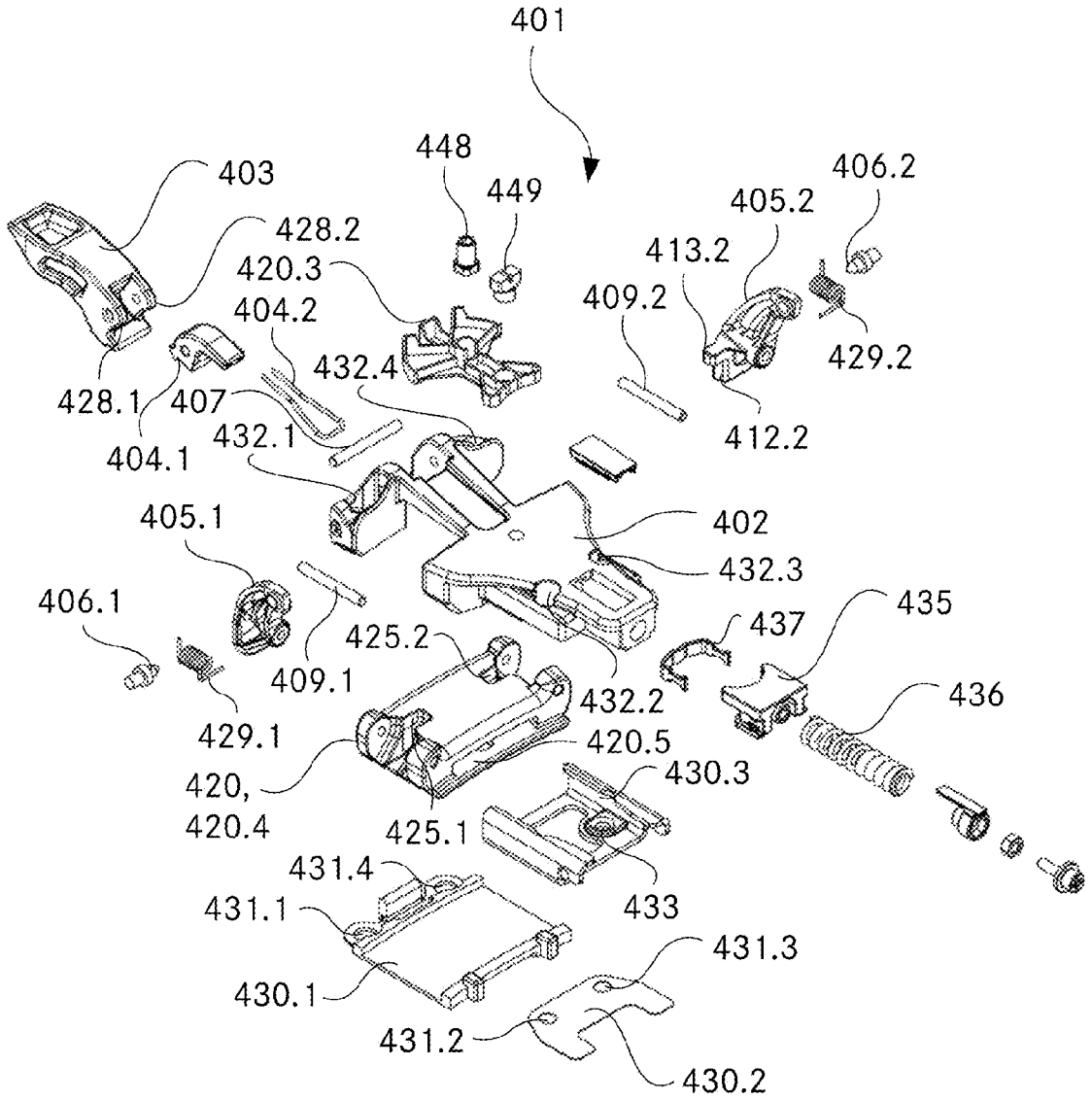
FIG. 28 shows an exploded drawing of a further automatic front unit according to the invention, FIGS. 29*a, b, c* each show a view from below of a horizontally aligned cross section through the further automatic front unit shown in FIG. 28, the cross sections in each case extending through a pivoting element of the automatic front unit, FIGS. 30*a, b, c* each show a vertically aligned cross section, extending along the center of the ski in the longitudinal direction of the ski, through the further automatic front unit shown in FIGS. 28-29.

FIG. 28 shows an exploded drawing of a further automatic front unit 401 according to the invention from the perspective of an oblique view, in which "rear" lies at the bottom right in the figure, while "front" lies at the top left. Some of the elements provided with designations in FIG. 28 are only described in more detail in the description of the subsequent figures. These designations are also indicated in FIG. 28, however, in order to simplify understanding of the type of construction of the automatic front unit 401.

The automatic front unit 401 shown in FIG. 28 is designed very similarly to the two automatic front units 201, 301 that are respectively shown in FIGS. 14*a* to 24*c* and 25 to 27*c*. Correspondingly, the operating mode of the three automatic front units 201, 301, 401 is also very similar. The automatic front unit 401 that is shown in FIG. 28 is more similar to the automatic front unit 301 that is shown in FIGS. 25 to 27*c* than it is to the automatic front unit 201 that is shown in FIGS. 14*a* to 24*c*. Therefore, the structural differences and differences in the operating mode of the automatic front unit 401 described here in comparison with the automatic front unit 301 previously described in conjunction with FIGS. 25 to 27*c* are explained below. Elements and positions of the automatic front unit 401 shown here that are not described in more detail thereby correspond to the elements and positions described above of the automatic front unit 301 shown in FIGS. 25 to 27*c*. Thus, for example, as already in the case of the automatic front unit 301 described above, the automatic front unit 401 comprises, inter alia, a housing 402, a control lever 403, a ram 435 and a spiral spring 436. Furthermore, alongside the two pivoting levers 405.1, 405.2, the automatic front unit 401 likewise comprises a positive control device 420.

A first major difference from the automatic front unit 301 shown in FIGS. 25 to 27*c* is that the positive control device 421 of the automatic front unit 401 is constructed differently. Thus, the positive control device 420 does in fact likewise comprise a pivoting element 420.3 and a carriage 420.4. By contrast with the positive control device 320 of the automatic front unit 301, however, it does not comprise two side levers. Therefore, in the case of the automatic front unit 401, the two pivoting levers 405.1, 405.2 interact directly with the pivoting element 420.3. In order to make this possible, the two pivoting levers 405.1, 405.2 of the automatic front unit 401 have under each of the pivots 409.1, 409.2 a stop 412.1, 412.2 facing the center of the ski. Moreover, the pivoting element 420.3 has a different shape than in the case of the previously described automatic front unit 301, in order that it can interact with the two stops 412.1, 412.2 of the pivoting levers 405.1, 405.2. Furthermore, the carriage 420.4 is also shaped differently than the carriage 320.4 of the previously described automatic front unit 320. Thus, for example, the pivoting element 420.3 is mounted in a central region of the carriage 420.4, in a slit 420.5 running horizontally from a rear side to a front side of the carriage 420.4. Moreover, a surface of the carriage 420.4 has on each side a recess 425.1, 425.2, from which the stops 412.1, 412.2 of the pivoting levers 405.1, 405.2 can be moved in the upward direction when the corresponding pivoting lever 405.1, 405.2 is tilted away to the side when there is a lateral safety release. In order to prevent, or at least greatly reduce, ingress of snow through these recesses 425.1, 425.2 into the carriage 420.4, the two side levers 405.1, 405.2 each have a cover 413.1, 413.2 level with the pivots 409.1, 409.2. These covers 413.1, 413.2 each reach somewhat closer to the center of the ski than the stop 412.1, 412.2 of the corresponding pivoting lever 405.1, 405.2 and fill the recesses 425.1, 425.2 in the surface of the carriage 420.4 in the securing position and in the release position of the automatic front unit 401. In order that these covers 413.1, 413.2 do not butt against the sole of a ski boot held in the ski binding from below when there is a lateral safety release, the upper regions of the pivoting levers 405.1, 405.2 are bent rearwardly, so that the two holding spurs 406.1, 406.2 are behind the stops 412.1, 412.2 and the covers 413.1, 413.2. This achieves the effect that the cover 413.1, 413.2 of the pivoting lever 405.1, 405.2 tilted away to the side can be pivoted in the upward direction in front of the sole of the ski boot when there is a lateral safety release.

A second major difference between the automatic front unit 401 shown here and the automatic front unit 301 shown in FIGS. 25 to 27*c* is that the automatic front unit 401 comprises not just one but two baseplates 430.1, 430.2 and a holding element 430.3. Of these three elements, a first baseplate 430.1 serves as a guide for the movement of the carriage 420.4 in the transverse direction of the ski. It has in its front region, in front of the guide for the carriage 420.4, two openings 431.1, 431.4, through which screws can be led for fastening the automatic front unit 401 to a ski. A second baseplate 430.2 likewise has in its front region two openings 431.2, 431.3, through which screws can be led for fastening the automatic front unit 401 to a ski. This second baseplate 430.2 is arranged behind the first baseplate 430.1 and serves as a base for the holding element 430.3, which likewise has two openings 433 for the fastening to a ski. This holding element 430.3 is formed from a piece of metal sheet. In a cross section aligned vertically and in the transverse direction of the ski, this holding element 430.3 has substantially the shape of a u, the two upper edges being bent inwardly. As a result, the holding element 430.3 forms a rail-like longitudinal guide for the housing 402 of the automatic front unit 401, it not being possible for the housing 402 of the automatic front unit 401 to be moved away in the upward direction with respect to the holding element 430.3. Therefore, when the automatic front unit 401 is mounted on a ski, four screws are led through four vertically aligned openings 432.1, 432.2, 432.3, 432.4, arranged in the housing 402, and are firmly screwed to the ski. The two front screws thereby extend both through the two front openings 432.1, 432.2 of the housing 402 and through the two openings 431.1, 431.4 of the first baseplate 430.1 and secure the housing 402 and the first baseplate 430.1 on the ski. By contrast, when fastening the automatic front unit 401, the two rear screws are led downward through the rear openings 432.2, 432.3 of the housing 402, where they extend through the two openings in the holding element 430.3 and through the two openings 431.2, 431.3 of the second baseplate 430.2 and only secure the holding element 430.3 and the second baseplate 430.2 on the ski. Therefore, in the mounted state, when the automatic front unit 401 is fastened on a ski, the housing 402 is only firmly screwed on the ski by the two front screws. By contrast, the rear region of the housing 402 is held in the longitudinal guide of the holding element 430.3 firmly screwed to the ski and can move in relation to the holding element 430.3 in the longitudinal direction of the ski. This makes it possible that the ski can flex during skiing, the automatic front unit 401 adapting itself to the flexing of the ski, by the housing 401 being moved with respect to the holding element 430.3 in the longitudinal direction of the ski. This has the advantage that the automatic front unit 401 does not lead to any stiffening of the ski, whereby the skier's skiing comfort is optimized.

A third major difference between the automatic front unit 401 shown here and the automatic front units 201, 301 respectively shown in FIGS. 14*a* to 24*c* and 25 to 27*c* is that, instead of a blocking position, the automatic front unit 401 has a damping position. Correspondingly, the control lever 403 of the automatic front unit 401 represented here does not have a catch with which a movement of the carriage 420.4 in the transverse direction of the ski can be blocked. By contrast, the control lever 403 has two bulges 428.1, 428.2, which press from the front against a front side of the carriage 420.4 when the control lever 403 is moved in the upward direction into a damping position. As a result, an increased movement resistance is imparted to a movement of the carriage 420.4 in the transverse direction of the ski by friction. Correspondingly, the carriage 420.4 can be moved less well in the transverse direction of the ski in the damping position of the automatic front unit 401. If, therefore, the damping position is used when climbing, it is prevented that the ski judders back and forth with respect to the ski boot held in the automatic front unit 401. Correspondingly, the surefootedness is increased for the skier by the damping position. At the same time, a lateral safety release can still take place in the damping position, however, whereby the safety for the skier is also ensured in the damping position.

Figure 29A:
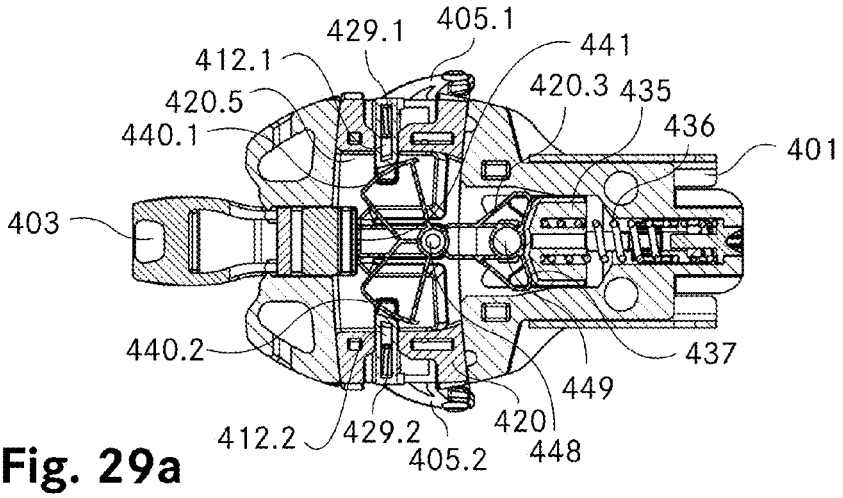
Figure 29B:
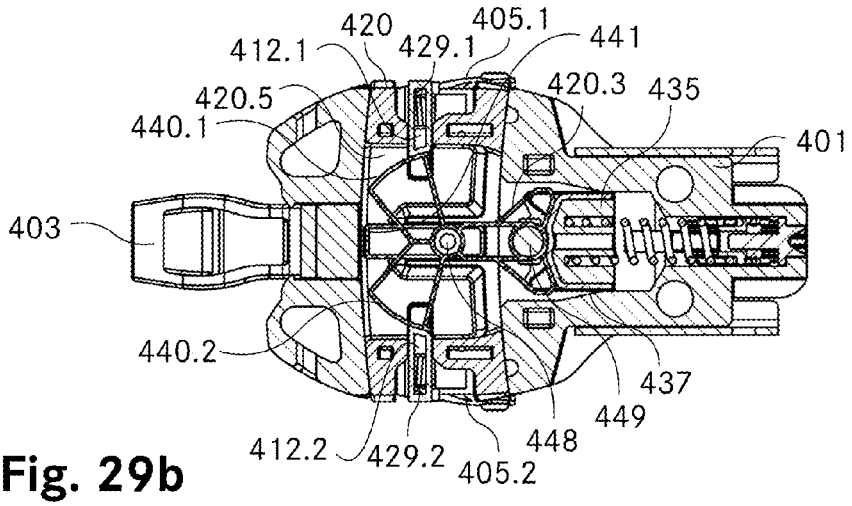
Figure 29C:
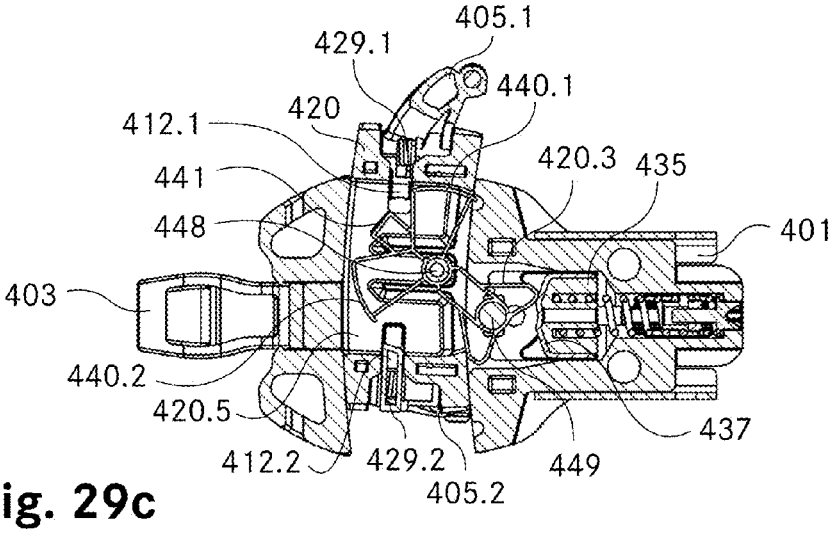

FIGS. 29*a*, 29*b* and 29*c* each show a view from below of a horizontally aligned cross section through the automatic front unit 401, which in each case extends through the pivoting element 420.3 and through the horizontal slit 420.5 in the carriage 420.4. In these cross-sectional views it can be seen that, as already in the case of the two automatic front units 201, 301, the pivoting element 420.3 is mounted on the carriage 420.4 pivotably about a first vertical pin 448, the first vertical pin 448 being displaceable in the longitudinal direction of the ski with respect to the carriage 420.4. It can also be seen that the pivoting element 420.3 behind the carriage 420.4 is mounted on the housing 402 of the automatic front unit 401 pivotably about a second vertical pin 449, the second vertical pin 449 being displaceable with respect to the housing 402 in the longitudinal direction of the ski. It can also be seen in the cross-sectional views that the pivoting element 420.3 has an elongate shape. A longitudinal axis of the pivoting element 420.3 is aligned parallel to the longitudinal direction of the ski when the positive control device 420 is in the center of the positive control path. In a rear region, the pivoting element 420.3 has two feet protruding laterally from the longitudinal axis of the pivoting element 420.3 and pointing obliquely in the rearward direction. With these feet, the pivoting element 420.3 is supported against a metal front side 437 of the ram 435. In this case, the support of the pivoting element 420.3 against the ram 435 functions in the same way as in the case of the pivoting element 43 of the variant of the automatic front unit 1 that is shown in FIGS. 12*a*, 12*b* and 12*c*. It can also be seen in the cross-sectional views of FIGS. 29*a*, 29*b* and 29*c* that the pivoting element 420.3 has arranged slightly in front of the first vertical pin 448 two arms 440.1, 440.2, which are directed slightly forward and protrude laterally from the longitudinal axis of the pivoting element 420.3. These two arms 440.1, 440.2 have outer ends, which are rounded and, running from the rear to the front, are bent toward each other from laterally the outside toward the center of the ski. These outer ends serve as slotted links for the stops 412.1, 412.2 of the pivoting levers 405.1, 405.2. Furthermore, the pivoting element 420.3 comprises a head 441 arranged between its two arms 440.1, 440.2. This head 441 is arranged in front of the first vertical pin 448 and has a forwardly aligned side with a latching position. A flat region of this forwardly aligned side is aligned substantially perpendicularly to the longitudinal axis of the pivoting element 420.3.

When the automatic front unit 401 is in the release position, as represented in FIG. 29*a*, the control lever 403 presses against the head 441 of the pivoting element 420.3. As a result, in comparison with the securing position, in the release position the pivoting element 420.3 has been moved together with the ram 435 in the rearward direction, counter to the spring force of the spiral spring 436. Correspondingly, the two arms 440.1, 440.2 of the pivoting element 420.3 have also been moved in the rearward direction with respect to the stops 412.1, 412.2 of the pivoting levers 405.1, 405.2. This has the effect that the outer ends of the two arms 440.1, 440.2 which, in the forward direction, are bent toward each other, toward the center of the ski, provide the stops 412.1, 412.2 with more space for a movement toward the center of the ski in comparison with the securing position. In order that this space is used by the stops 412.1, 412.2, the two pivoting levers 405.1, 405.2 are each subjected to an outwardly directed force by a leg spring 429.1, 429.2. This force has the effect that, in the release position too, the pivoting levers 405.1, 405.2 have been pivoted apart as far as possible and the two stops 412.1, 412.2 butt against the outer ends of the two arms 440.1, 440.2. This achieves the effect that the two holding spurs are at the first distance from each other.

When, by contrast, the automatic front unit 401 is in the securing position, as shown in FIG. 29*b*, the control lever 403 does not press against the head 441 of the pivoting element 420.3. Correspondingly, in the securing position, the pivoting element 420.3 has been moved by the spiral spring 436 and the ram 435 in the forward direction to the extent allowed by the mounting of the first vertical pin 448 in the carriage 420.4. In this position, the head 441 of the pivoting element 420.3 is just within the front side of the carriage 420.4. When in this case the positive control device 420 is in the center of the positive control path, as represented in FIG. 29*b*, the two arms 440.1, 440.2 of the pivoting element 420.3 are moreover so far forward in the carriage 420.4 that the stops 412.1, 412.2 of the two pivoting levers 405.1, 405.2 butt against the outer ends of the arms 440.1, 440.2 in the rear region of the outer ends of the arms 440.1, 440.2. Since the outer ends of the two arms 440.1, 440.2 are spaced furthest apart from each other in their rear region, the stops 412.1, 412.2 have also been moved further apart in comparison with the release position. This has the effect that the pivoting levers 405.1, 405.2 have been pivoted together, so that the two holding spurs are at the second distance from each other.

By contrast with FIG. 29*b*, the automatic front unit 401 in FIG. 29*c* is shown in the safety release position, with a pivoting lever 405.1 pivoted away to the side. In this case, the positive control device 420 has been moved up to one end of the positive control path, whereby the pivoting element 420.3 has been pivoted about the first vertical pin 448 and about the second vertical pin 449 to the side of the pivoting lever 405.1 released by the safety release. By this pivoting movement, the arm 404.1 of the pivoting element 420.3, against which the pivoted-away pivoting lever 405.1 is supported in the securing position by a stop 412.1, has been moved in the rearward direction. Correspondingly, the stop 412.1 of the pivoted-away pivoting lever 405.1 is in front of the arm 440.1 of the pivoting element 405.1, when seen in the longitudinal direction of the ski. Since the pivoting lever 405.1 has consequently been released by the pivoting element 420.3, it has been pivoted away in the outward direction by the leg spring 429.1 with the holding spur, while its stop 412.1 has been moved toward the center of the ski. Because, as a result, the stop 412.1 is in front of the arm 440.1 of the pivoting element 420.3, the stop 412.1 prevents that the arm 440.1 of the pivoting element 420.3 can be moved again in the forward direction. Correspondingly, as a result, a movement of the positive control device 420 back into the center of the positive control path is blocked. Only when the pivoted-away pivoting lever 405.1 is pivoted back toward the center of the ski by the skier is the arm 440.1 of the pivoting element 420.3 released again, whereby the positive control device 420 can be moved back into the center of the positive control path by the spring force of the spiral spring 436.

It can also be seen in FIG. 29*c* that, in the safety release position, the arm 440.2 of the pivoting element 420.3 has been moved in the forward direction on the side of the non-released pivoting lever 405.2 by the pivoting movement of the pivoting element 420.3. In this case, this arm 440.2 of the pivoting element 420.3 has been moved in the forward direction to such an extent that the stop 412.2 of the corresponding pivoting lever 405.2 is behind the arm 440.2, when seen in the longitudinal direction of the ski. Therefore, the corresponding pivoting lever 405.2 has also been released by the pivoting element 420.3. Nevertheless, this pivoting lever 405.2 has not been pivoted away in the outward direction with the holding spur because the cover 413.2 of the corresponding pivoting lever 405.2 has been moved under a central region of the housing 402 by the movement of the carriage 420.4 in the transverse direction of the ski, and at the bottom butts against the housing 402.

Not only in the release position but also in the securing position and in the safety release position, the pivoting levers 405.1, 405.2 can be pivoted toward the center of the ski with the holding spurs counter to the spring force of the leg springs 429.1, 429.2. If, therefore, a ski with the automatic front unit 401 falls over and gets hit on a pivoting lever 405.1, 405.2, the corresponding pivoting lever 405.1, 405.2 can be pivoted inward toward the center of the ski, whereby the risk of the automatic front unit 401 being damaged is reduced.

Figure 30A:
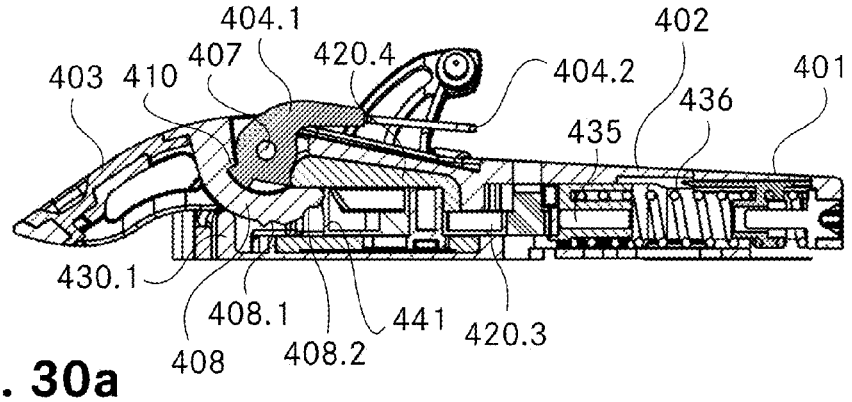
Figure 30B:
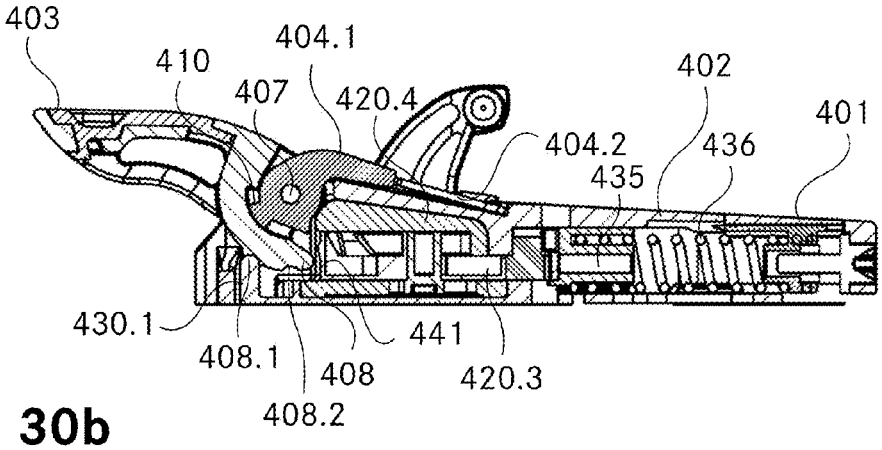
Figure 30C:
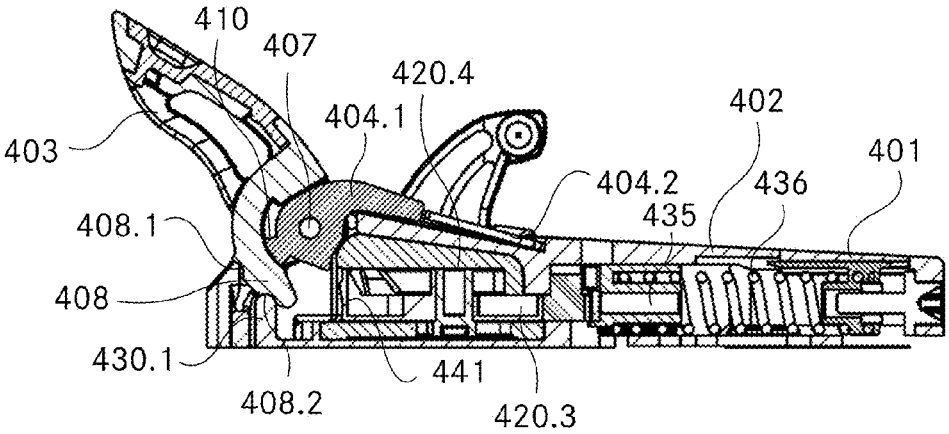

In each of FIGS. 30*a*, 30*b* and 30*c* there is shown a vertically aligned cross section, arranged in the center of the ski and extending in the longitudinal direction of the ski, of the automatic front unit 401. In this case, left in the figures is front on the automatic front unit 401, while right in the figures is rear on the automatic front unit 401.

In FIG. 30*a*, the automatic front unit 401 is in the release position. Correspondingly, the control lever 403 has been pivoted with its front end in the downward direction about the transverse axle 407 of the ski and is located in the release position. As a result, a latching unit 408, arranged on the control lever 403 underneath the transverse axle 407 of the ski and running concentrically around the transverse axle of the ski, has been moved in the rearward direction and presses the head 441 of the pivoting element 420.3 in the rearward direction. In this case, a rear end of the latching unit 408 in the latching position is latched on the head 441 of the pivoting element 420.3. This latching prevents that the spiral spring 436 can press the ram 435 and the pivoting element 420.3 in the forward direction and move the control lever 403 into its securing position.

In order to move the automatic front unit 401 from the release position into the securing position, the control lever 403 can be pulled slightly in the upward direction. This is sufficient to release the latching unit 408 from the latching position on the head 441 of the pivoting element 420.3. As soon as the latching unit 408 has been released from the latching position, the latching unit 408 is moved in the forward direction by the spiral spring 436 together with the pivoting element 420.3 and the ram 435. This has the effect that the control lever 403 is pivoted upward with its free end and transferred into the securing position. As a variant of this, however, the tread spur, consisting of a base element 404.1 and a wire loop 404.2, may also be pressed downward to transfer the automatic front unit 401 into the securing position. If the tread spur is pressed downward, the base element 404.1 of the tread spur is pivoted about the transverse axle 407 of the ski. The control lever 403 is thereby moved along with it by a stop 410 of the base element 404.1, which bears against a counterpart of the control lever 403. As a result, the latching unit 408 is likewise released from the latching position on the head 441 of the pivoting element 420.3, after which the control lever 403 is moved by the spiral spring 436 into the securing position and the automatic front unit 401 is moved into the securing position.

In FIG. 30*b*, the automatic front unit 401 is shown in the securing position. Therefore, the free end of the control lever 403 is slightly further up than in the release position, while the latching unit 408 of the control lever 403 is slightly further forward than in the release position. Correspondingly, two latching positions 408.1, 408.2 that are arranged one behind the other on a lower side of the latching unit 408 are also somewhat further forward than in the release position. In this case, the front of the two latching positions 408.1 has been drawn onto a front, upright edge of the first baseplate 430.1 and engaged on this front, upright edge of the first baseplate 430.1. As a result, the control lever 403 is engaged in its securing position.

Since the latching unit 408 of the control lever 403 is further forward in the securing position than in the release position, space is cleared in front of the head 441 of the pivoting element 420.3 by the moved-forward rear end of the latching unit 408. As a result, as already explained in conjunction with FIGS. 29*a* and 29*b*, the pivoting element 420.3 has been moved by the spiral spring 436 in the forward direction with respect to the carriage 420.4 and the rest of the automatic front unit 401.

Furthermore, alongside the control lever 403, in the securing position the base element 404.1 of the tread spur has also been pivoted about the transverse axle 407 of the ski, so that the loop element 404.2 of the tread spur has been lowered onto the housing 402 of the automatic front unit 401.

In FIG. 30*c*, the automatic front unit 401 is shown in the damping position. In comparison with the securing position, therefore, the free end of the control lever 403 has been moved further in the upward direction. Correspondingly, the control lever 403 has been pivoted further about the transverse axle 407 of the ski, whereby the latching unit 408 of the control lever 403 has also been moved further upward in the forward direction. As a result, the rear of the two latching positions 408.2 has been drawn onto the front, upright edge of the first baseplate 430.1 and engaged on this front, upright edge of the first baseplate 430.1. Therefore, the control lever 403 is engaged in its damping position. Moreover, by this positioning of the control lever 403 in the damping position, the two bulges 428.1, 428.2 of the control lever 403 that are shown in FIG. 28 have been lowered with respect to the carriage 420.4 and press from the front onto the front side of the carriage 420.4. The carriage 420.4 is in fact only moved a little in the rearward direction by this pressure. On the other hand, however, the carriage 420.4 is pressed in the rearward direction against the first baseplate 430.1 and the housing 402, which together form a guide of the carriage 420.4 for a movement of the carriage 420.4 in the transverse direction of the ski. As already explained further above, this has the result of increasing the movement resistance when there is a movement of the carriage 420.4 in the transverse direction of the ski.

In a variant of the automatic front unit 401 shown in FIGS. 28 to 30*c*, for example, the stops 412.1, 412.2 on the pivoting levers 405.1, 405.2 may also be formed in some other way. In particular, the function of the stops 412.1, 412.2 may also be undertaken by a further element. Thus, for example, instead of the stops 412.1, 412.2, for each pivoting lever 405.1, 405.2 there may be provided a roller which is mounted on the corresponding pivoting lever 405.1, 405.2 rotatably about a axis. In this case, these rollers may, for example, be arranged in such a way that their axes are aligned substantially vertically in the release position and in the securing position and that the rollers can roll on the outer ends of the arms 440.1, 440.2 of the pivoting element 420.3. In this case, for example, the rollers may be regarded instead of the stops 412.1, 412.2 as first sliders, while the outer ends of the arms 440.1, 440.2 of the pivoting element 420.3 may be regarded as first slotted links.

In a further variant of the automatic front unit 401 that is shown in FIGS. 28 to 30*c*, the function of the stops 412.1, 412.2 on the pivoting levers 405.1, 405.2 may, however, also be undertaken for example by pivoting arms mounted pivotably on the pivoting levers 405.1, 405.2. Such an automatic front unit 501 is shown for example in the following FIG. 31.

Figure 31:
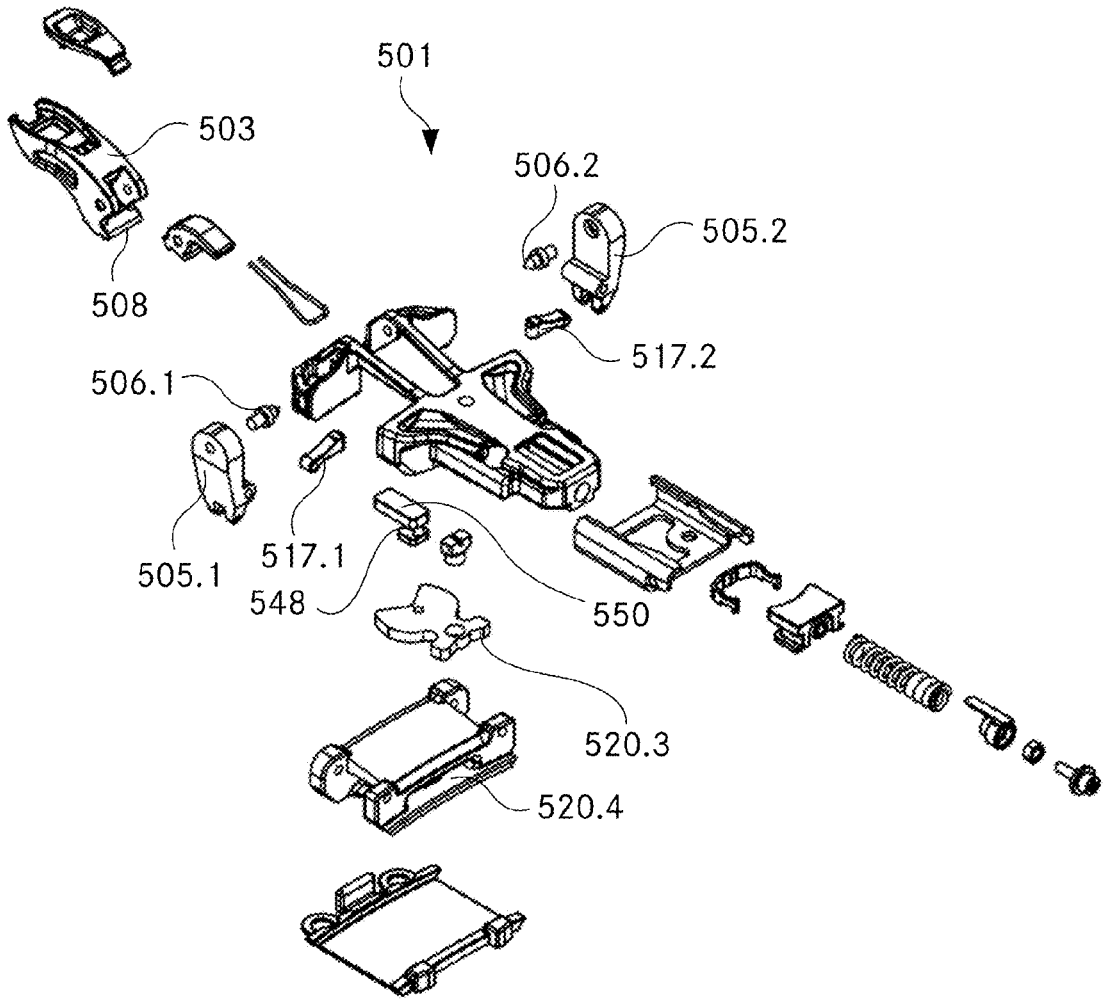
FIG. 31 shows an exploded drawing of a further automatic front unit according to the invention.

FIG. 31 shows an exploded drawing of a further automatic front unit 501 according to the invention from the perspective of an oblique view, in which "rear" in the figure lies at the bottom right, while "front" lies at the top left. In order to improve the overall clarity of the representation, not all of the elements of the automatic front unit 501 are shown, but only those that are most important for understanding.

A first major difference between the automatic front unit 501 shown here and the automatic front unit 401 shown in FIGS. 28 to 30*c* is the operating mode of the interaction of the pivoting levers 505.1, 505.2 with the pivoting element 520.3. As already in the case of the automatic front unit 401, here too the two pivoting levers 505.1, 505.2 are mounted on a carriage 520.4 in a central region pivotably about pivots (not shown) aligned substantially in the longitudinal direction of the ski. Underneath the mounting of these pivots on the pivoting levers 505.1, 505.2, the pivoting levers 505.1, 505.2 do not, however, comprise stops facing the center of the ski, but each comprise a pivoting arm 517.1, 517.2 pointing to the center of the ski. These two pivoting arms 517.1, 517.2 each have an elongate shape and are each mounted in the region of a lower end of the corresponding pivoting lever 505.1, 505.2 on the corresponding pivoting lever 505.1, 505.2 pivotably about a pivot (not shown) aligned substantially in the longitudinal direction of the ski. In the mounted state of the automatic front unit 501, these two pivoting arms 517.1, 517.2 point substantially horizontally to the center of the ski and, with a free end, which lies opposite the mounting on the respective pivoting lever 505.1, 505.2, interact with the pivoting element 520.3. Therefore, when a pivoting arm 517.1, 517.2 is pressed by the pivoting element 520.3 away from the center of the ski in the outward direction, the corresponding pivoting lever 505.1, 505.2 with the corresponding holding spur 506.1, 506.2 is pivoted toward the center of the ski. If, by contrast, the pivoting element 520.3 gives a pivoting arm 517.1, 517.2 more space toward the center of the ski, the corresponding pivoting lever 505.1, 505.2 is pivoted outward by a leg spring not shown here, so that the corresponding holding spur 506.1, 506.2 is moved outward away from the center of the ski and the corresponding pivoting arm 517.1, 517.2 is moved inward toward the center of the ski.

A second major difference between the automatic front unit 501 shown here and the automatic front unit 401 shown in FIGS. 28 to 30*c* is the control of the displacement of the pivoting element 520.3 in the longitudinal direction of the ski. Thus, by contrast with the pivoting element 520.3 of the automatic front unit 401, the pivoting element 420.3 does not have a head against which the control lever 503 could press in order to push the pivoting element 520.3 in the rearward direction. However, the pivoting element 520.3 of the automatic front unit 501 shown here is likewise mounted on the carriage 520.4 pivotably about a first vertical pin 548. This first vertical pin 548 is also likewise mounted on the carriage 520.4 displaceably in the longitudinal direction of the ski. However, this first vertical pin 548 has at its upper end a rectangular, elongated element 550, which is aligned in the longitudinal direction of the ski and is mounted on the carriage 520.4 displaceably in the longitudinal direction of the ski. This rectangular element 550 reaches with its front end into a region of a front end of the carriage 520.4. Therefore, when the control lever 503 is pivoted in the downward direction with its free end and, as a result, the latching unit 508 of the control lever 503 is moved in the rearward direction, the latching unit 508 does not press a head of the pivoting element 520.3 but instead the front end of the rectangular element 550 in the rearward direction. As a result, the rectangular element 550 is moved together with the first vertical pin 548 in the rearward direction, whereby the pivoting element 520.3 is also moved in the rearward direction.

In a variant of the automatic front unit 501 shown in FIG. 31, for example, the pivoting arms 517.1, 517.2 may also be formed in some other way on the pivoting levers 505.1, 505.2. Thus, the pivoting arms 517.1, 517.2 may, for example, be shaped differently. However, they may, for example, also each have at their free ends a roller which is mounted on the corresponding pivoting arm 517.1, 517.2 rotatably about an axis. For example, these rollers may in this case be arranged in such a way that their axes are vertically aligned when the pivoting arms 517.1, 517.2 are horizontally aligned. This can achieve the effect that the rollers can roll on the outer side edges of the pivoting element 520.3. In this case, for example, the rollers may be regarded instead of the free ends of the pivoting arms 517.1, 517.2 as first sliders, while the outer side edges of the pivoting element 520.3 may be regarded as first slotted links.

It goes without saying that the invention is not restricted to the exemplary embodiments described above of the automatic front unit 1 and of the four further automatic front units 201, 301, 401 and 501. Various further embodiments are possible. Thus, for example, features of the automatic front units 1, 201, 301, 401 and 501 may be combined in any way desired. Thus, for example, the automatic front units 401, 501 may also have a blocking position instead of the damping position or have neither a damping position nor a blocking position. Equally, the automatic front units 1, 201 and 301 may also have a damping position instead of the blocking position or have neither a damping position nor a blocking position.

Independently of such combinations, both the first slotted links and the second slotted links may, for example, he replaced by other guides. One possibility for this is that dovetail guides with a carriage guided on them are used. Furthermore, the first slotted links may also not be arranged on the positive control device but on the housing of the automatic front unit. In the case of the automatic front unit 1, the two pivots may in this case be arranged on the positive control device instead of the housing. Furthermore, in the case of the automatic front unit 1, the mounting of the two pivoting levers on the positive control device may also be arranged underneath the pivots about which the pivoting levers are pivotable.

By contrast, in the case of the further automatic front units 201, 301, 401 and 501, the pivoting away of the pivoting lever lying in the direction of movement may for example be achieved by arranging on the housing of the automatic front unit a guide for the pivoting levers that releases the corresponding pivoting lever as soon as the end of the positive control path is reached. However, it is also conceivable that, at the end of the positive control path, the positive control device butts against an obstacle, whereby a releasing mechanism on the positive control device that releases the corresponding lever for a pivoting movement is actuated.

The invention is not restricted to these variants of the automatic front unit. Further embodiments are also possible.

To sum up, it can be stated that an automatic front unit that increases the safety for a skier is provided.

The invention claimed is:

1. An automatic front unit for a ski binding, in particular a ski-touring binding, comprising:

two levers, which when seen in the longitudinal direction of the ski are arranged laterally, lie opposite each other and each have a holding means for holding a ski boot in a toe region of the ski boot, wherein the holding means are spurs which are arranged on the respective lever and which, starting from the respective lever, point with their free end towards the centre of the ski, the two levers each being mounted pivotably about a pivot in such a way that, when there is a pivoting movement of the levers about these pivots, the holding means are moved in a transverse direction of the ski; and a positive control device, wherein a. the automatic front unit has a release position, in which the two holding means are at a first distance from each other and b. the automatic front unit has a securing position, in which the two holding means are at a second distance from each other, which is less than the first distance, c. in the securing position the two levers are mounted on the positive control device, and d. while the automatic front unit is in the securing position, the positive control device controls movement, in the transverse direction of the ski, of the two levers in a coupled state within a dynamic region such that the two holding means remain coupled at the second distance from each other during movement within the dynamic range.

2. The automatic front unit according to claim 1, wherein the pivots of the levers are arranged in a plane parallel to the ski.

3. The automatic front unit according to claim 1, wherein both levers each comprise on a side facing the center of the ski a control jaw for interaction with a ski boot.

4. The automatic front unit according to claim 1, wherein, in the securing position, the positive control device is movable along a control path.

5. The automatic front unit according to claim 4, further comprising:

a pretensioned, elastic element that, when there is a deviation from a centre of the control path, presses the positive control device with a force toward the centre of the control path.

6. The automatic front unit according to claim 1, wherein the automatic front unit has a safety release position and in that, in the securing position, the two levers can be moved up to one end of the dynamic region, where the one of the two levers that comprises the holding means that has been moved away from the centre of the ski on the dynamic path can be released by the positive control device and can be pivoted away by the other of the two levers, whereby the automatic front unit can be brought from the securing position into the safety release position.

7. The automatic front unit according to claim 1, wherein, in the release position, the two levers are mounted on the positive control device such that the holding means of the two levers are at the first distance from each other.

8. The automatic front unit according to claim 7, wherein the positive control device comprises a control element on which the two levers are mounted, the control element being movable in such a way that, in the release position, the two levers have been moved apart and the holding means are at the first distance from each other and in that, in the securing position, the two levers have been moved together and the holding means are at the second distance from each other.

9. The automatic front unit according to claim 7, wherein the positive control device comprises two elements, one of the two levers being mounted on a first element and the other of the two levers being mounted on a second element, and the first and second elements being movable in relation to each other in such a way that, in the release position, the two levers have been moved apart and the holding means are at the first distance from each other and in that, in the securing position, the two levers have been moved together and the holding means are at the second distance from each other.

10. The automatic front unit according to claim 9, wherein the first element and the second element of the positive control device are each respectively mounted on a third element of the positive control device by a respective slotted link and a respective slider.

11. The automatic front unit according to claim 10, wherein the third element of the positive control device is movable along the longitudinal axis of the ski, wherein a. the first and second elements of the positive control device are moved together by the slotted links when there is a movement of the third element of the positive control device in a first direction, and b. the first and second elements of the positive control device are moved apart by the slotted links when there is a movement of the third element of the positive control device in a second direction.

12. The automatic front unit according to claim 1, wherein the automatic front unit has a blocking position, in which the two holding means are at a third distance from each other, which is equal to or less than the second distance and in which the two levers have been blocked in their movement.

13. The automatic front unit according to claim 1, wherein the automatic front unit has a damping position, in which the two holding means are at a third distance from each other, which is equal to or less than the second distance and in which the two levers can be moved within the dynamic region with a greater resistance than in the securing position.

14. The automatic front unit according to claim 1, further comprising a control lever, which can be brought into a release position and into a securing position, the automatic front unit being able to be brought into the release position by positioning the control lever in the release position and able to be brought into the securing position by positioning the control lever in the securing position.

15. The automatic front unit according to claim 2, wherein both levers each comprise on a side facing the center of the ski a control jaw for interaction with a ski boot.

16. The automatic front unit according to claim 2, wherein, in the securing position, the positive control device is movable along a control path, whereby the two levers are movable in a coupled state within the dynamic region.

17. The automatic front unit according to claim 3, wherein, in the securing position, the positive control device is movable along a control path, whereby the two levers are movable in a coupled state within the dynamic region.

18. The automatic front unit according to claim 2, wherein the automatic front unit has a safety release position and in that, in the securing position, the two levers can be moved up to one end of the dynamic region, where the one of the two levers that comprises the holding means that has been moved away from the centre of the ski on the dynamic path can be released by the control device and can be pivoted away by the other of the two levers, whereby the automatic front unit can be brought from the securing position into the safety release position.

19. The automatic front unit according to claim 3, wherein the automatic front unit has a safety release position and in that, in the securing position, the two levers can be moved up to one end of the dynamic region, where the one of the two levers that comprises the holding means that has been moved away from the center of the ski on the dynamic path can be released by the control device and can be pivoted away by the other of the two levers, whereby the automatic front unit can be brought from the securing position into the safety release position.

20. An automatic front unit for a ski binding, in particular a ski-touring binding, comprising:

two levers, which when seen in the longitudinal direction of the ski are arranged laterally, lie opposite each other and each have a holding means for holding a ski boot in a toe region of the ski boot, wherein the holding means are spurs which are arranged on the respective lever and which, starting from the respective lever, point with their free end towards the centre of the ski, the two levers each being mounted pivotably about a pivot in such a way that, when there is a pivoting movement of the levers about these pivots, the holding means are moved in a transverse direction of the ski; and a positive control device on which the two levers are mounted, wherein a. the automatic front unit has a release position, in which the two holding means are at a first distance from each other and b. the automatic front unit has a securing position, in which the two holding means are at a second distance from each other, which is less than the first distance, c. the positive control device is moveable while the automatic front unit is in the securing position, and d. the positive control device controls movement, in the transverse direction of the ski, of the two levers in a coupled state within a dynamic region range such that the two holding means, remain coupled at the second distance from each other during movement within the dynamic range.

21. An automatic front unit for a ski binding, in particular a ski-touring binding, comprising:

two levers, which when seen in the longitudinal direction of the ski are arranged laterally, lie opposite each other and each have a holding means for holding a ski boot in a toe region of the ski boot, the two levers each being mounted pivotably about a pivot which is arranged in a plane parallel to the ski in such a way that, when there is a pivoting movement of the levers about these pivots, the holding means are moved in a transverse direction of the ski; and a positive control device, wherein a. the automatic front unit has a release position, in which the two holding means are at a first distance from each other and b. the automatic front unit has a securing position, in which the two holding means are at a second distance from each other, which is less than the first distance, c. in the securing position the two levers are mounted on the positive control device, and d. the positive control device, while the automatic front unit is in the securing position, controls movement, in the transverse direction of the ski, of the two levers in a coupled state within a dynamic region such that the two holding means remain coupled at the second distance from each other during movement within the dynamic range.

22. An automatic front unit for a ski binding, in particular a ski-touring binding, comprising two levers, which when seen in the longitudinal direction of the ski are arranged laterally, lie opposite each other and each have a holding means for holding a ski boot in a toe region of the ski boot, wherein the holding means are spurs which are arranged on the respective lever and which, starting from the respective lever, point with their free end towards the centre of the ski, the two levers each being mounted pivotably about a pivot in such a way that, when there is a pivoting movement of the levers about these pivots, the holding means are moved in a transverse direction of the ski; and a moveable positive control device, wherein a. the automatic front unit has a release position, in which the two holding means are at a first distance from each other and b. the automatic front unit has a securing position, in which the two holding means are at a second distance from each other, which is less than the first distance, c. in the securing position, the two levers are mounted on the positive control device, and d. in the securing position, the positive control device is movable along a control path aligned in the transverse direction of the ski, and controls movement, in the transverse direction of the ski, of the two levers in a coupled state within a dynamic region such that the two holding means remain coupled at the second distance from each other during movement within the dynamic range.

* * * * *